US006211627B1

(12) United States Patent
Callahan

(10) Patent No.: US 6,211,627 B1
(45) Date of Patent: Apr. 3, 2001

(54) LIGHTING SYSTEMS

(76) Inventor: Michael Callahan, 351 E. 84th St., #21A, New York, NY (US) 10028

( * ) Notice: Subject to any disclaimer, the term of this patent is extended or adjusted under 35 U.S.C. 154(b) by 0 days.

(21) Appl. No.: 09/384,129

(22) Filed: Aug. 27, 1999

Related U.S. Application Data

(63) Continuation-in-part of application No. 08/901,933, filed on Jul. 29, 1997, now abandoned.

(51) Int. Cl.[7] ..... G05F 1/00

(52) U.S. Cl. ..... 315/294; 315/297; 315/317; 315/199; 323/322; 323/905

(58) Field of Search ..... 315/292–295, 315/297, 312, 316, 317, 324, 360, 362, 199, 194, 195; 323/234, 237, 322, 905

(56) References Cited

U.S. PATENT DOCUMENTS

| | | | | |
|---|---|---|---|---|
| 3,691,404 | | 9/1972 | Swygert, Jr. | 307/252 |
| 4,348,582 | | 9/1982 | Budek | 219/483 |
| 4,392,121 | | 7/1983 | Gray et al. | 340/310 |
| 4,471,232 | | 9/1984 | Peddie et al. | 307/35 |
| 4,633,161 | * | 12/1986 | Callahan et al. | 315/194 X |
| 4,823,069 | * | 4/1989 | Callahan et al. | 315/194 X |
| 4,947,302 | * | 8/1990 | Callahan | 315/312 X |
| 4,975,629 | * | 12/1990 | Callahan et al. | 315/194 X |
| 4,980,806 | * | 12/1990 | Taylor et al. | 315/316 X |
| 5,004,957 | | 4/1991 | Cunningham | 315/199 |
| 5,055,746 | | 10/1991 | Hu et al. | 315/291 |
| 5,068,576 | | 11/1991 | Hu et al. | 315/291 |
| 5,107,184 | | 4/1992 | Hu et al. | 315/291 |
| 5,225,765 | * | 7/1993 | Callahan et al. | 315/194 X |
| 5,319,301 | * | 6/1994 | Callahan et al. | 315/294 X |
| 5,323,088 | | 6/1994 | Cunningham | 315/195 |
| 5,406,176 | * | 4/1995 | Sugden | 315/292 |
| 5,455,490 | * | 10/1995 | Callahan et al. | 315/194 |
| 5,530,322 | * | 6/1996 | Ference et al. | 315/295 |
| 5,629,607 | * | 5/1997 | Callahan et al. | 323/237 |
| 5,787,428 | * | 7/1998 | Hart | 707/9 |
| 5,821,703 | * | 10/1998 | Callahan et al. | 315/317 |
| 6,069,457 | | 5/2000 | Bogdan | 315/291 |

* cited by examiner

*Primary Examiner*—Haissa Philogene
(74) *Attorney, Agent, or Firm*—Davidson, Davidson & Kappel, LLC

(57) ABSTRACT

Improvements to lighting systems, especially for entertainment and architectural applications are disclosed, including apparatus that permit a user to readily field-configure power distribution to branch circuits to be dimmed or un-dimmed, single- or multi-phase, as required; communication of data over existing power wiring by variations in output of dimmers; and improved methods for generating, managing, and distributing data specifying the physical and electrical configurations of a lighting system.

7 Claims, 50 Drawing Sheets

LIGHTING SYSTEMS

This represents a continuation in part of U.S. patent application Ser. No. 08/901,933 filed Jul. 29, 1997, now abandoned, entitled "Improvements to Lighting Systems Including for Management and Integration of System Specification Data", the entire disclosure of which is hereby incorporated by reference. This application includes material disclosed in Disclosure Documents Nos. 380187 and 380229.

FIELD OF THE INVENTION

This application relates to the field of lighting systems.

Prior disclosures of lighting systems and improvements thereto include U.S. Pat. Nos. 4,633,161; 4,823,069; 4,975,629; 5,225,765; 5,319,301; 5,455,490; 5,629,607 and 5,821,703.

BRIEF SUMMARY OF THE INVENTION

One aspect of the disclosure relates to apparatus that provide for the distribution of electrical power to a plurality of branch circuits, the apparatus being readily reconfigurable so as to make such circuits dimmed or not-dimmed, single or multi-phase, as the user requires.

Another aspect of the invention is the deliberate introduction of variations into the output of a dimmer or other power controller so as to encode data in a form detectable in the load wiring and at the load. Such information can include data identifying the dimmer and its assigned control channel; descriptive information about the load; and for remote control. Such data can be captured by devices in direct electrical contact with the circuit; by devices inductively or capacitively coupled to the load or the load wiring; and/or by devices optically coupled to light sources or indicators having a sufficient speed of response. The technique can also be with loads not normally employed with dimming (such as fixtures with gas discharge sources). Where full-range dimming is not required, a choke, controlled transition, or forced air cooling of the power devices may not be required.

Another aspect of the invention is the use of apparatus, methods, and techniques at or near the load that produce a change in electrical characteristics detectable upstream in the system (for example, at a dimming or distribution point) to signal or communicate with other components in the system.

Another aspect of the invention is the maintenance of a minimum average voltage level by a dimmer and the use of apparatus, methods, and techniques to provide a source of power to supply electronics and actuators at a remote location without the requirement for a separate undimmed supply circuit.

Another aspect of the invention relates to various apparatus, methods, and techniques for communication within and between points in a lighting system.

Another aspect of the invention relates to various apparatus, methods, and techniques by which the processes of setting-up, focusing, changing, maintaining, troubleshooting, and documenting lighting systems and lighting designs can be made more efficient, including means for providing broader access to information about the lighting system; and an interactive connection between the components maintaining such information and the console and dimmers.

Apparatus, methods, and techniques are described for turning on fixtures to test and focus them and for providing interactivity with the console and dimmers, as well as with the elements maintaining such information, and apparatus, methods, and techniques are disclosed by which the type, location, circuiting, and orientation of lighting fixtures can be rapidly entered.

BRIEF DESCRIPTION OF THE DRAWINGS

FIG. 1I illustrates a portion of a lighting system that packages dimmer power stages in mechanical modules separate from the branch circuit protection elements, showing the use of a switch/contact assembly for the shunt function.

FIG. 1O is a detail view illustrating modification of the power stage condition when used with a multi-phase load.

FIG. 1S illustrates an apparatus that provides for the distribution of single and multi-phase power with selective dimming capability.

FIG. 3O illustrates one possible mechanical design for the combination of FIG. 3N.

DETAILED DESCRIPTION

One aspect of the invention relates to improvements to apparatus for distributing and controlling power to loads.

Figure 1A:
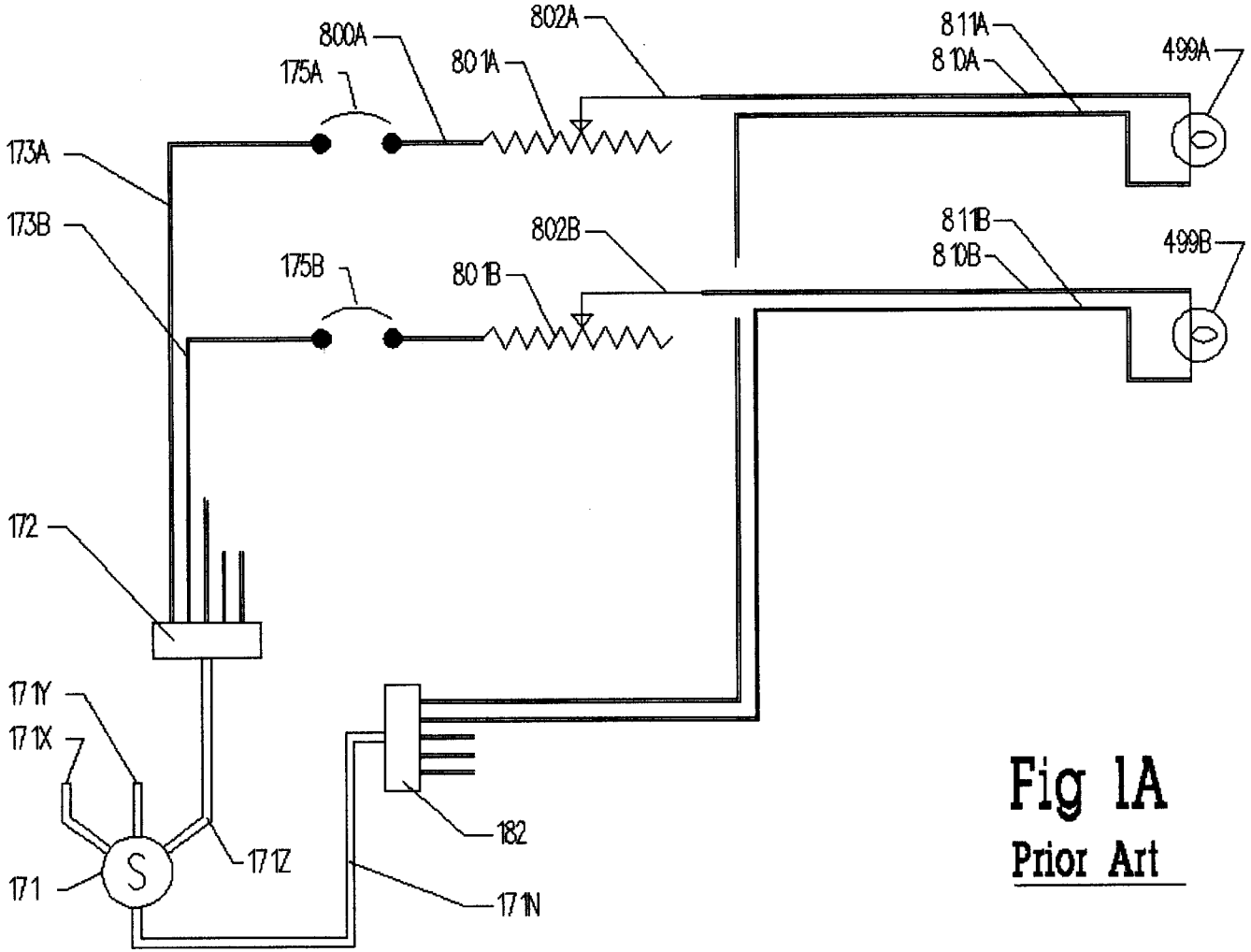
Fig 1A Prior Art
FIG. 1A illustrates a prior art lighting system including a plurality of dimmers.

Refer now to FIG. 1A.

In a traditional lighting system, a plurality of light sources/lamp loads, for example, 499A and 499B, are supplied from a common source of electrical power 171. The versatility of the lighting system is increased by providing for the separate adjustability of the intensity of each of the plurality of lamp loads 499A and 499B by means of dimmers 801A and 801B, such dimmers interposed between the electrical supply 171 and their respective lamp loads. Dimmers 801A and 801B variably limit the fraction of the average power available from supply 171 that is permitted to pass through their respective lamp loads and, consequently, the brightness of those lamp loads. At the turn of the century (and in a few applications until the 1960s), dimmers 801A and 801B would be "rheostats"—high—wattage variable power resistors. "Rheostats" were supplanted by "variacs" (variable secondary tap transformers) and both by the thyristor-based phase-control dimmer, which has been dominant for decades.

The lighting system of FIG. 1A finds applications in entertainment and architectural lighting, in both portable and permanently installed variations. Dimmers 801A and 801B may be both mechanically and electrically independent of each other or they may be combined in a common mechanical enclosure (i.e., a "dimmer pack" or "dimmer rack") and/or may share certain components (for example, common drive electronics). All or part of the supply wiring between electrical supply 171 and the dimmers 801A and 801B may be permanent or temporary/portable, as may the load wiring conductors 810A and 811A and 810B and 811B between the dimmer outputs 802A and 802B and the lamp loads 499A and 499B. Such load wiring may or may not incorporate single- or multi-circuit connectors at one or more points intermediate between dimmer and load and/or provisions to "load-patch" the output of a given dimmer with one or more different circuits coupled to different lamp loads.

FIG. 1A illustrates a typical alternating-current electrical power supply 171 having three different phases: 171X, 171Y, and 171Z and a neutral 171N. Distribution busses 172 and 182 are illustrated between the high-current electrical supply and the smaller branch circuits, those branch circuits protected by current-limiting means 175A and 175B, typically circuit breakers. These distribution busses may or may not be contained within the same enclosure as dimmers 801A and 801B. Multiple levels of distribution and circuit protection may be incorporated in a system.

Figure 1B:
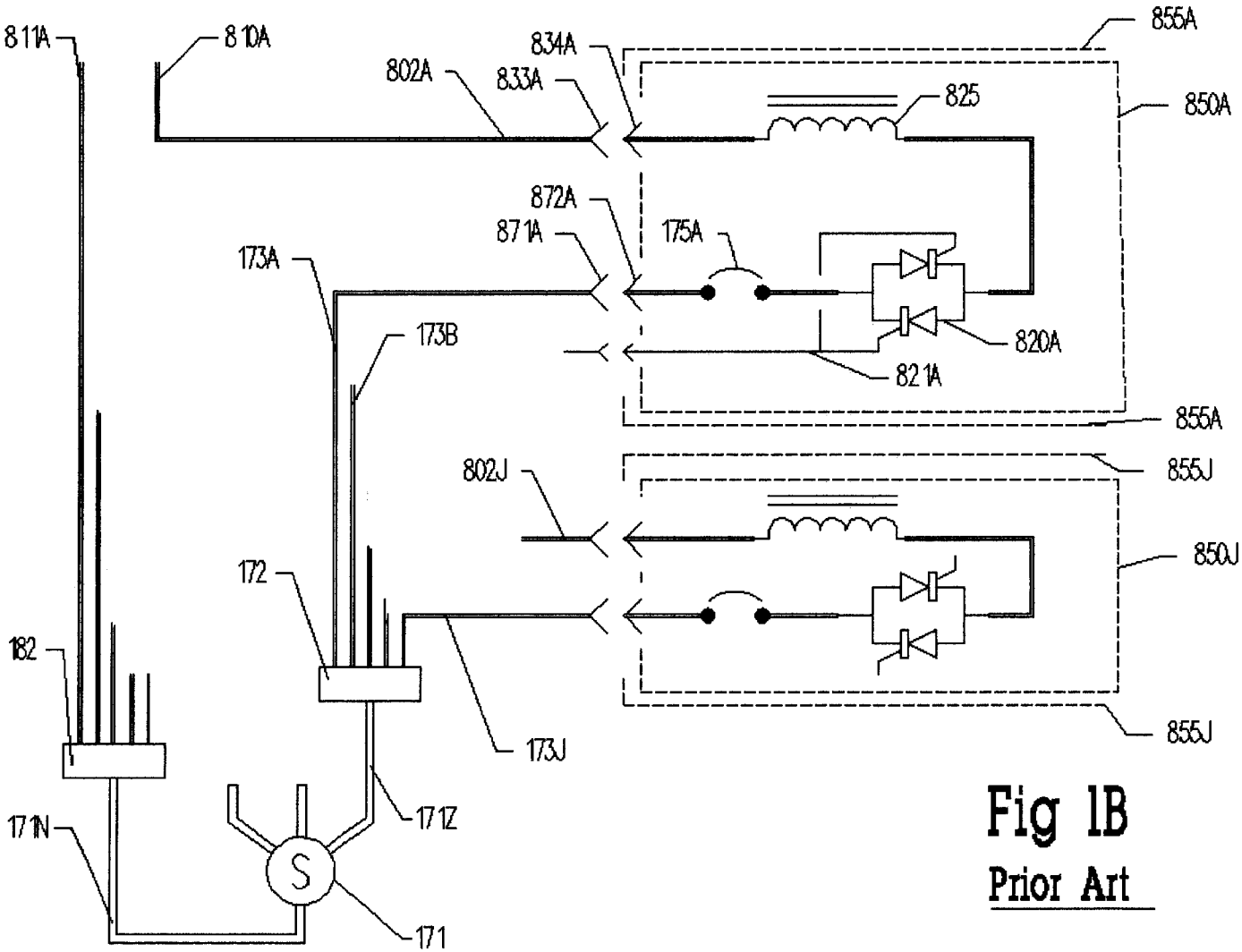
Fig 1B Prior Art
FIG. 1B illustrates a portion of a prior art lighting system including a plurality of mechanical modules, each module containing at least the power stage of one dimmer.

FIG. 1B illustrates one embodiment of a modern dimmer rack or pack. A plurality of mechanical modules 850A and 850J are shown, representative of a larger number.

Each such module contains at least the power level components of a dimmer, including (in the illustrated example, module 850A) current-limiting means circuit breaker 175A, inverse-parallel thyristors 820A, and choke/inductor 825A. The module inserts in a corresponding position (e.g. 855A) in a rack or pack; electrically interconnecting at the power level through supply input (871A and 872A) and load output (833A and 834A) contacts, as well as through low-current connections for drive to the gates of thyristors 820A via 821A.

(In this and some subsequent Figures, for reasons of Figure composition, the "A" module and the "J" module are illustrated as being of different heights. It will be understood that modules and chassis positions of the same type in a given rack or pack are typically of the same height.)

(In this and subsequent Figures, the sex of contacts illustrated (e.g., that of 871A and 872A) should not be taken as restrictive. While many early modular dimmer modules frequently mounted female receptacles on the chassis and male contacts on the dimmer modules, other embodiments have differed. For example, in some current designs, apparently "female" receptacles on the dimmer modules engage "male" bus bars and contacts in the chassis.)

Figure 1C:
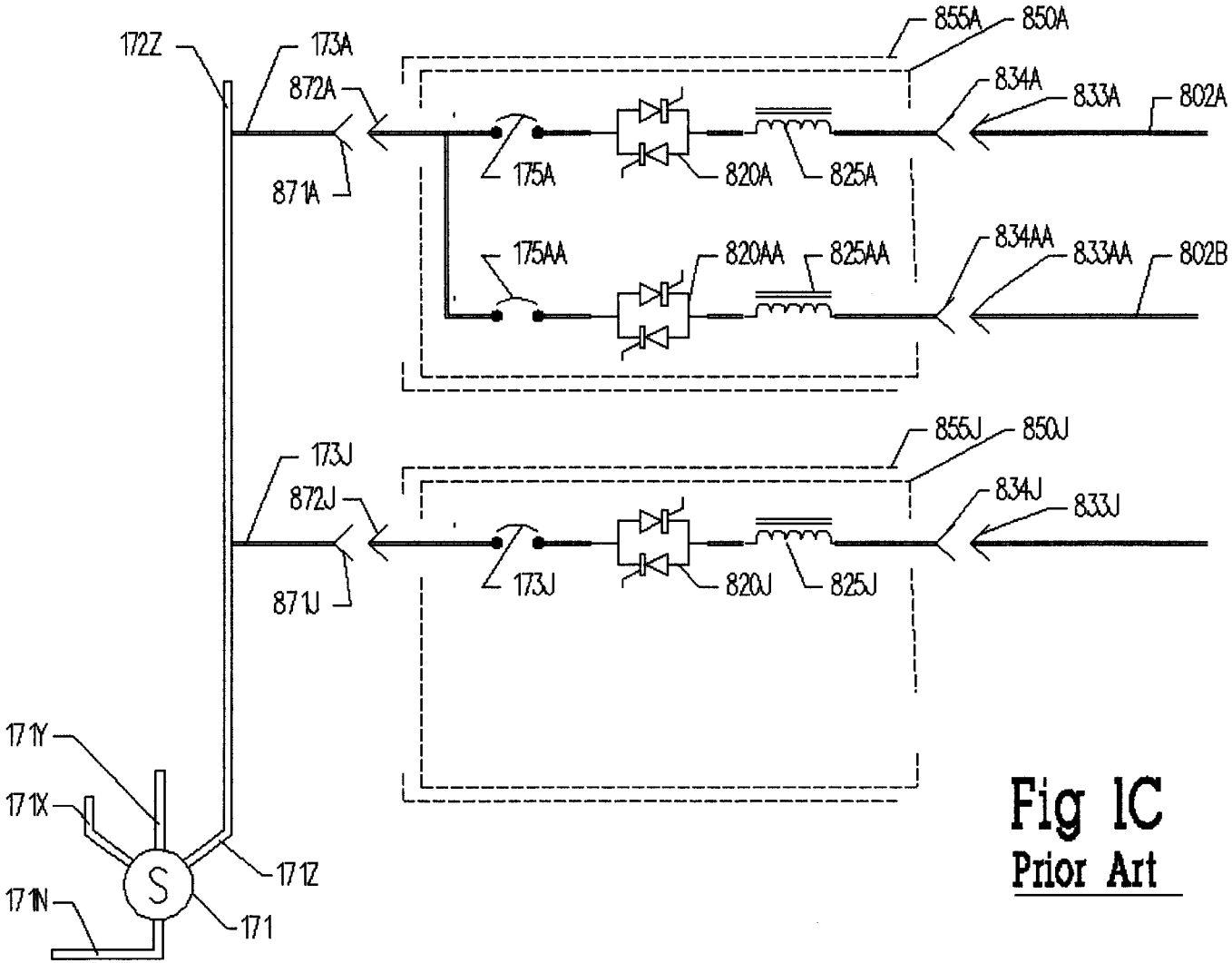
Fig 1C Prior Art
FIG. 1C illustrates a portion of a prior art lighting system including a plurality of mechanical modules, each module containing at least the power stage of one or more dimmers.

Dimmers are produced in a range of capacities from a few hundred watts to 12,000. In earlier practice (e.g., the Skirpan Electronics "C" series of Skirpan Electronics, Long Island City, N.Y.) the use of a single power stage per module, when combined with the differences in the heat sink size required, resulted in different module package sizes for different wattages (in the Skirpan case, having the same frontal cross-section, but with very different depths). Over time, variations in module size were reduced (and certain economies achieved) by packaging a plurality of dimmer power stages of smaller capacity in the same size module as required for a single power stage of larger capacity. For example, modules of the same size could incorporate either two 2400-watt dimmers or one 6000-watt dimmer (or four 1200-watt dimmers). FIG. 1C illustrates such an alternative, notable examples of which include the Strand Lighting "CD80", the Colortran "D192" and "ENR", and the Electronic Theatre Controls "Sensor". Illustrated module 850A is a "dual 2.4 kw" including two 2400-watt power stages, "A" and "AA". Module 850J is a "6 kw" with a single 6000-watt capacity power stage. While the two modules (and a 4×1200-watt module) are all of the same size, they have not been made field-interchangeable in a given rack or pack position because of the differences in their load wiring requirements.

(FIGS. 1B and 1C also illustrate another variation in the design of dimmer racks and packs. In many earlier modular designs, supply power was distributed to the various branch circuits via distribution blocks (e.g., block 172 of FIG. 1B) that adapted between large gauge, high-current supply conductors and the plurality of smaller gauge conductors supplying individual dimmer modules. In some recent modular designs (e.g., as illustrated in U.S. Pat. No. 4,977,484) the distribution function is provided by an elongated bus bar (e.g. 172Z of FIG. 1C), which the individual modules engage either directly or via a contact mounted to it. Both variations are schematically depicted in these and subsequent Figures (as is a drawing convention in certain detailed views that shows a direct transition between the high-current and lower-current supply conductors (e.g., FIG. 1J)). None should be taken as restrictive.)

In the entertainment lighting systems of the 1960s and 1970s, virtually all light fixtures (with the exception of followspots) were built around incandescent light sources and as such, in both permanently-installed and portable applications, such dimmer racks were suitable for the systems' requirements.

The requirements of many events and installations have, however, changed.

Figure 1D:
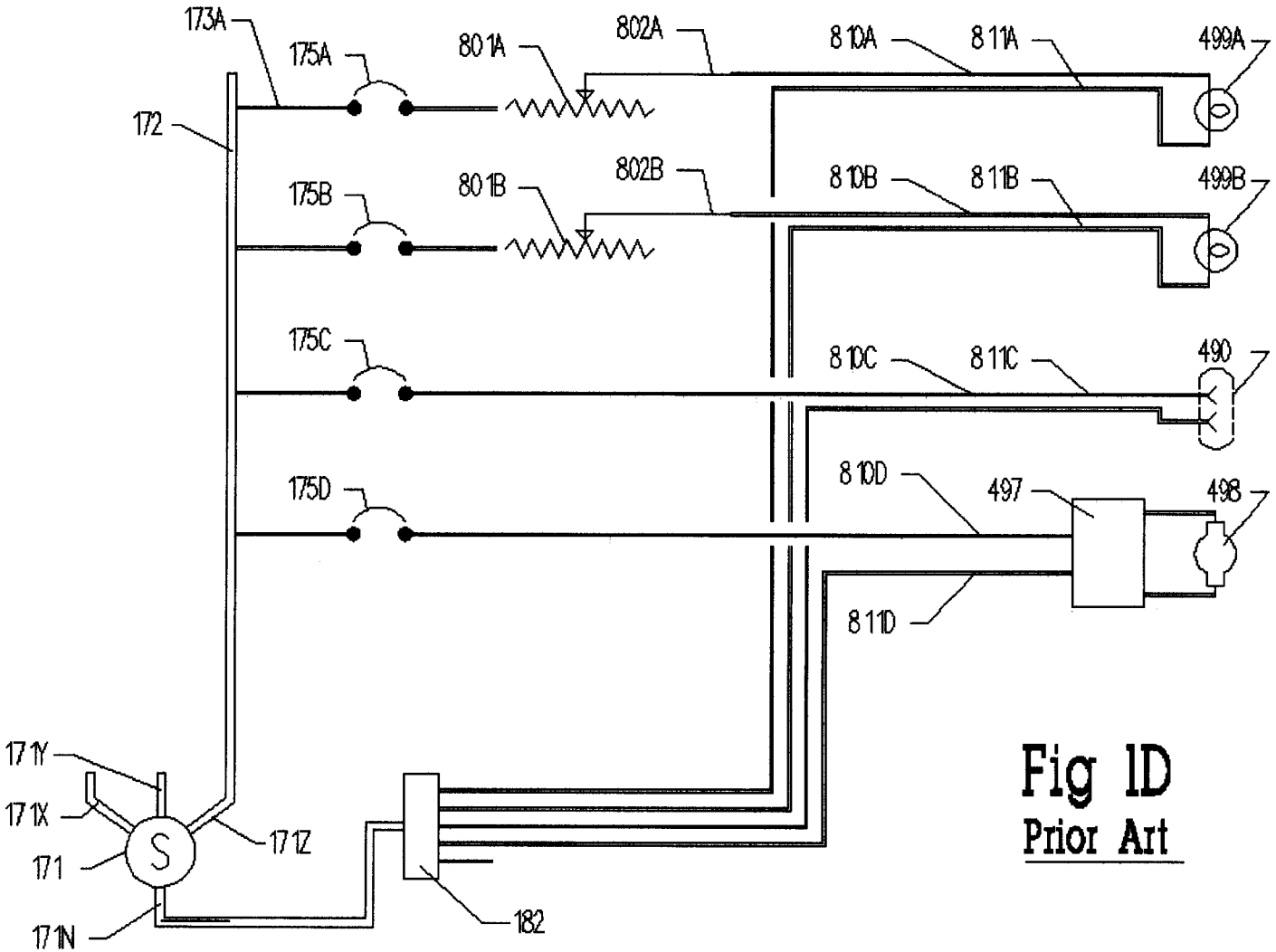
Fig 1D Prior Art
FIG. 1D illustrates a prior art lighting system requiring both dimmed and undimmed branch circuits.

Refer now to FIG. 1D.

While incandescent light sources remain in use, new requirements have arisen. A variety of loads, require (or accept) only line voltage; dimming is either unnecessary or undesirable. Examples include the increasing use of various fixture types employing gas discharge sources (e.g. 498) supplied by ballasts (e.g. 497), as well as the requirements of a wide variety of lighting and non-lighting electrical and electronic devices. Traditional dimmer racks and packs are ill suited to this requirement.

Figure 1E:
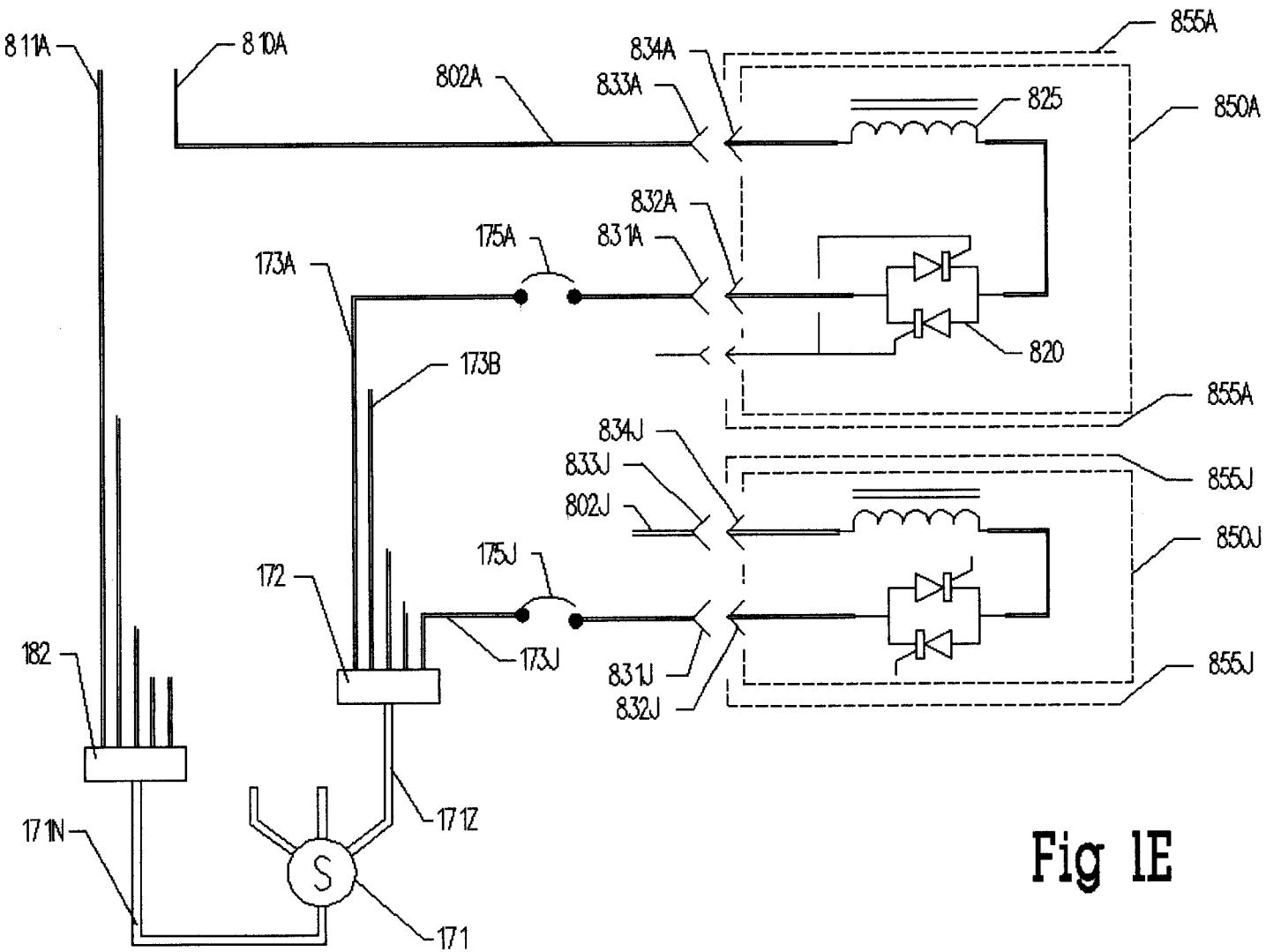
FIG. 1E illustrates a portion of a lighting system that packages dimmer power stages in mechanical modules separate from the branch circuit protection elements.

FIG. 1E illustrates a superior alternative. Unlike the apparatus of FIGS. 1B and 1C, the apparatus of FIG. 1D places the power level components of at least one dimmer in a module (e.g. 850A) that is mechanically separate from its branch circuit protection element(s), here circuit breaker 175A. (That the power level dimmer component(s) are in a module mechanically separate from the branch circuit protection element(s) does not mean that the circuit protection element(s) may not, themselves, also be mechanically modular.)

Figure 1F:
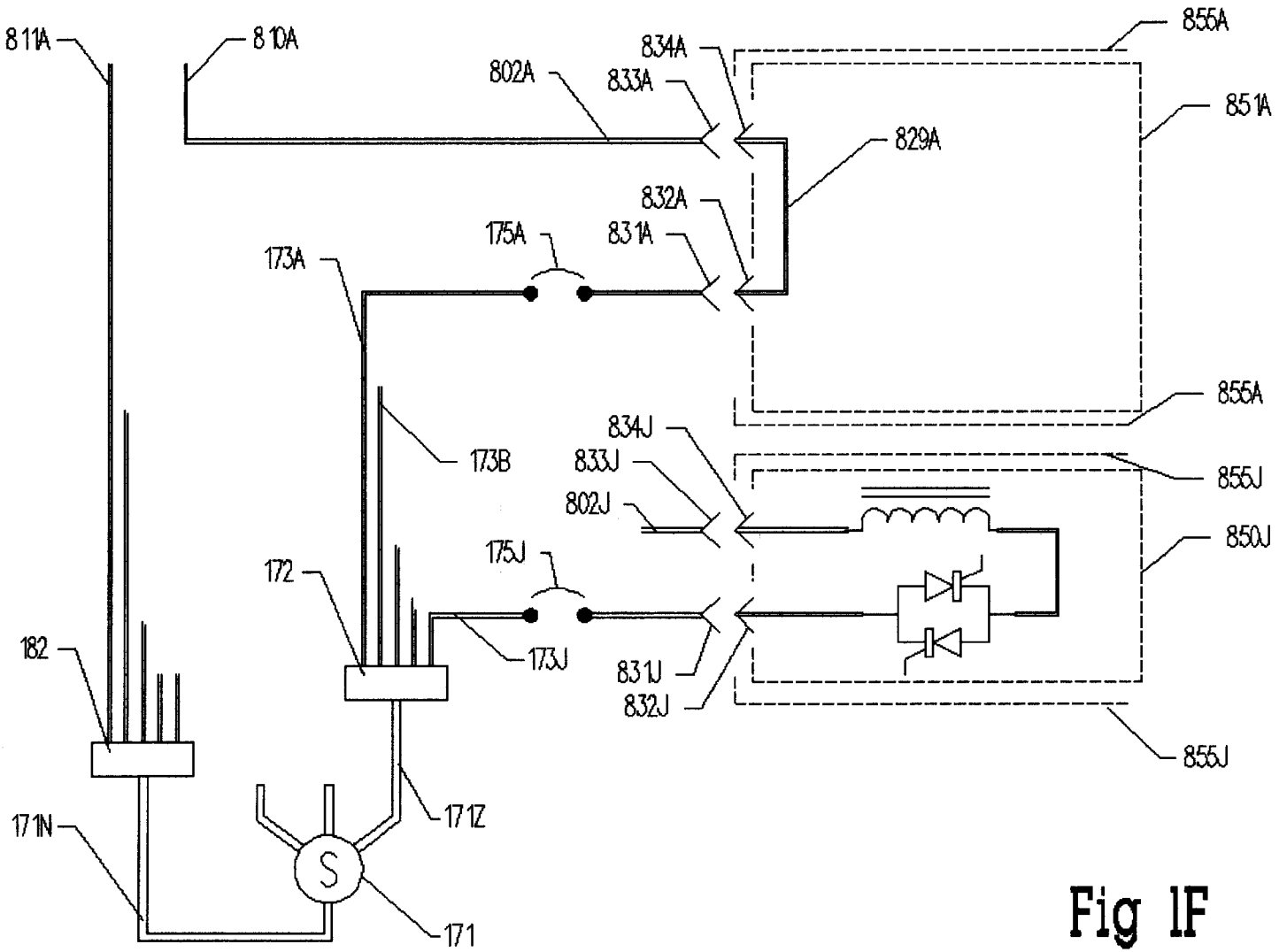
FIG. 1F illustrates a portion of a lighting system that packages dimmer power stages in mechanical modules separate from the branch circuit protection elements, showing the use of a module containing a shunt.

FIG. 1F illustrates one benefit: the ability to readily substitute for the dimmer power stage, a module 851A containing only a shunt 829A, supplying power to a load.

Figure 1G:
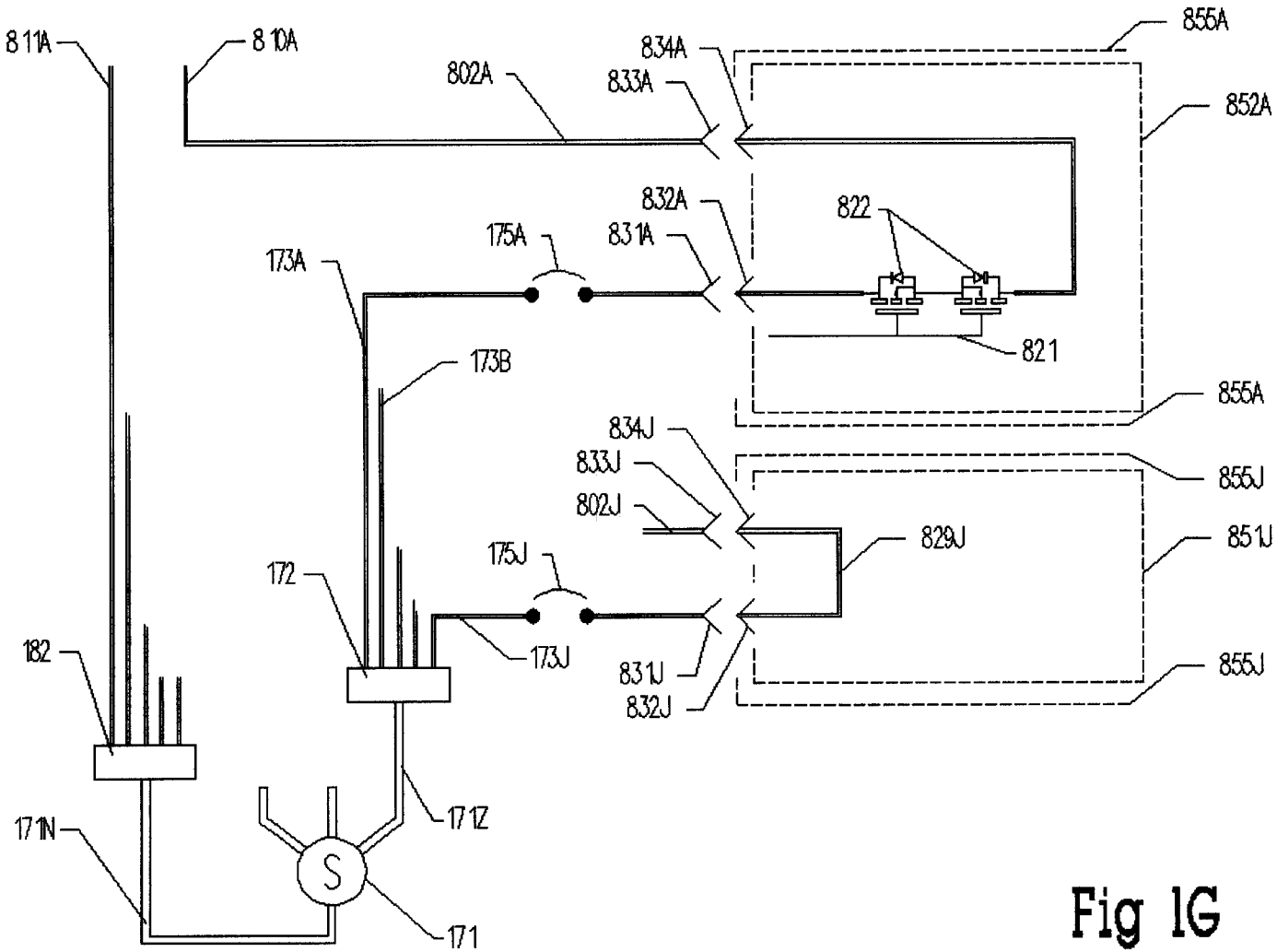
FIG. 1G illustrates a portion of a lighting system that packages dimmer power stages in mechanical modules separate from the branch circuit protection elements, showing the use of a non-SCR power stage.

FIG. 1G illustrates the use of non-SCR power devices in a power stage.

Modes for a power stage employing one or more such power devices include linear operation and pulse-width modulation. Another mode having many advantages is controlled-transition, such as disclosed in U.S. Pat. Nos. 4,633,161; 4,823,069; 4,975,629; 5,225,765; 5,319,301; 5,455,490; 5,629,607 and 5,821,703, which are included in their entirety by reference.

The elimination of a traditional choke, the largest and heaviest of power-level components in a dimmer, allows a radical reduction in the size and weight of the total package. When a non-SCR power stage is employed in a mechanical module separate from the branch circuit protection element (s), and with provision to shunt power to the load when the power stage is not required, the result is a uniquely compact, versatile, and efficient solution to modern requirements.

Figure 1H:
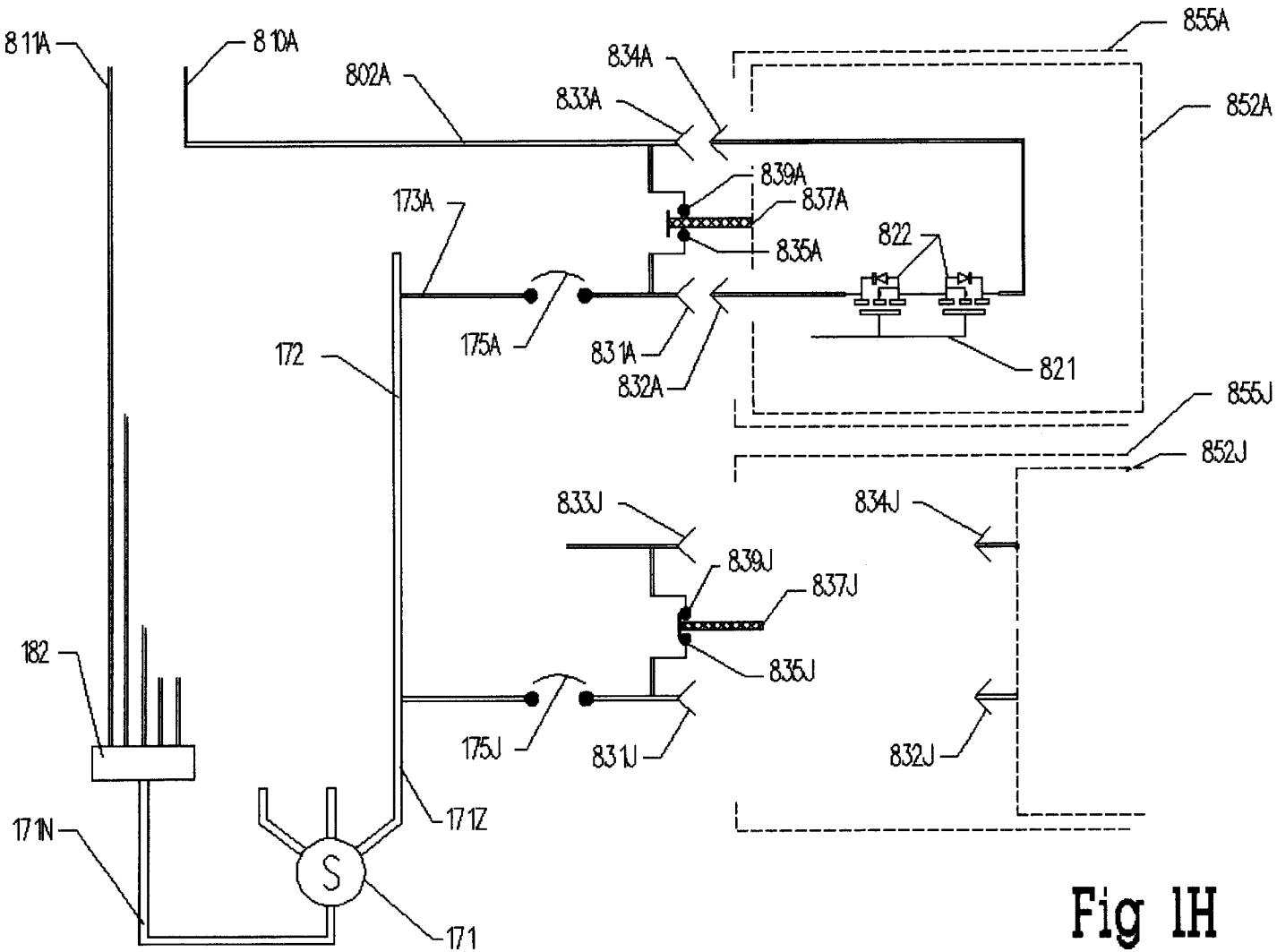
FIG. 1H illustrates a portion of a lighting system that packages dimmer power stages in mechanical modules separate from the branch circuit protection elements, showing the use of a switch performing the shunt function.
Figure 11:
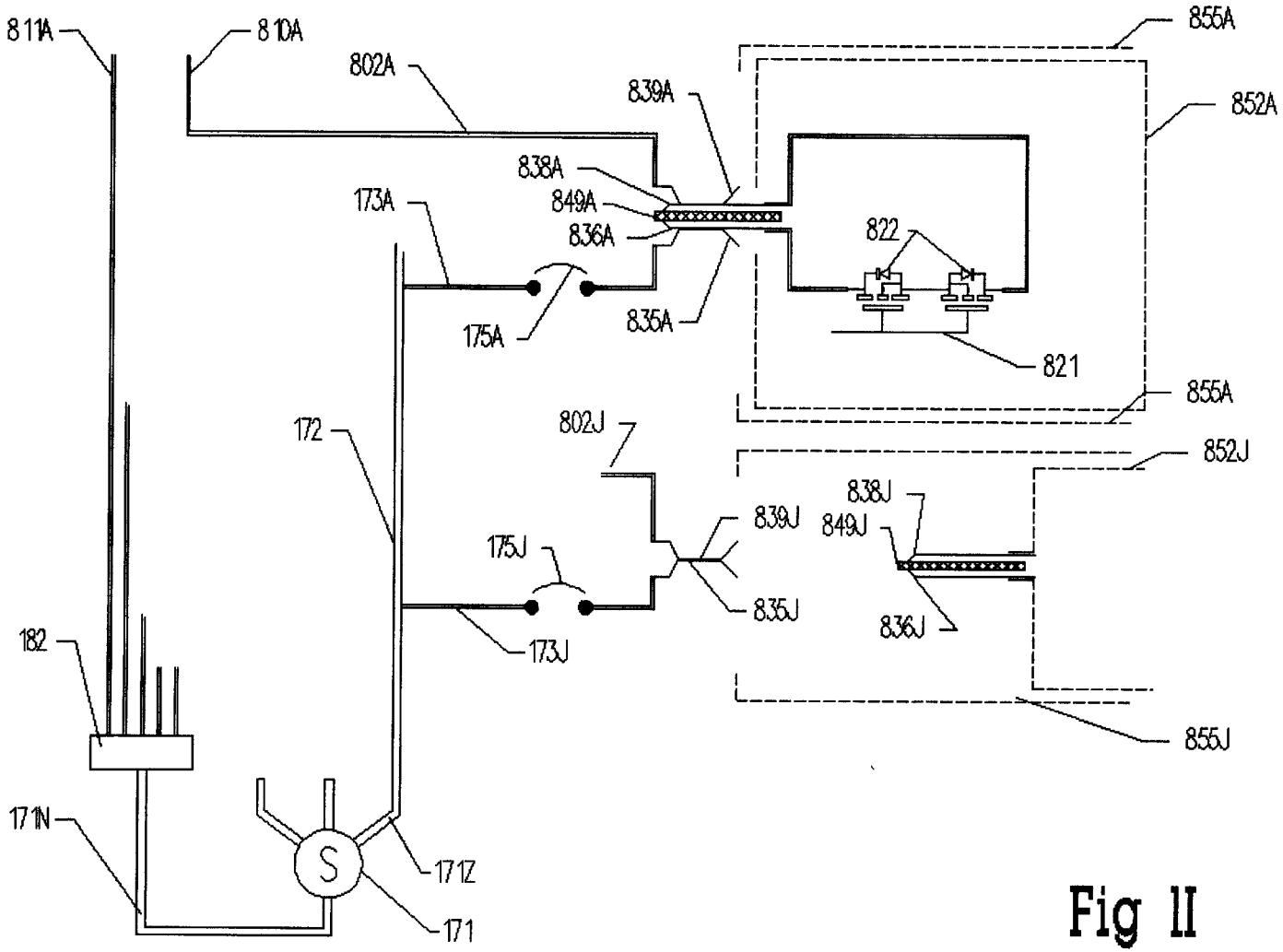

FIG. 1H illustrates one embodiment of an apparatus that does not require the use of a shunt module. The illustrated embodiment employs a switch or similar component. In the illustrated embodiment, the operation of the switch is automatic. The switch is illustrated as having an actuator (e.g. 837A) which, when depressed by the insertion of a dimmer module (e.g. 852A), causes the diversion of power from supply 171 through the power stage in the dimmer module. When the dimmer module is removed (e.g., in the case of module 852J), the normally-closed switch shunts power via contacts 835J and 839J.

FIG. 1I illustrates another embodiment that does not require the use of a shunt module. The illustrated embodiment employs two contacts on the dimmer module (e.g. 836J and 838J) that are electrically isolated from one another (e.g., by insulator 849J). Insertion of the dimmer module in a chassis position (e.g., module 852A into position 855A) inserts the contacts for the dimmer module between a contact (e.g. 835A) connected to the supply and a second contact (e.g. 839A) connected to the load, inserting the dimming power stage into the electrical circuit. Without the presence of a dimmer module and its contacts (e.g., in the example of chassis position 855J), the contacts on the chassis side (e.g. 835J and 839J) close the circuit between supply and load.

Figure 1J:
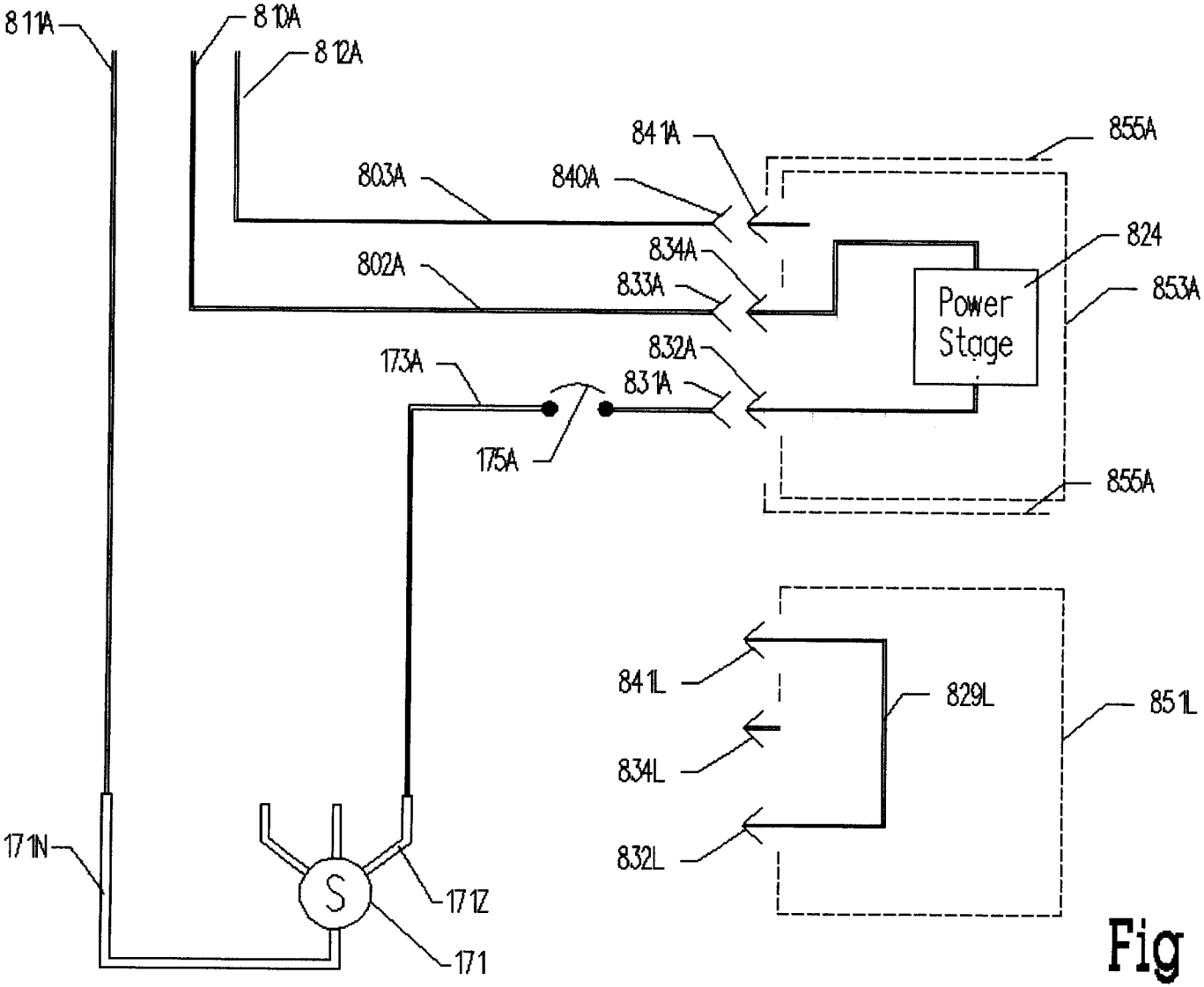
FIG. 1J is a detail view illustrating separate contacts/outputs for dimmed and undimmed power.

FIG. 1J illustrates an embodiment in which the supply of current is routed to different outputs of the apparatus depending upon whether a dimmer module is or is not employed. In the illustrated embodiment, the insertion of a dimmer module (e.g. 853A) into a chassis position results in the coupling of supply power, via the power stage 824, to one output 810A, via contacts 833A and 834A. Insertion of a shunt module (e.g. 851L) couples supply power to a different pair of contacts 840A and 841L, and to a different output 812A.

Figure 1K:
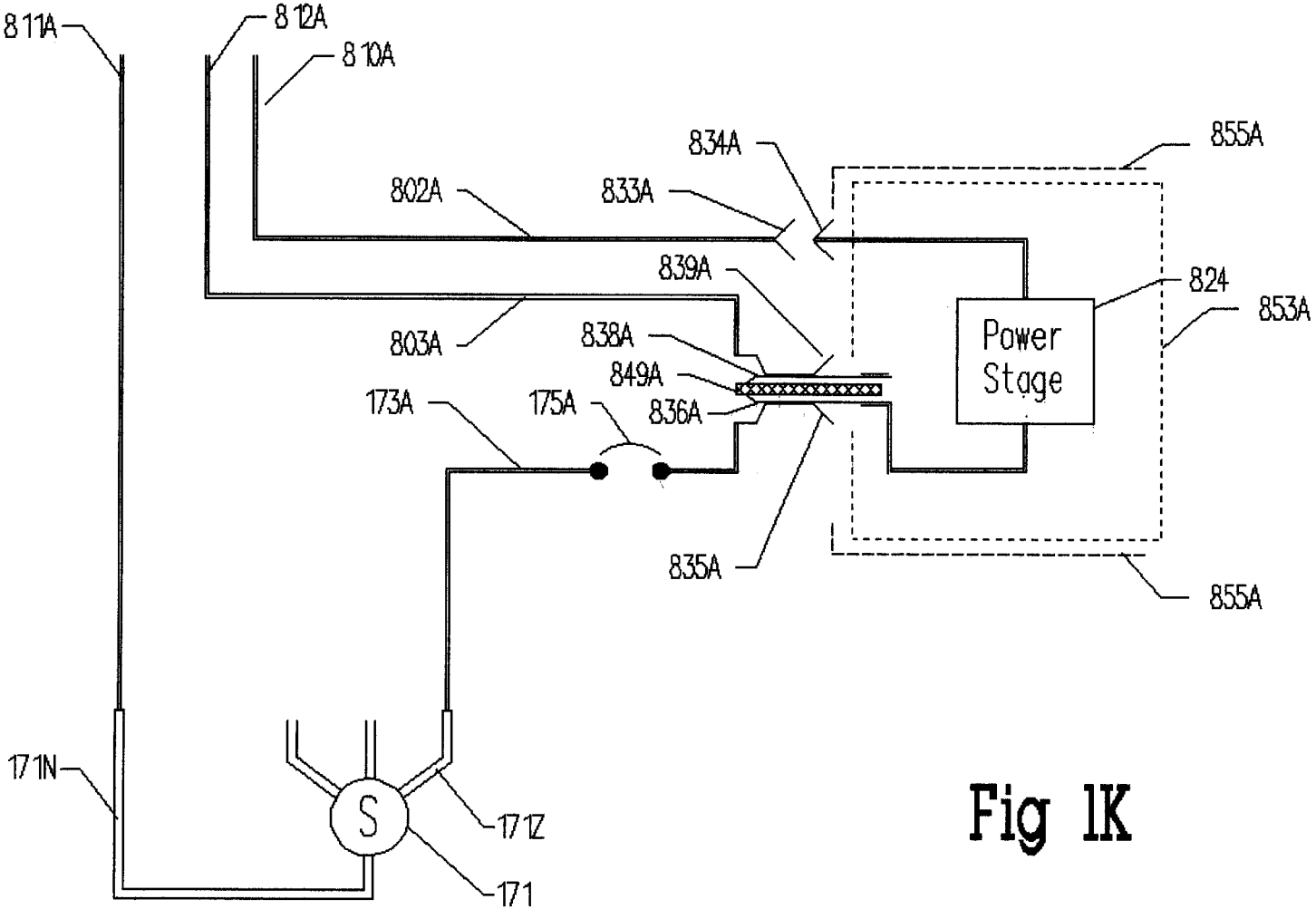
FIG. 1K is a detail view illustrating the routing of dimmed and undimmed power to separate outputs.

FIG. 1K illustrates an embodiment combining a switching component and separate outputs. It will be seen that the insertion of dimmer module 853A couples supply power to output 810A via contacts 833A and 834A, while the removal of the module shunts power directly to output 812A via contacts 835A and 839A.

Figure 1L:
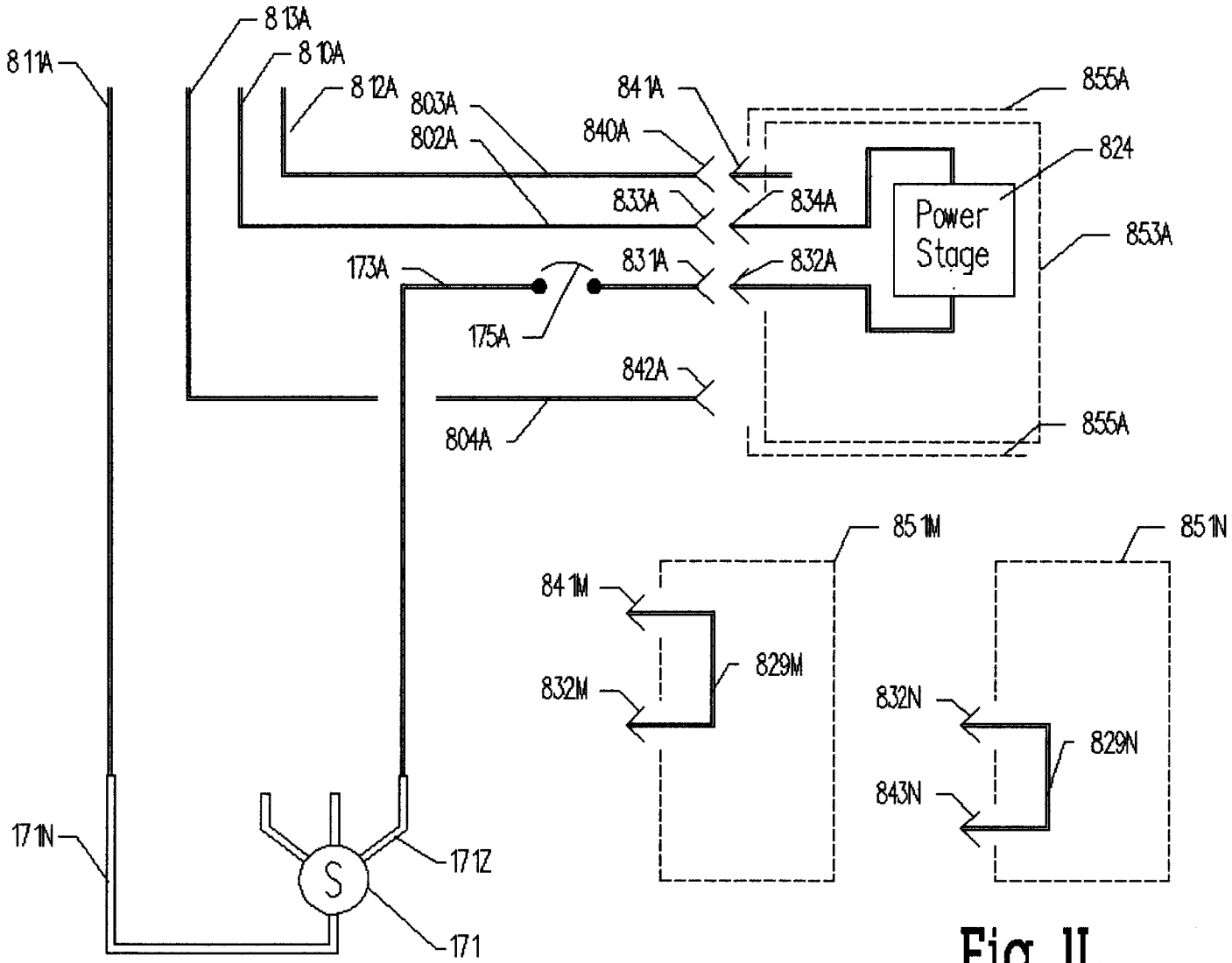
FIG. 1L is a detail view different output.

FIG. 1L illustrates an embodiment in which different modules (e.g. 851M and 851N) can be inserted in a chassis position, each routing power to different outputs (e.g., to output 812A by module 851M via contact 840A, or to output 813A by module 851N via contact 842A).

It will also be seen that a single module can be designed that couples power to different outputs depending upon its orientation on insertion—for example, module 851M might be inverted to perform the same function as module 851N.

Different modules can employ different types of dimming, sensing, additional circuit protection, and/or power conditioning and, as illustrated in some subsequent Figures, a module may supply multiple outputs from a single input, those outputs having the same or different characteristics. Examples include the ability to insert modules dimming incandescent loads and ballasts for gas discharge sources.

The apparatus and techniques disclosed herein can also be used in the distribution of power to dimmers located in proximity to their loads.

(The presence or absence of unused contacts in these and other Figures, for example, contact 841A in FIG. 1L, should not be taken as restrictive.)

Figure 1M:
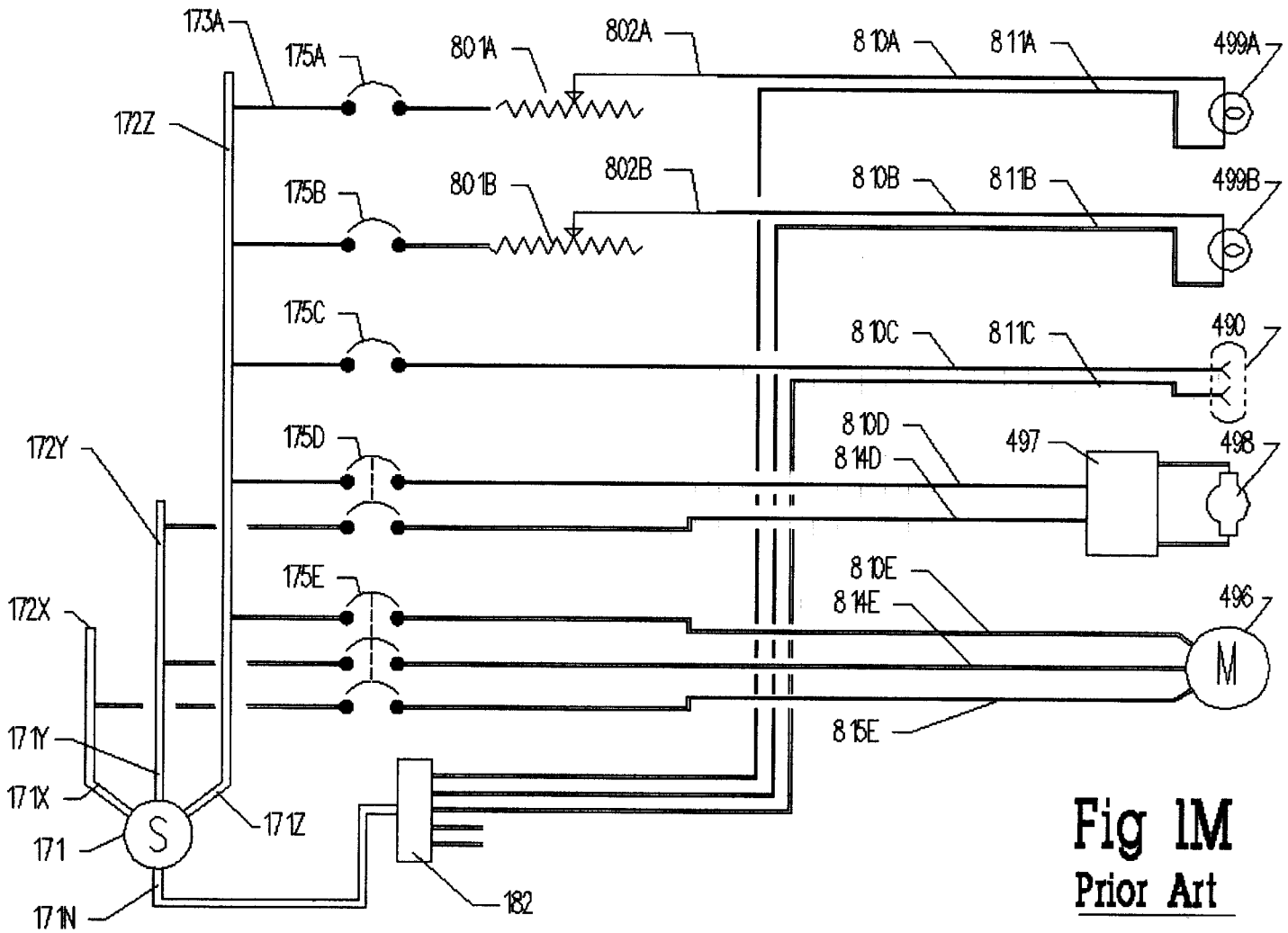
Fig 1M Prior Art
FIG. 1M illustrates a prior art lighting system requiring dimmed branch circuits and also undimmed branch circuits in both single and multi-phase configurations.

Refer now to FIG. 1M.

Unlike the lighting systems of prior eras, many modern systems require not only provisions to dim lamp loads (e.g., in the case of lamp loads 499A and 499B) and to supply undimmed power to other loads (e.g., output receptacle 490) but also to supply multi-phase power to loads of various types, for example, to ballasts for gas discharge sources (e.g. 498), heater coils, and motors (e.g. 496). Prior art dimmer racks, whether for permanent installations or portable use, are not designed to provide flexible multi-phase branch circuit distribution.

Figure 1N:
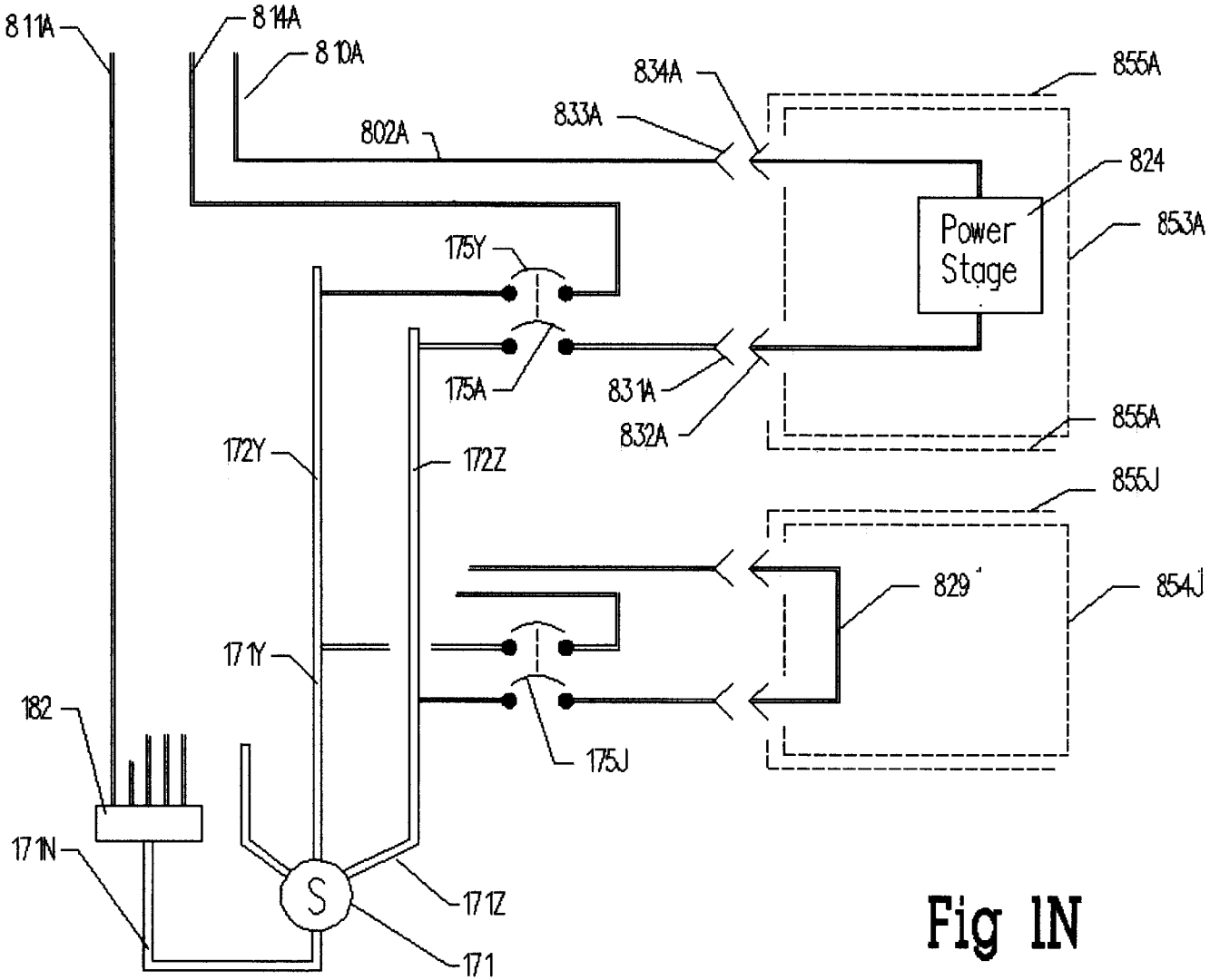
FIG. 1N illustrates a portion of a lighting system that packages dimmer power stages in mechanical modules separate from the branch circuit protection elements and provides for multi-phase power outputs.

Refer now to FIG. 1N.

Like the embodiment of FIGS. 1E–1L, the apparatus of FIG. 1N provides for the selective insertion of dimmer modules (e.g. 853A) into branch circuit distribution. Unlike the embodiments illustrated in prior Figures, the apparatus of FIG. 1N provides for multi-phase distribution. Branch circuit protection device 175A is illustrated as a two-pole common-trip circuit breaker that protects two phases of a multi-phase branch circuit (phase Z via pole 175A and phase Y via pole 175Y). In the illustrated embodiment, the additional phase branch circuit is routed directly to an output 814A, and a single-phase load can be supplied by connection between dimmable output 810A and neutral 811A or a multi-phase load supplied by connection between output 810A and additional phase output 814A.

Figure 10:
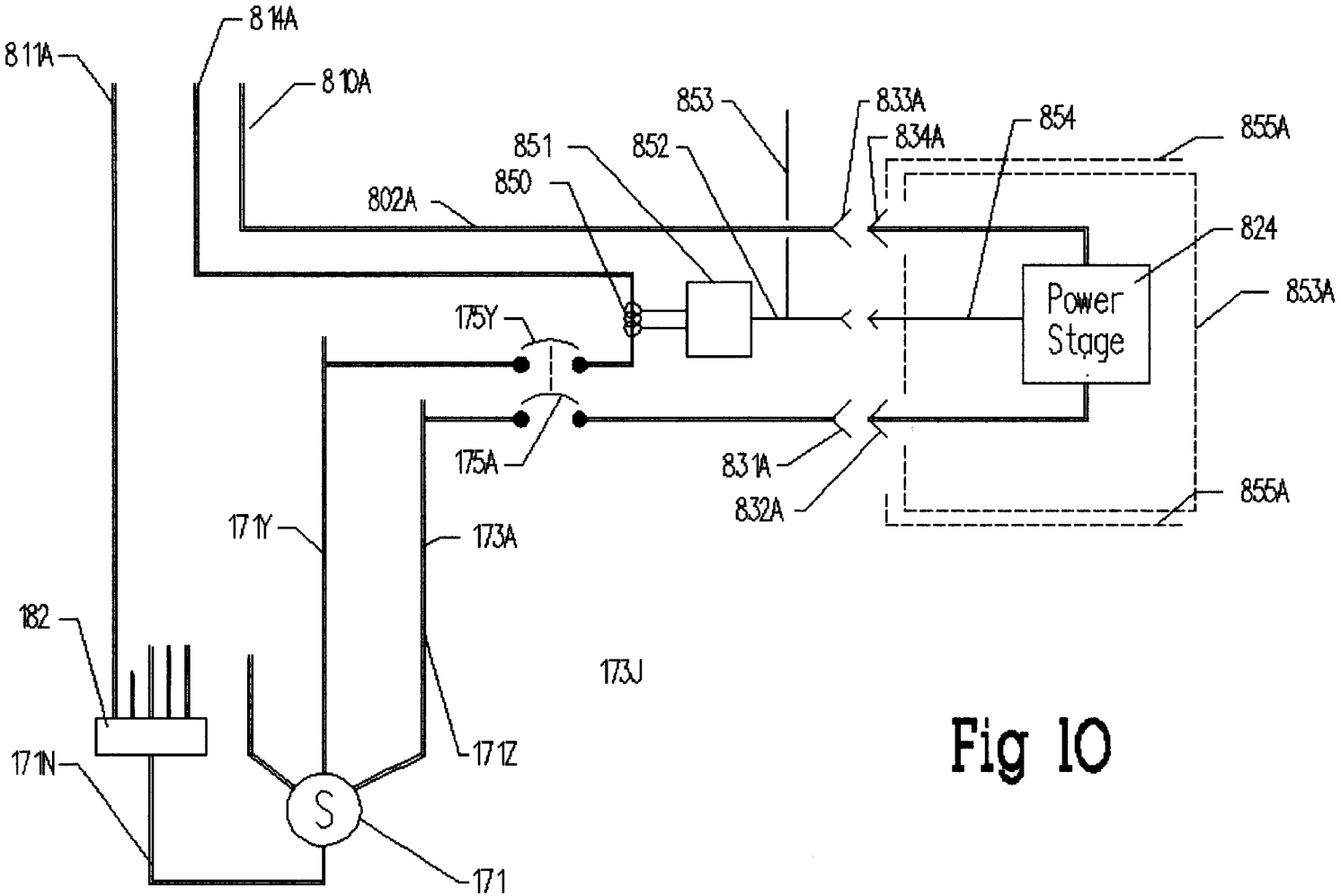

With a load connected between dimmable output 810A and additional phase output 814A, a dimmer power stage 824 is inserted in the circuit. FIG. 10 illustrates some of the possible methods of assuring that, when desired, such a dimmer power stage is forced into substantially full conduction when a multi-phase load is connected across the two phase outputs.

Techniques of data communication will be subsequently disclosed in which at least one power device is inserted in series with a branch circuit and used to modify the waveform in the power wiring in order to encode data.

Power stage 824 is illustrated as having a control input 854 that can be employed to force the power stage into full conduction (or alternatively into other conditions for the above-described data communication, for current-limiting, or for other purposes). Control input 854 can be driven by a control signal generated by a mode selection elsewhere (for example, at a user interface at the rack or system level) via control line 853. Control input 854 can also be driven by components sensing the connection of a load across the two phase terminals, here illustrated as 851 with associated sensor 850.

The output of 851, in addition to driving control input 854 of power stage 824, is also present on line 853 and therefore the detection of a multi-phase load and the driving of the power stage into conduction can be reported to other portions of the system.

Figure 1P:
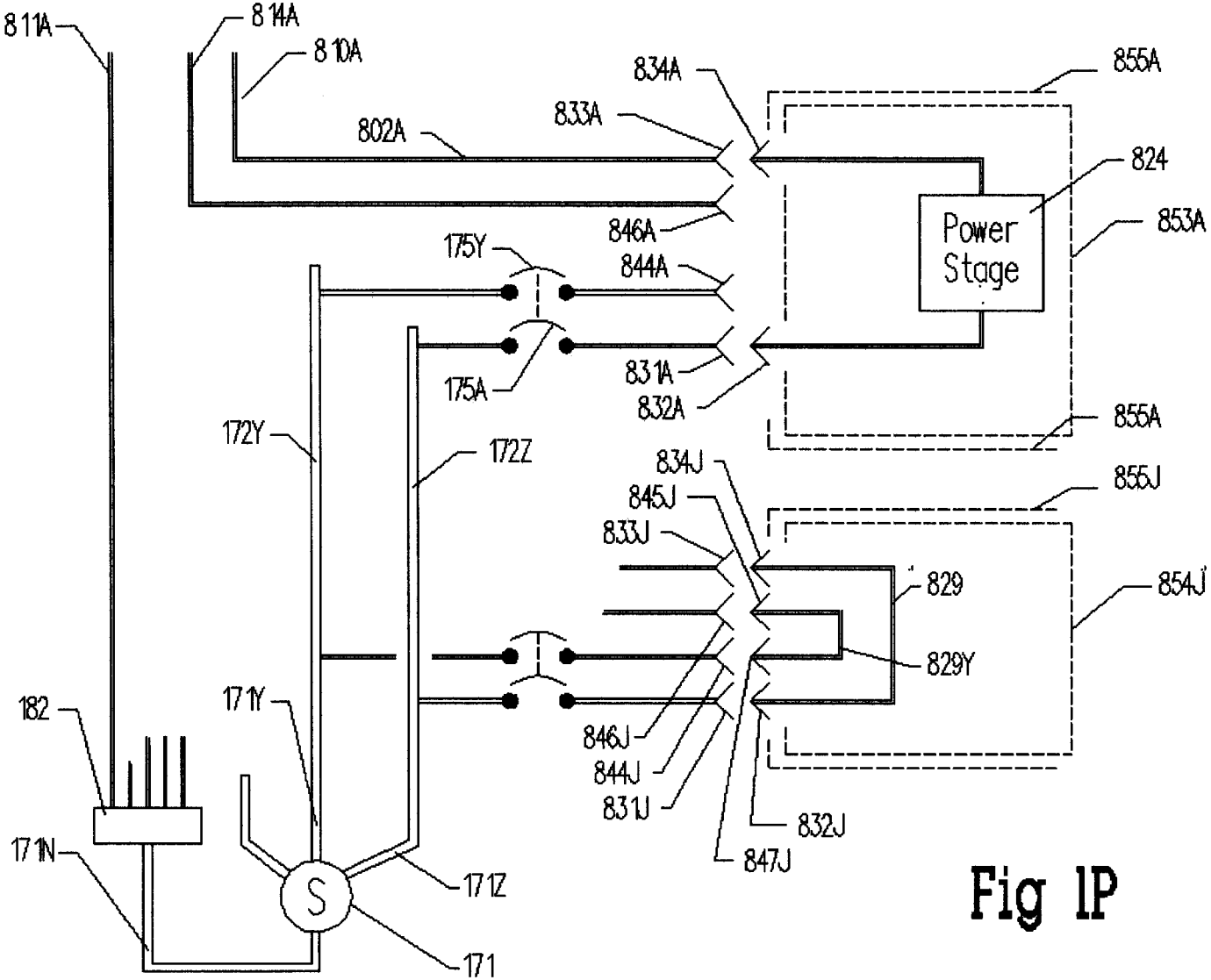
FIG. 1P illustrates a portion of a lighting system that packages dimmer power stages in mechanical modules separate from the branch circuit protection elements and provides for multi-phase power outputs with multi-phase shunt modules.

In FIG. 1P the routing of both phase outputs is made conditional on the module type inserted. In this example, a multi-phase load cannot be employed with a dimming module in place because a dimming module will not complete the connection of the additional phase output 814A. The installation of a shunt module (here, 854J) connects both phase outputs.

Figure 1Q:
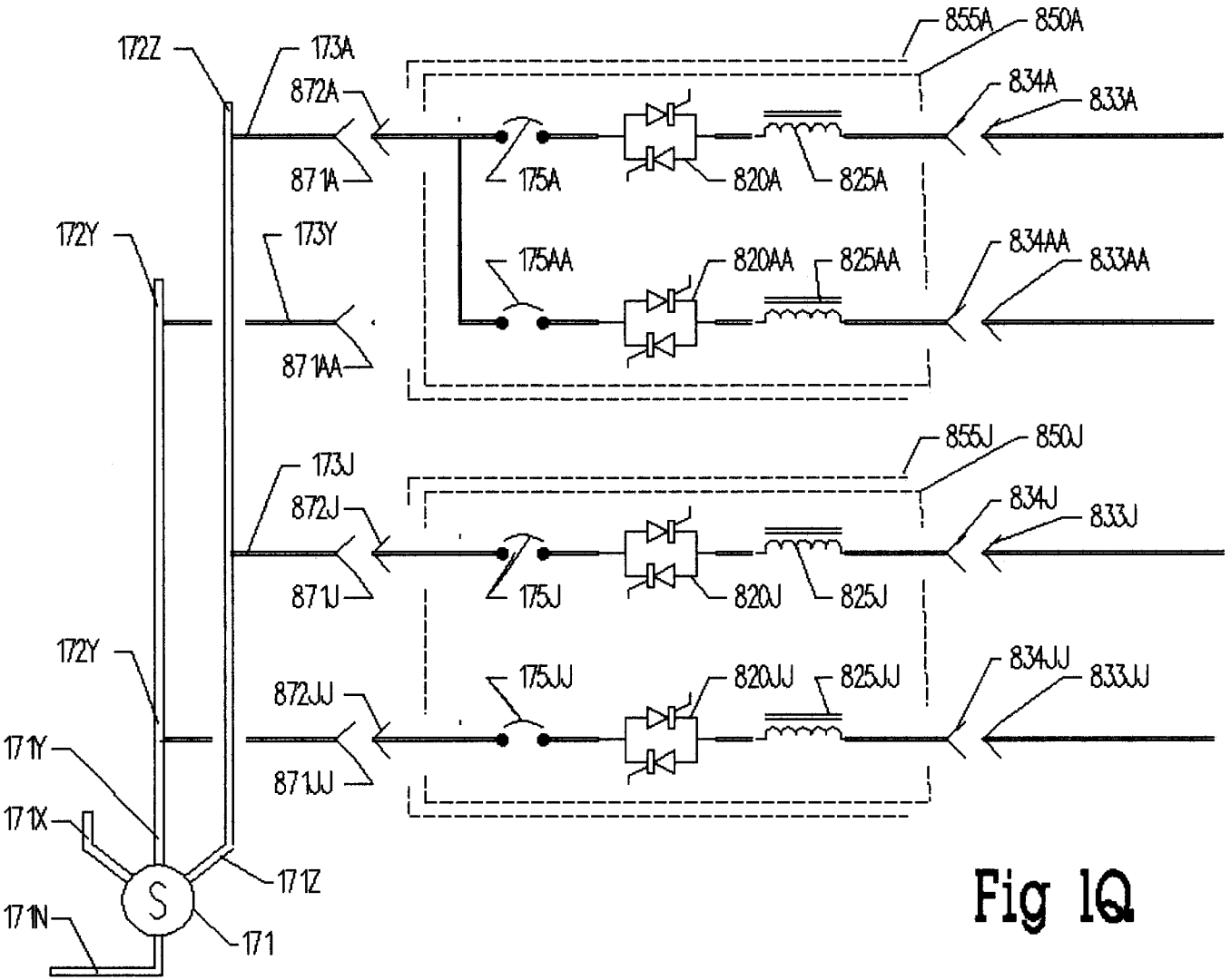
FIG. 1Q illustrates a portion of a lighting system that packages one or more dimmer power stages in a mechanical module and supplies multi-phase power to the module.

FIG. 1Q specifically illustrates an apparatus in which more than one dimmer power stage may be included in a single mechanical module (although this technique can be employed with any of the previously and subsequently disclosed improvements). Unlike such dimmer racks (as are illustrated in FIG. 1C), a plurality of phases are provided to the module. Multiple power stages in a single module may either be supplied by the same phase (e.g. 850A) or by different phases (e.g. 850J).

Figure 1R:
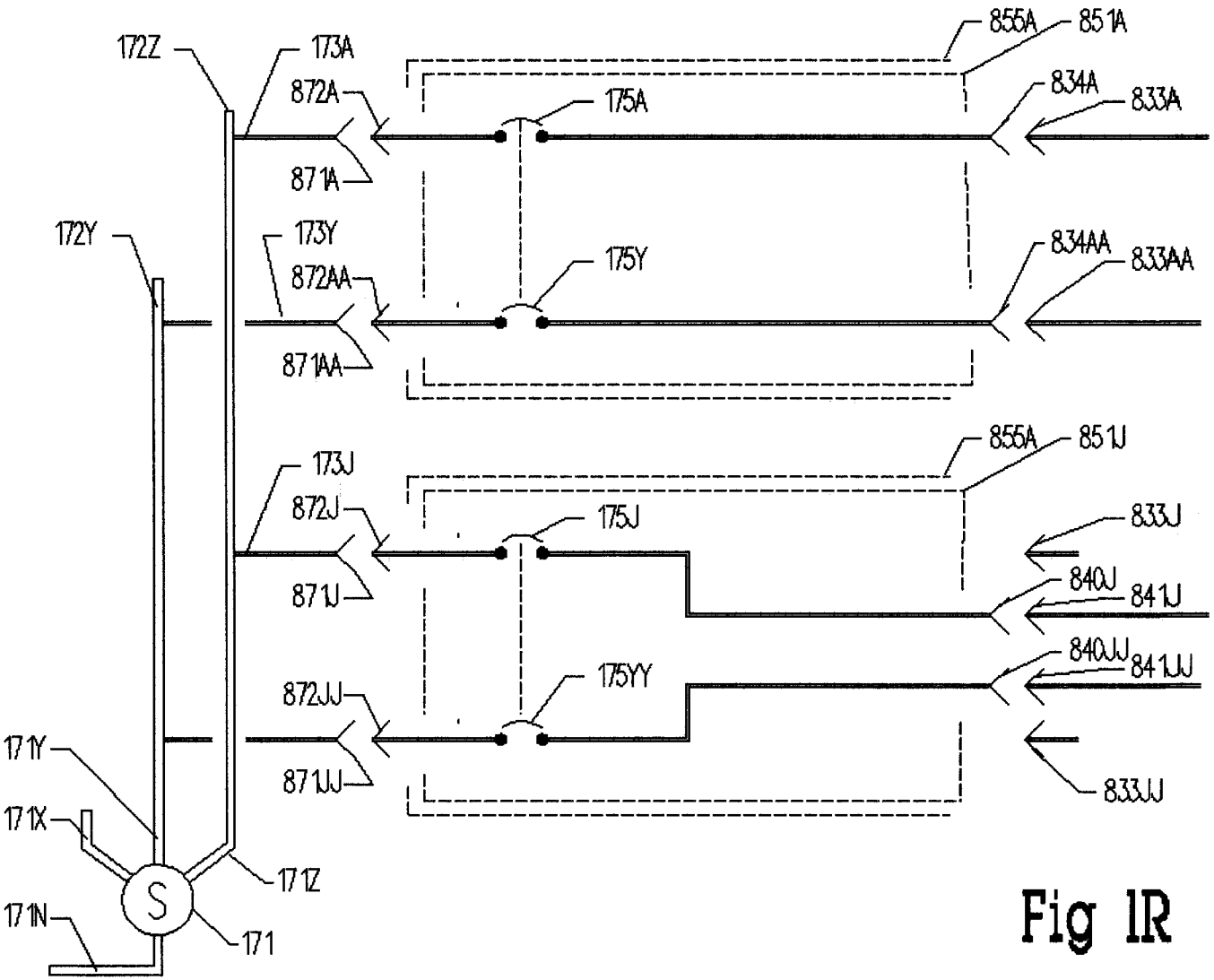
FIG. 1R illustrates a portion of a lighting system that packages one or more dimmer power stages in a mechanical module; supplies multi-phase power to the module; and provides for shunting such power to outputs.
Figure 15:
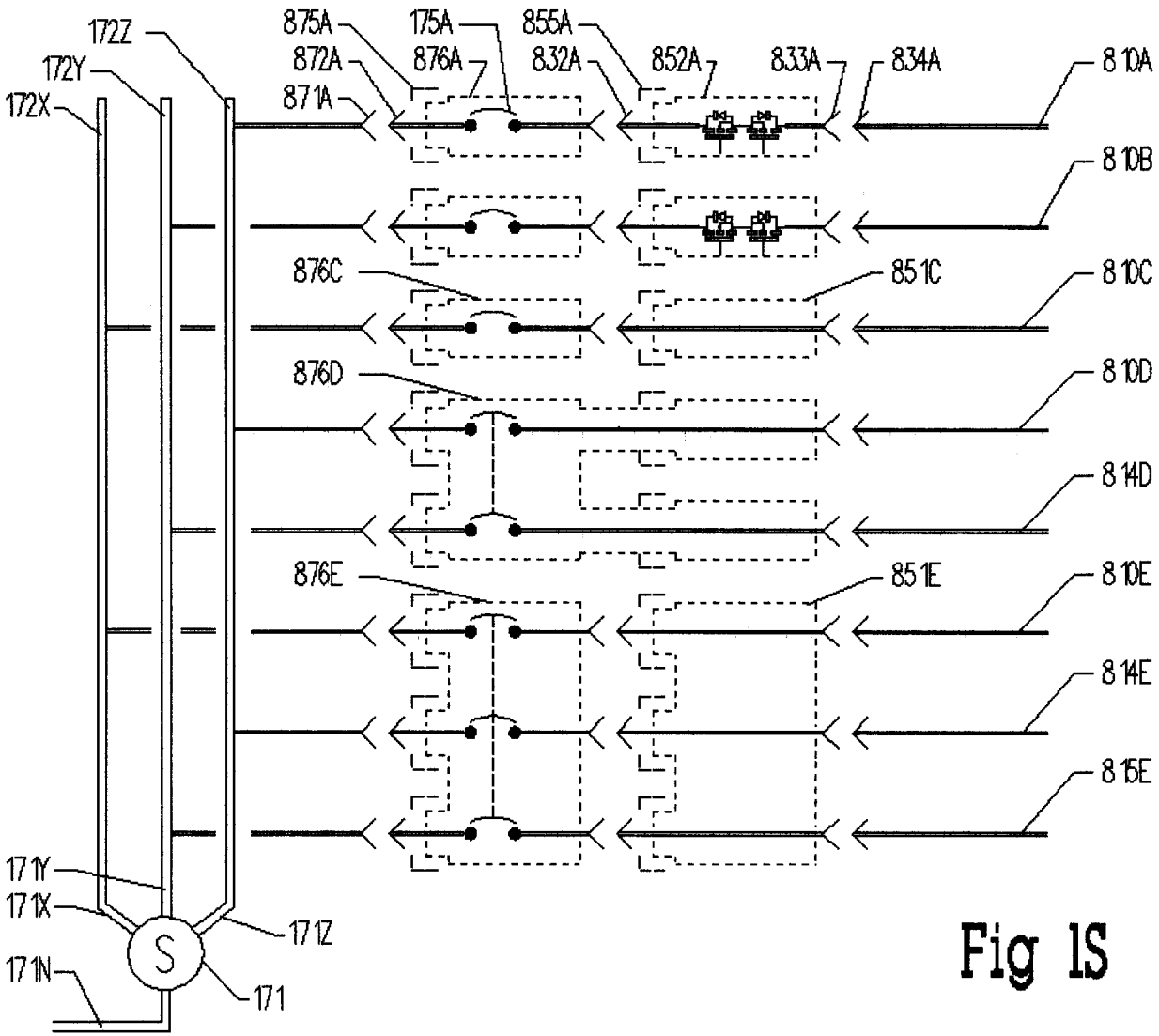

FIG. 1R illustrates shunt modules (e.g. 851A and 851J) with branch circuit protection elements suitable for multi-phase operation (e.g. 175A and 175Y) inserted into the same chassis position as can accommodate a module containing one or more dimmer power stage, with the result that multi-phase power is available between the module. FIG. 1R illustrates that such multi-phase outputs may be made available either at the same outputs as single-phase dimmed outputs (as in the case of module 851A) or at separate outputs (as in the case of module 851J).

It will be understood that in the case of the apparatus of Figures IN and subsequent Figures, that any and all of the methods illustrated in FIGS. 1G–1L may be employed, including the use of switching and of other methods to route power to one or more outputs when a module is not inserted in the chassis position; the employment of a controlled transition (or other) power stage; and/or the routing of dimmed and undimmed power to different outputs. It will also be understood that although two phases are supplied to the module in the illustrated embodiments, that three-phase versions are also equally possible.

Refer, for example, to FIG. 1S, which illustrates an apparatus that provides two sets of chassis positions: one for modular branch circuit protection elements and another for modular dimmer power stages. Chassis position 875A is illustrated as accommodating a single-pole branch circuit protection element, circuit breaker 175A, as do the next two available positions. The first two dimming positions are illustrated as accommodating controlled transition power stage modules (e.g. 852A), while the third has a shunt module 851C installed. The illustrated embodiment also readily accommodates multi-phase circuit protection elements, including a two-pole circuit breaker module 876D, and a three-pole circuit breaker 876E. The Figure also illustrates that branch circuit protection element modules may be fabricated to include shunt modules (e.g., in the case of 876D) and multi-phase/position shunt modules (e.g. 851E) fabricated as well. As previously noted, such an apparatus can provide a switching function that obviates the need for shunt modules and/or additional outputs. Connections between modules in one set of chassis positions and the other can be direct or via the chassis.

FIGS. 2A–2E illustrate a few of many possible mechanical embodiments for apparatus having one or more of the features disclosed.

Figure 2A:
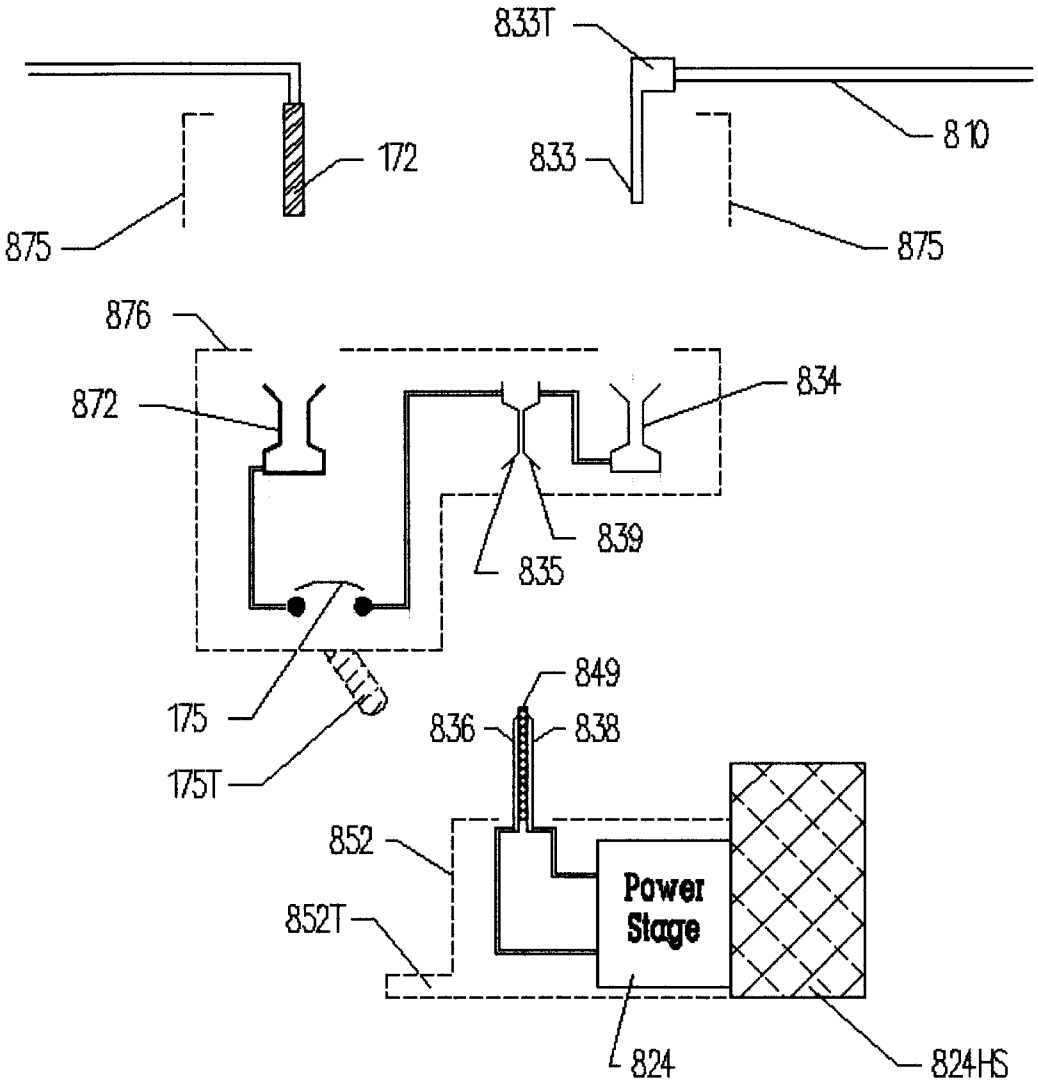
FIG. 2A illustrates one possible embodiment of an apparatus employing separate mechanical modules containing the dimmer power stage and the branch circuit protection element.

Referring to FIG. 2A; like many recent dimmer designs, the chassis incorporates a vertical bus bar 172 used to distribute power from the supply to a plurality of modules that engage it. Circuit protection module 876 is inserted into a chassis position defined in part by 875. Circuit protection module 876 accepts power via contacts 872 that engage bus 172 and supplies an output via terminal 834 to a chassis-mounted terminal 833 to which load wiring can be terminated—all in the well-understood fashion illustrated, for example, in U.S. Pat. Nos. 4,977,484 and 4,972,125. Circuit protection module 876 includes a circuit breaker 175, which has an actuator/handle 175T. Circuit protection module 876 also includes a contact pair 835 and 839 that shunts power between the output of circuit breaker 175 and output contact 834. (It will be understood that a single compound contact assembly can provide the functions of contacts 835, 839, and 834.)

A dimmer power stage module 852 is illustrated, which, when inserted with its contact assembly 836/849/838 between contact pair 835/839, electrically inserts the dimmer power stage 824 in series between the circuit breaker 175 and output 834, in the previously described manner.

One of many possible methods is illustrated, in the form of a projecting tab 852T on the dimmer power stage module 852, that prevents insertion or removal of dimmer power stage module 852 when the actuator/handle 175T of circuit breaker 175 is in the "on" position. Other and/or additional techniques can be employed to assure that the power devices in the dimmer power stage 824 cannot be driven into conduction unless the module is fully inserted.

A heat sink assembly 824HS is illustrated as incorporated in the dimmer power stage module, such that cooling air can be passed through it in the known manner.

Because the removal of a power stage module changes the airflow characteristics of the rack or pack (by reducing the impedance and therefore increasing the airflow through the chassis position) the apparatus may employ a technique, such as a dummy module or a hinged flap, for blocking the chassis position when a power stage module is not employed. As noted later, there are circumstances in which cooling will not be required. Other or alternative thermal dissipation methods are also possible.

Figure 2B:
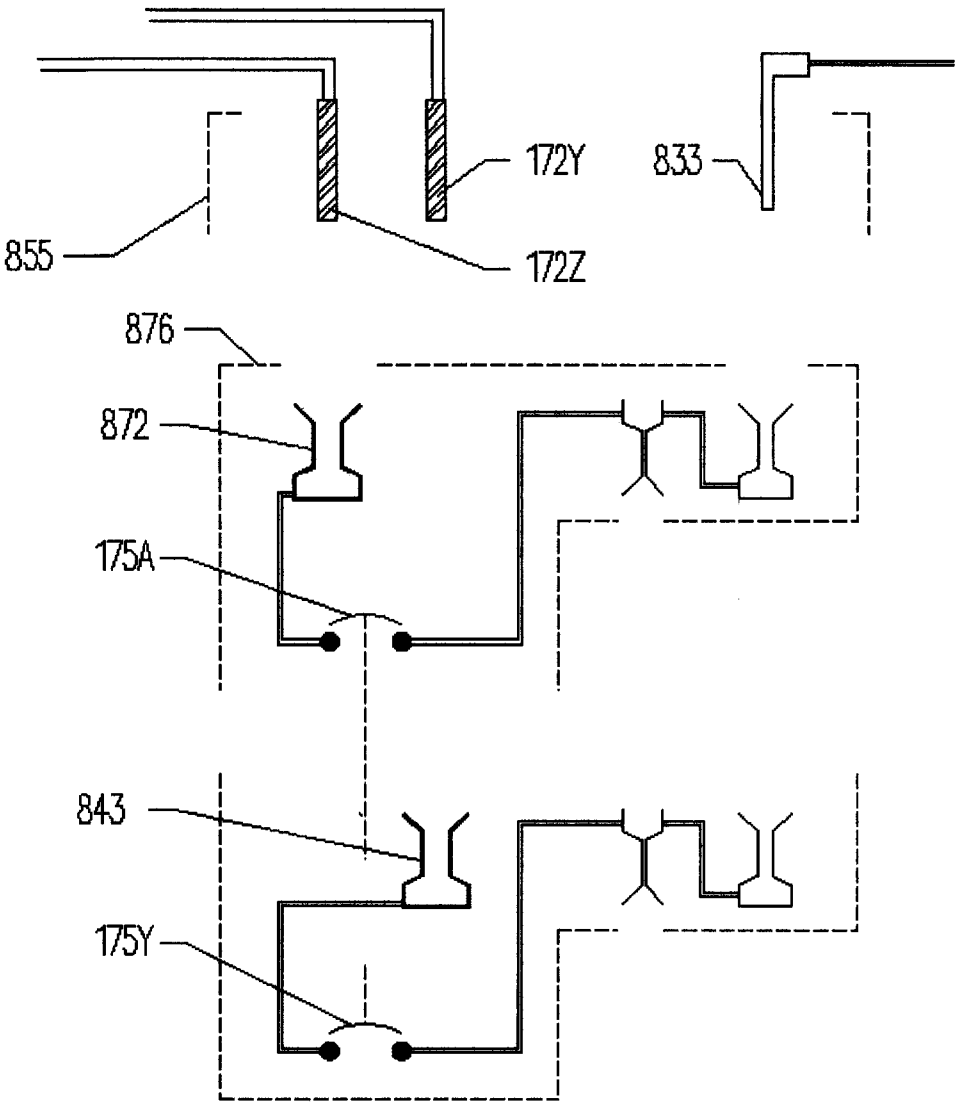
FIG. 2B illustrates one possible embodiment of a multi-phase branch circuit protection element module.

FIG. 2B illustrates one of many possible methods of providing for multi-phase operation. Here, two parallel bus bars are provided for two phases; at this location 172Y and 172Z. (Just as in prior art racks, the total number of chassis positions is typically divided in thirds; the bus bars divided; and the phases rotated between them X Y Z. In the illustrated embodiment, the rotation might become X&Y Y&Z Z&X.) A two-pole module is illustrated, housing a common-trip two-pole circuit breaker 175A/175Y, each pole of which is supplied by a separate contact engaging a different bus bar. Output contacts could be stacked over one another (in which case, the output contact for the "Y" pole would be immediately below the illustrated contact) or may be located adjacent (as will be illustrated in the example of FIG. 2E).

Dimmer racks and packs must provide for three basic variations in output wiring.

In permanent installations, single-conductor load wiring is pulled through conduit to the rack or pack, where it is hand terminated to the output terminals.

Portable packs are constructed with output receptacles mounted to one surface (generally the face opposite the dimmer modules) to permit the temporary connection of portable cables via mating plugs. Hand wiring from the dimmer output terminals to the receptacles is required.

Some larger portable racks include not only output receptacles hand wired to the dimmers, but also a "load-patch" that permits cross-connection of circuits in 6- or 12-circuit multi-circuit multi-connector receptacles with any desired combination of dimmer outputs. Hand wiring to both the single-circuit output receptacles and the "load-patch" is required.

Figure 2C:
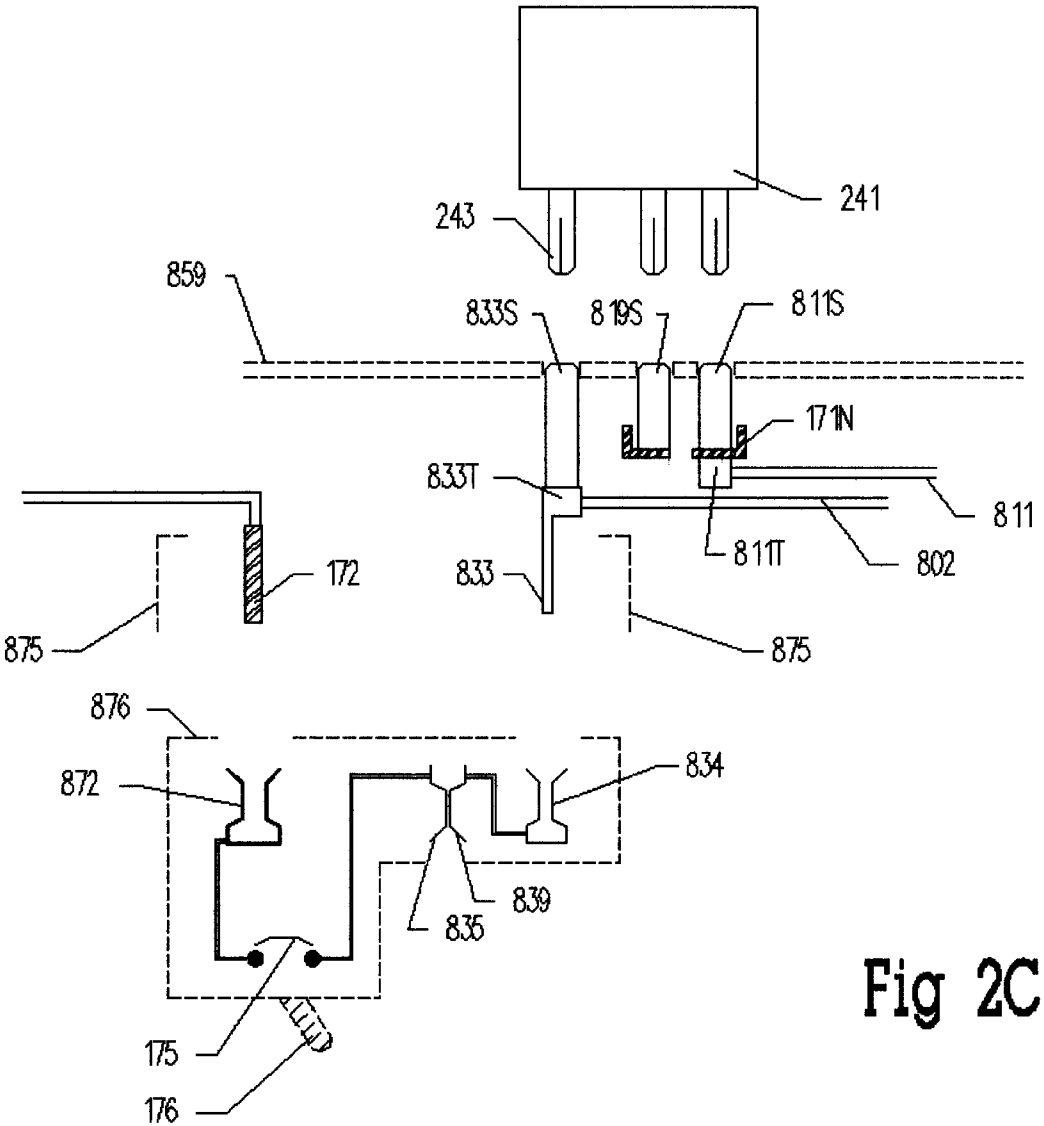
FIG. 2C illustrates one possible embodiment of an apparatus including integral output receptacles.

FIG. 2C illustrates an improved apparatus for both power distribution and dimming that requires substantially less hand wiring. When used in portable racks or packs, the apparatus chassis employs a load terminal 833T to which a female receptacle contact is connected or incorporated, for example, contact 833S for the commonly employed "stage pin" connector. A similar terminal/receptacle contact assembly 811T/811S is provided for the neutral connection, in this case the various neutral terminals bussed together by neutral bus 171N. A bus/receptacle contact assembly is also illustrated for the ground receptacle 819S. The plug side of these receptacle contacts faces an exterior surface of the chassis, and openings are provided in the surface 859 through which the male pins (e.g. 243) of the mating plugs (e.g. 241) extend. It will be apparent that these terminals, buses, and receptacle contacts may retained in place, for example, by a common molded assembly.

The illustrated embodiment thus provides a receptacle for every chassis position, into which a stage pin connector (e.g. 241) can be plugged—without the requirement for hand wiring, and while also offering a terminal for connection to a load patch, if employed.

Figure 2D:
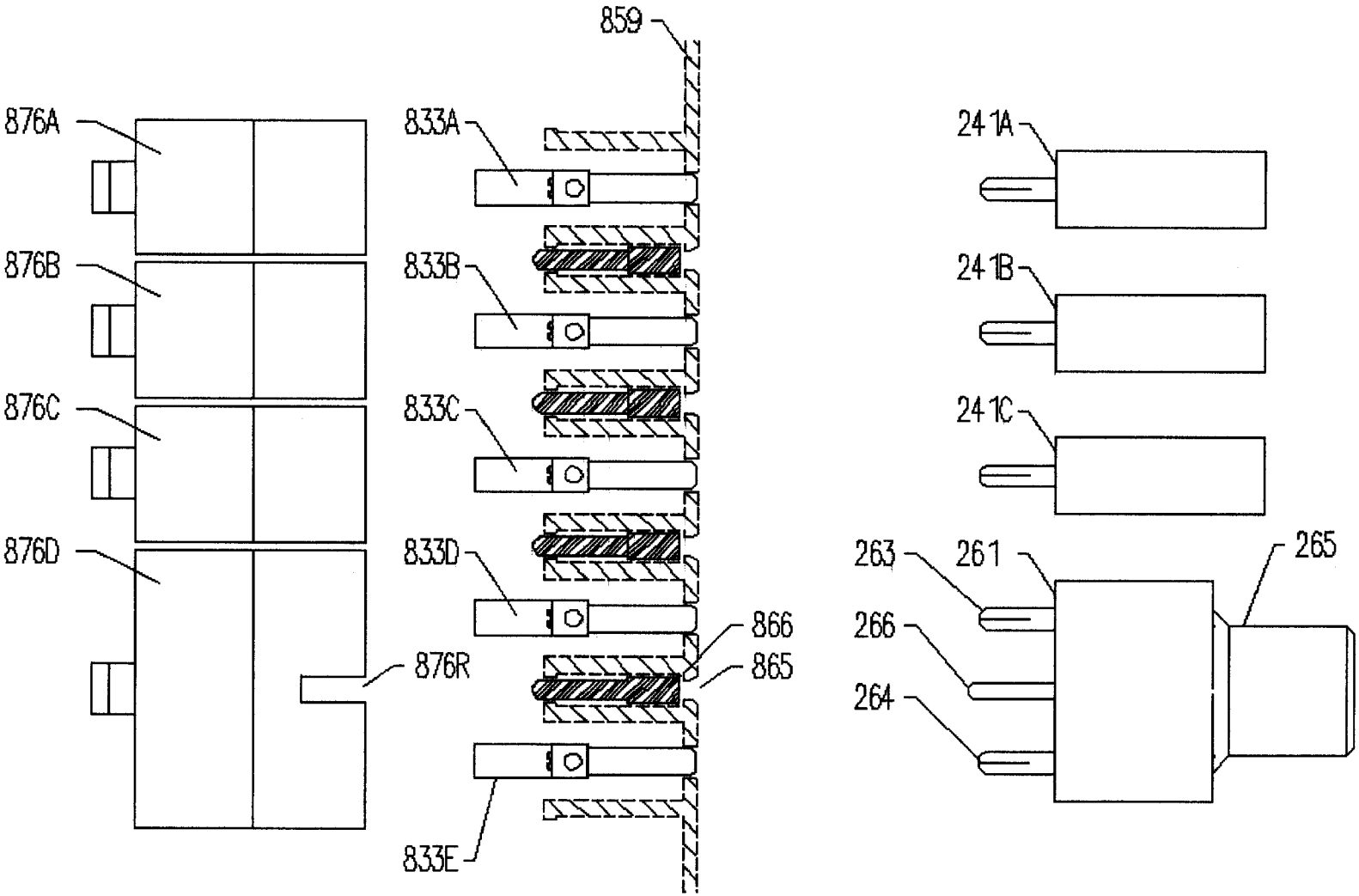
FIG. 2D is a section of an apparatus that provides for both integral receptacles and an interlocked multi-phase receptacle adapter.

FIG. 2D illustrates how connectors and adapters can be produced that plug into two or more adjacent receptacles, including on the rear surface of a chassis, to connect a multi-phase circuit. FIG. 2D is a vertical section through an apparatus like that of FIG. 2C, showing a plurality of single-phase protection modules 876A–876C and a single two-phase module 876D. The output terminal/receptacle assemblies 833A–833E for five chassis positions are illustrated. Mating single-circuit "stage pin" plugs 241A–241C are illustrated. Also illustrated is a two-phase adapter 261, which mounts male pins 263 and 264 that mate with the output receptacle contacts 833S of two adjacent chassis positions; here contacts 833D and 833E in the "D" and "E" positions. Such an adapter would also include at least one ground pin, mating with a corresponding ground contact 819S and, if a neutral was also desired, include at least one neutral pin mating with a corresponding neutral receptacle contact. Similar multi-phase plug and receptacle assemblies can be used in portable cable between the chassis receptacles and the load, or the adapter convert to an existing multi-phase connector configuration, such as the NEMA standard L6-20 twistlock receptacle 265 illustrated. An adapter could also mount, for example, a 6-circuit multi-connector such as the "Socopex" type, engaging six single-phase circuits/chassis positions.

FIG. 2D illustrates one of many methods by which a plug or adapter can be made to interlock with the apparatus chassis; with dimmer power stages; or with protection modules, such that it cannot be used inappropriately. In the illustrated example, adapter 261 includes a male pin 266 that inserts in an opening 865 in the panel surface 859. A plunger 866 is contained within a well. It will be seen that the attempt to insert adapter 261 into a pair of adjacent receptacles requires that pin 266 push plunger 866 towards the interior of the chassis. If the adapter 261 is being inserted into an appropriate pair of receptacle positions; that is, a pair supplied by the same two-pole protection module, plunger 866 will extend into a recess 876R provided in such modules. Attempts to insert an adapter 261 into any other receptacle pair will not be permitted, because no recess permits displacement of plunger 866. Other forms and methods of interlock are possible, as, of course, are interlocks between chassis positions or configurations and modules and between module types. Interlocks and features of the connectors and adapters can also serve electrical functions, for example, a pin like 266 or plunger like 866 could actuate a switch or sensor.

Figure 2E:
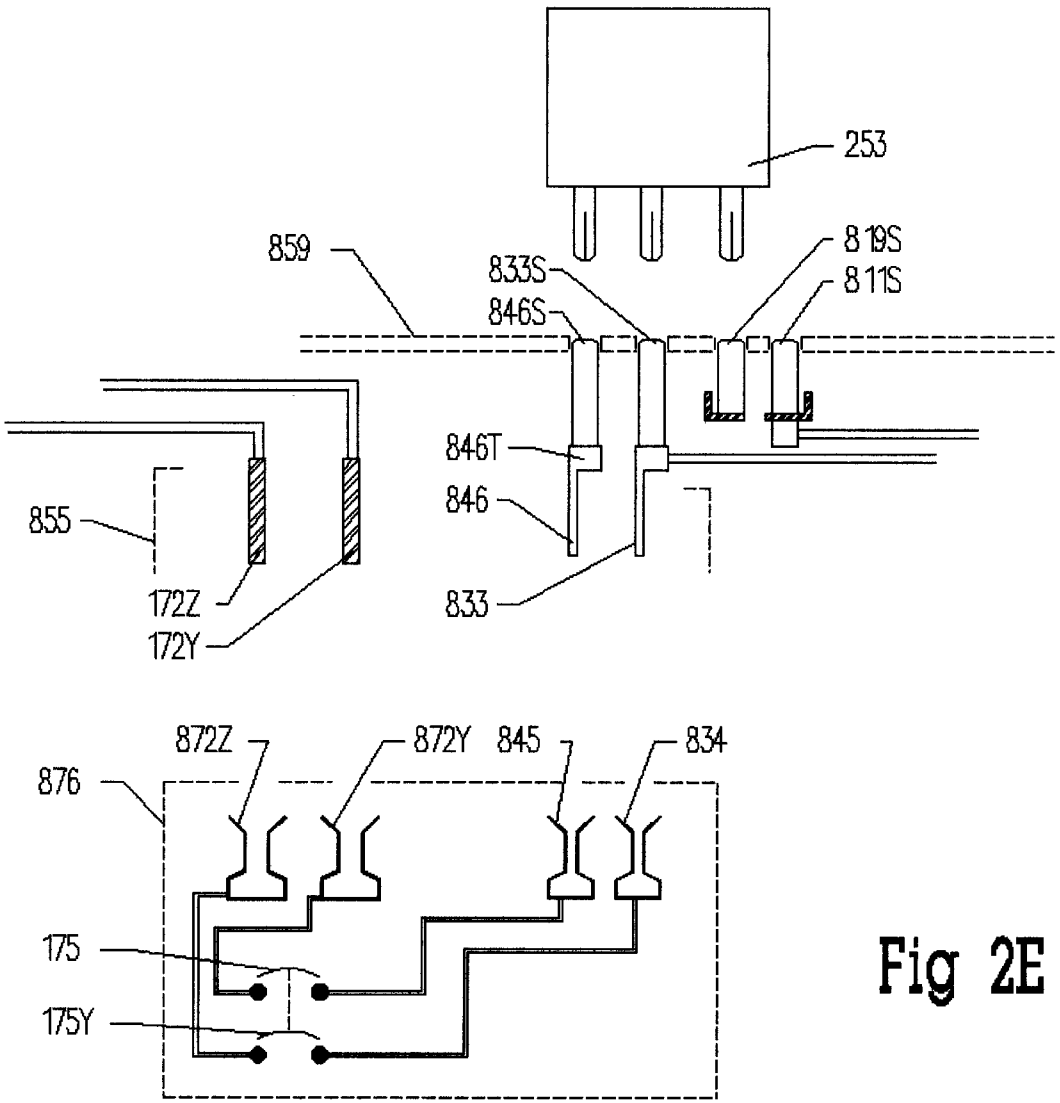
FIG. 2E illustrates another possible embodiment of an apparatus combining multi-phase branch circuit protection with integral receptacles.

FIG. 2E illustrates another possible mechanical embodiment of a multi-phase protection module. Like the embodiment of FIG. 2B, a two-pole protection module 876 engages two bus bars 172Y and 172Z. The module's output contacts 834 and 845 engage chassis-side terminals 833 and 846. In the manner illustrated in previous Figures, integrated terminal/receptacles are provided. A multi-phase variation 253 on the "stage pin" connector is provided, illustrated as using the same pins as the single-phase version, but as employing different pin spacings so that the two connector types are not intermateable. The size and/or shape of the additional phase pin and receptacle contact 243P and 848P can also be varied and/or a mechanical interlock, such as illustrated in the previous Figure can also be employed. Contacts/receptacles can be provided in the module or chassis for the insertion of a power stage or other element into one or both sides of the circuit.

While FIGS. 2A–2E illustrate two vertical bus bars, other designs are equally possible including pins, sockets, or tabs at each chassis position. Other designs, including designs that sequence all three phases through adjacent chassis positions, are equally possible.

It will be understood that suitable features will be provided to couple drive signals to dimmer modules. Contacts for this purpose may be employed, as may electrically-isolating non-contact couplers. Drive electronics may be packaged, in whole or in part, in the dimmer power stage module.

It will be understood that functions other than dimming can be provided, including in modules that may or may not be interchangeable with the dimmer modules, and using any of the techniques illustrated in prior Figures.

Features can be provided to couple signals and data to and from the chassis, protection modules, and other modules for functions including voltage and current sensing, indication, current-limiting, status, feedback as to the type of module that is or should be inserted and the connected load.

Components used in the distribution of signals and data can be incorporated in the chassis and in modules with power level functions, as well as in additional modular elements.

Figure 3A:
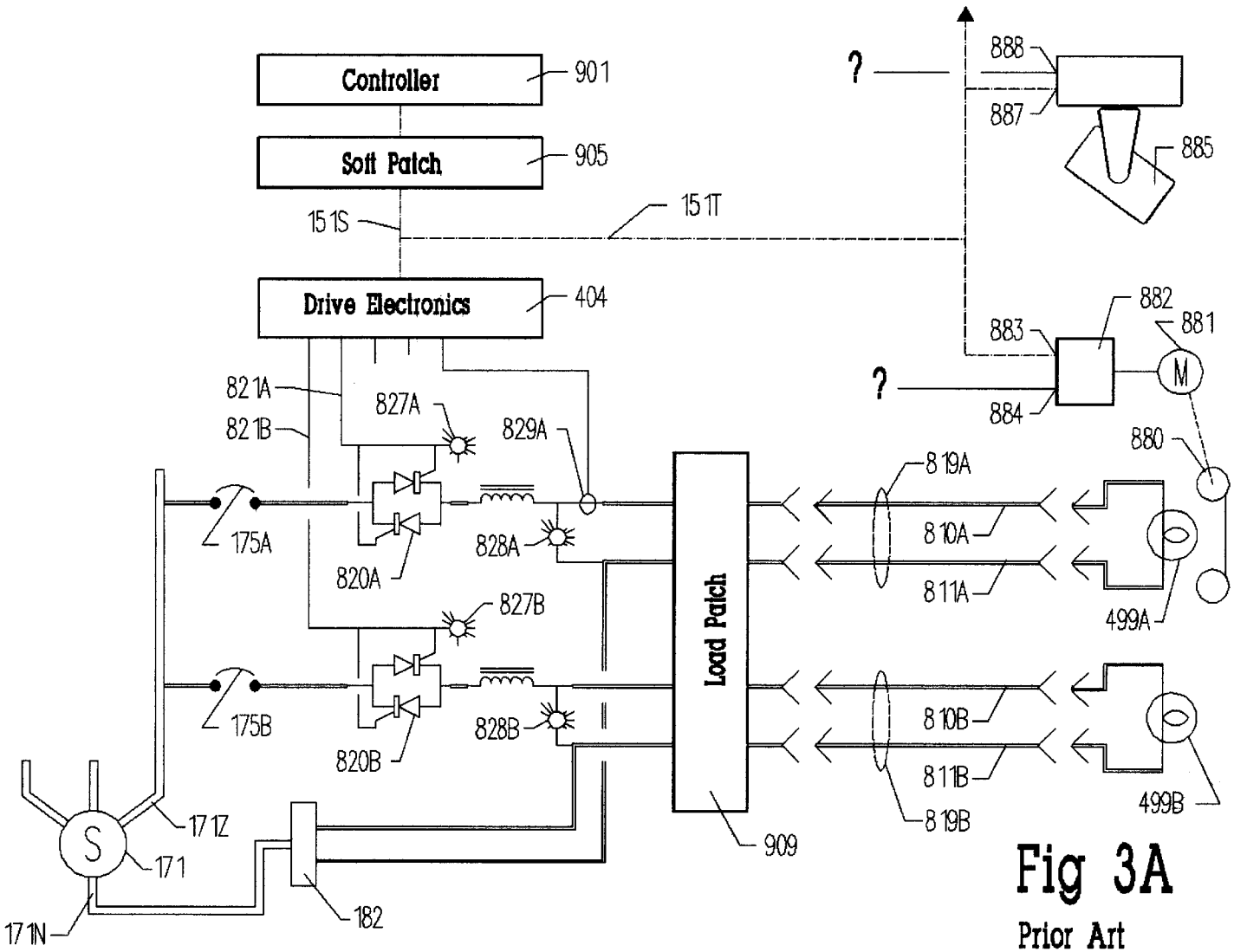
Fig 3A Prior Art
FIG. 3A illustrates a prior art lighting system.

Refer now to FIG. 3A.

The assembly and use of lighting systems is made more difficult by the complications of routing power and control signals in modern systems.

The solid state dimmers employed permit the remote control of the intensity of lamp loads from a controller or console at another location. Values each representing the desired average power to (and, therefore, the intensity of) the connected lamp loads are generated by the controller or console and coupled to the dimmers.

A controller or console will generally include a "soft-patch" function 905, whether internal or in the form of an outboard "patch engine", that allows the user to specify those dimmers or devices to which the desired value for each "channel" separately-adjustable by the console or controller will be sent.

System design and operation is further complicated by the requirement to send data to distributed locations in proximity to lamp loads for automated fixtures (e.g. 885) and for various mechanisms employed as accessories to remotely vary one or more parameter of the light beam produced by a conventional fixture, including color-changers (e.g., scroll 880, driven by motor 881, with local electronics 882). The control of such fixtures and devices requires conveying values from one or more central locations to the various fixtures and accessories. Small gauge, low current conductors and connectors, generally carrying a multiplexed serial data stream, have been employed (e.g. 151T to inputs 883 and 887). Address switches or functions on the fixture or accessories are required. A source of electrical power sufficient to supply the actuators and local electronics at the fixture or accessory is also required (e.g., via inputs 884 and 888). These requirements increase the cost and complexity of the lighting system; complicate its operation; and decrease its flexibility and reliability.

At the power level, in permanently-installed "dimmer-per-circuit" systems, each dimmer's output is permanently connected to a designated receptacle at a location distant from the dimmer, a location that is intended to be close to a lamp load. Portable cable may then be used to extend to the load as necessary.

In portable systems, some form of "load-patch" 909 is provided, whether simply the plugging of single circuit connectors to receptacles on dimmer packs or racks and/or a load patch internal to a rack itself.

The result of the combination of "soft-patch", "load-patch", extension cables, and accessories is a highly complex system. As an example, a given fixture is plugged, via an extension cable, into the fifth of six circuits in one of more than 50 apparently identical 6-circuit multi-cables. That multi-cable is plugged to receptacle "G" of the sixth dimmer rack, making the circuit "G5" in that rack's internal load patch, which is used to load patch the circuit to dimmer #3 in that rack. However, as that rack has been given a starting address of 289, dimmer #3 in that rack is dimmer #292 to the controller. At the controller, dimmer #292 is "soft-patched" to channel #90. (Were the system large enough to require the use of multiple DMX512 outputs, then a further offset might be introduced, making dimmer #3 in the rack, #292 on that output, but, when connected to the second DMX512 output, also making it #804 to the controller.) If the fixture is provided with a color scroller, then that scroller itself will require a different serial address and channel number and require a separate undimmed circuit for its power supply. A similarly convoluted sequence of connections is required for each fixture in a system—hundreds of them in many cases.

While many dimmer racks or packs provide an indicator (e.g. 827A) at the dimmer power stage that shows a power stage is receiving a non-zero drive signal from the drive electronics, and may also include an indicator on the power output that shows the dimmer is passing power (e.g., indicator 828A), determining whether a given lamp load or circuit is connected to a dimmer and, if so, which dimmer that is, can be difficult and time-consuming without extensive pre-marking and documentation (as is described later).

Another aspect of the invention is the deliberate introduction of variations into the output of a dimmer or power controller so as to encode information in a form detectable in the load wiring and at the load. Information may be communicated over the existing load wiring without the requirement for additional cabling, connectors, or distribution equipment. That information can identify the dimmer to which a circuit is connected, the controller or console channel to which it is "soft-patched", descriptive information about the load to be supplied, remote control and other data.

Figure 3B:
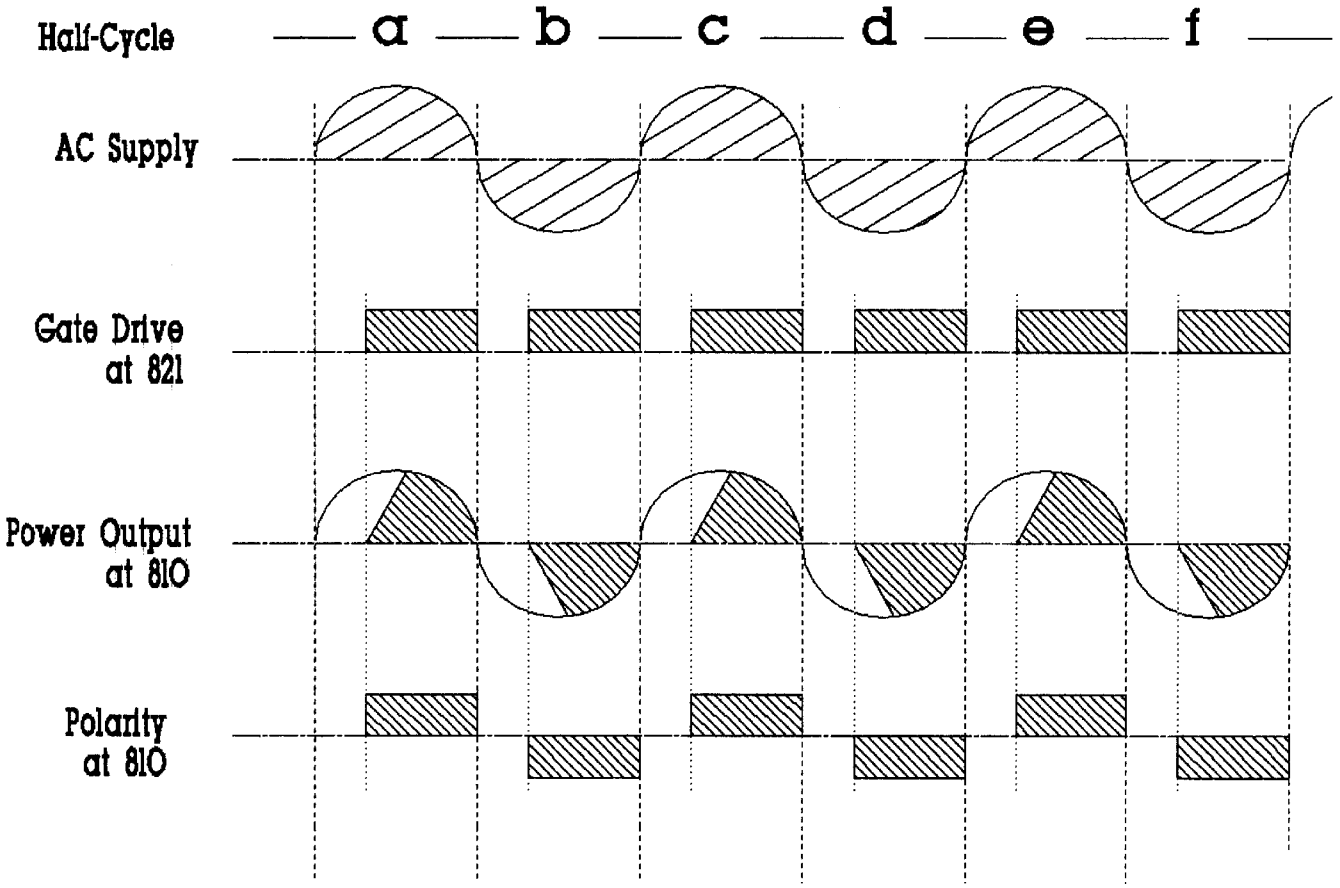
Fig 3B Prior Art
FIG. 3B illustrates waveforms at various points in the lighting system illustrated in FIG. 3A.
Figure 3C:
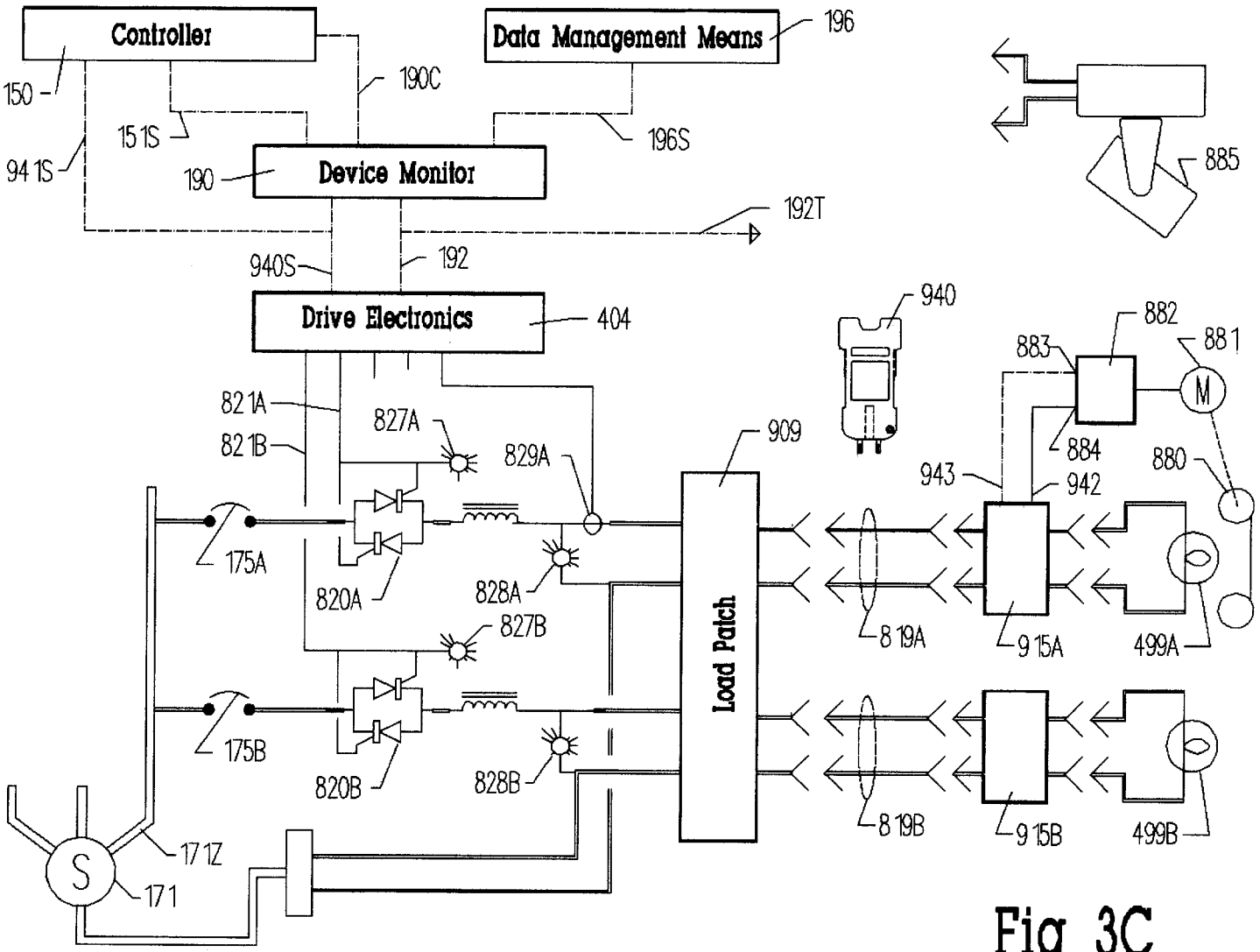
FIG. 3C illustrates a lighting system communicating via the power wiring.

Refer now to FIG. 3C.

The system of FIG. 3C can employ prior art dimmers, including the same dimmer drive electronics 404 and power stages (e.g. 820A and 820B) as the prior art system. The improvement, however, includes additional software (or a state machine) to implement the introduction of variations in the power stage output waveform to encode data. That data may be sourced by the dimmer electronics and/or by another component in the system. When sourced by another component, that data may be coupled to the dimmer drive electronics by incorporation in the data stream carrying desired intensity values from a controller 150 and/or a "device monitor" 190 as described in U.S. Pat. No. 5,821,703 (included in its entirety by reference); may be conveyed between the device monitor 190 and the drive electronics by an additional transmission channel 940S; or be conveyed directly between the controller 150 and the drive electronics 404 by an additional transmission channel 941S. Such data can include the dimmer number within the rack; its serial address; the channel to which it is "soft-patched"; descriptive information about the load that should be supplied by it; and/or control data for accessories used with the load supplied.

Referring to FIG. 3B it will be seen that, when phase-control dimming is employed, a given desired intensity value produces a gate drive signal to the power devices that brings the appropriate thyristor into conduction at a phase angle determined to supply the corresponding proportion of the alternating current supply to the load. (When other power devices and output waveforms are used the basic principle remains the same; the desired intensity value produces an output waveform supplying the corresponding average power to the lamp load.)

Figure 3D:
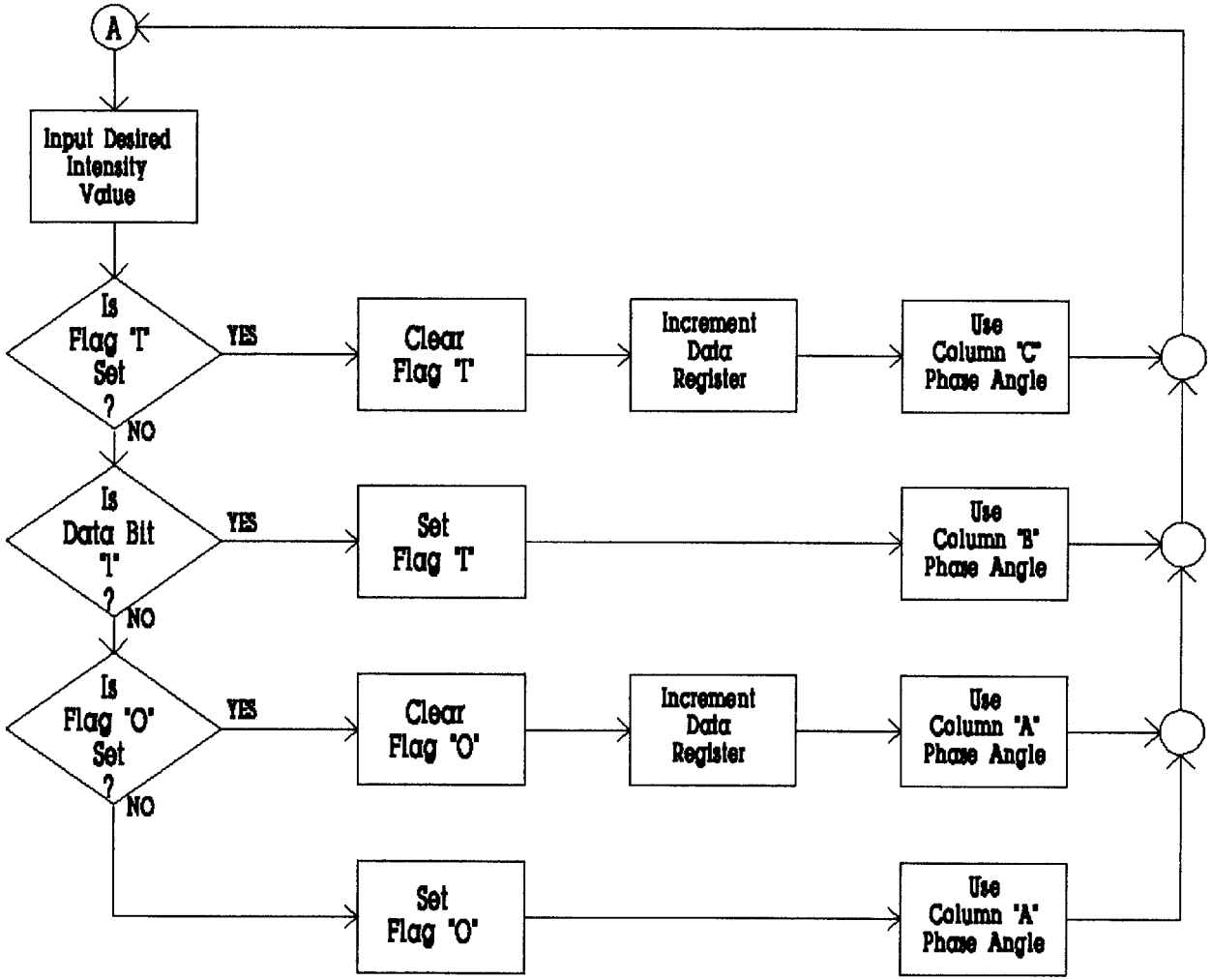
FIG. 3D is a flowchart illustrating one possible method of operation for the dimmer drive electronics in FIG. 3C.
Figure 3E:
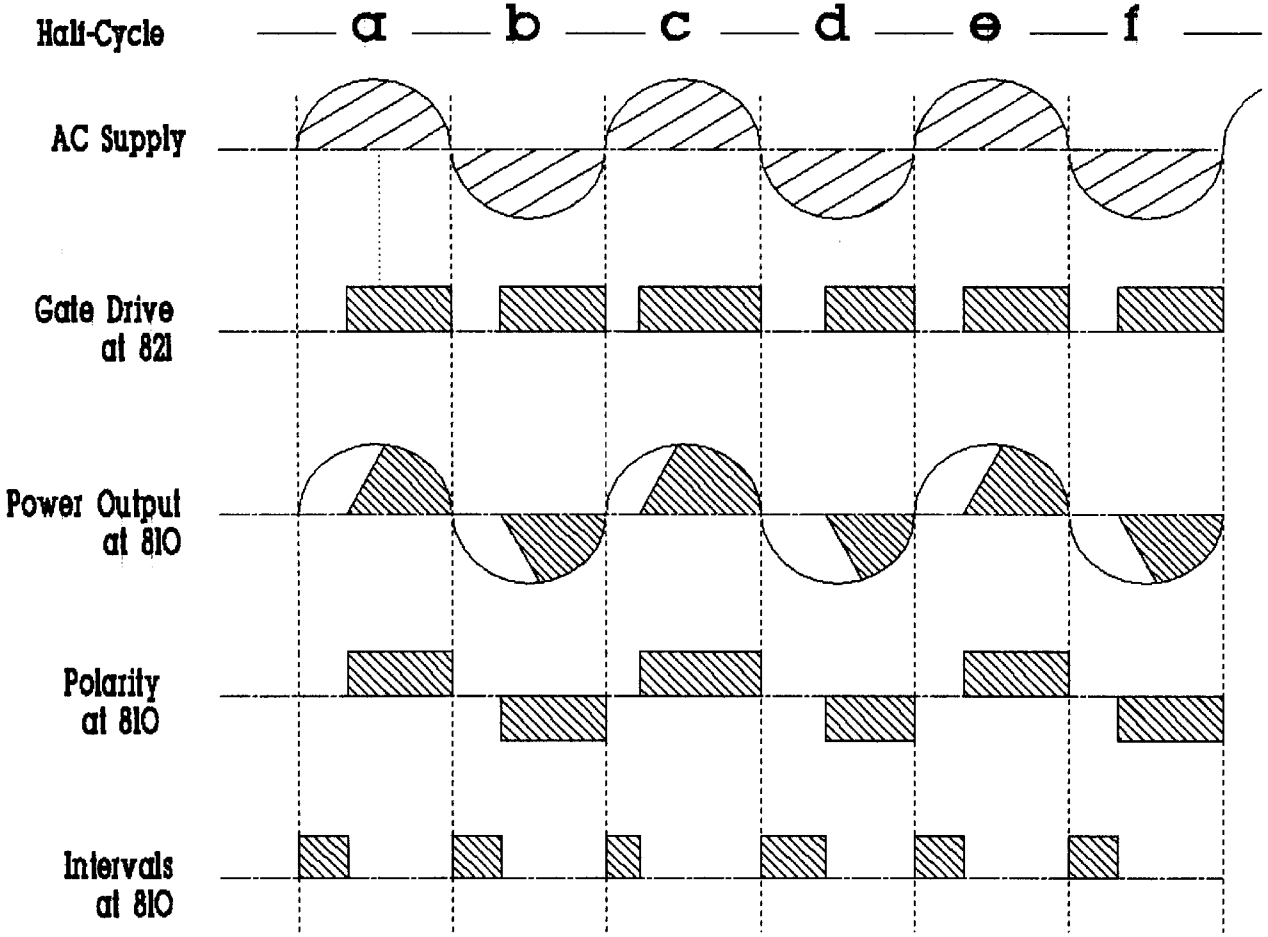
FIG. 3E illustrates waveforms at various points in the lighting system produced by the method of FIG. 3D.

Referring to FIGS. 3D and 3E, which illustrate only one of many possible embodiments, it will be seen that, in the case of a forward phase control dimmer, the phase angle for a given desired intensity value can be advanced and retarded from the phase angle normally employed for a given desired intensity value, by the simple expedient of maintaining (or calculating) two additional sets of firing angles for each desired intensity value. For purposes of example, a table can be visualized with three firing angles for each possible desired intensity value, with the "Column A" values representing the normal firing angles, "Column B" values representing an additional set of firing angles advanced relative to the "normal" angles, and "Column C" values representing an additional set of firing angles retarded relative to the "normal" angles.

In this example, which firing angles are used is determined by whether the next bit of the data to be transmitted is a "0" or a "1".

In the example, the presence of a "0" as the next bit to be transmitted results in two successive half-cycles using the "Column A" or normal firing angle for the desired intensity value (e.g., half-cycles "a" and "b" of FIG. 3E). The presence of a "1" in the outgoing data register results in a half-cycle with an advanced firing angle (e.g., half-cycle "c" of FIG. 3E) followed by a half-cycle with a retarded firing angle (e.g., half-cycle "d")—relative to the normal or "Column A" firing angle.

While, individually, the firing angles of half-cycles "c" and "d" would result in the supply of an amount of power to the lamp load different from that required to produce the desired intensity, it will be seen that such firing angles can be chosen so as to offset one another, with the result that the average of the two will be substantially the same as the normal "Column A" firing angle and no difference in the brightness of the load will be detectable regardless of the proportion of "1" bits transmitted.

Approaching full conduction, it will be understood that the "advanced" firing angle cannot be advanced beyond full conduction. Beyond this point, the difference between the "normal" and "retarded" firing angles can suffice. (Near full conduction, a significant change in firing angle has modest effect on total power delivered to the load, and therefore the use of "retarded" half-cycles for data transmission will have little or no apparent effect on the maximum brightness of the lamp load.)

Approaching non-conduction, the "retarded" angle cannot extend past non-conduction. In fact, the minimum average voltage supplied to an incandescent load generally need not drop below approximately 15 volts to turn the filament "off" so far as visible light output, and is desirably maintained at a non-zero level for "preheat" to decrease the response time and the current demands of a "dark" lamp load. As will be described, maintaining a minimum average voltage, with appropriate provisions, can also be used to assure the supply of power to electronics and actuators remote from the dimmer.

In these (and other) regions, the "two half-cycle per bit" approach can be employed or a single half-cycle per bit employed. Half-cycles of one or both polarities can be modified.

The decoder algorithm will be chosen to suit the methods chosen.

During the setup phase of a production (and, in many cases, even during a performance) the desired intensity value of any given individual dimmer is not likely to change frequently. Therefore, changes in the desired "normal" firing angle would not complicate data decoding. Changes in desired intensity value could be delayed until after a data transmission is completed or could be "stepped" between portions of a transmission, such that the same "normal", "advanced", and "retarded" firing angles are employed for the duration of a transmission or portion thereof. Because, in the illustrated example, either a "normal" firing angle or the average of a pair of "advanced" and "retarded" angles are the same, a decoder can also "track" the progress of a fade between desired intensity values and compensate for the changes in the various firing angles.

Separate "setup" and "performance" modes can be employed, differing, for example, in the amount, rate, and/or the method of data transmission.

Error detection and data compression can be employed. Data can be transmitted continuously or separate data packets defined.

The same or other methods can also be used with variants including 77-volt bulbs half-waved on the same thyristor pair; bulbs on a rectified and phase-shifted output; and loads not normally dimmed.

The technique illustrated is only one of many possible, which should not be understood as limited except by the scope of the claims.

Figure 3F:
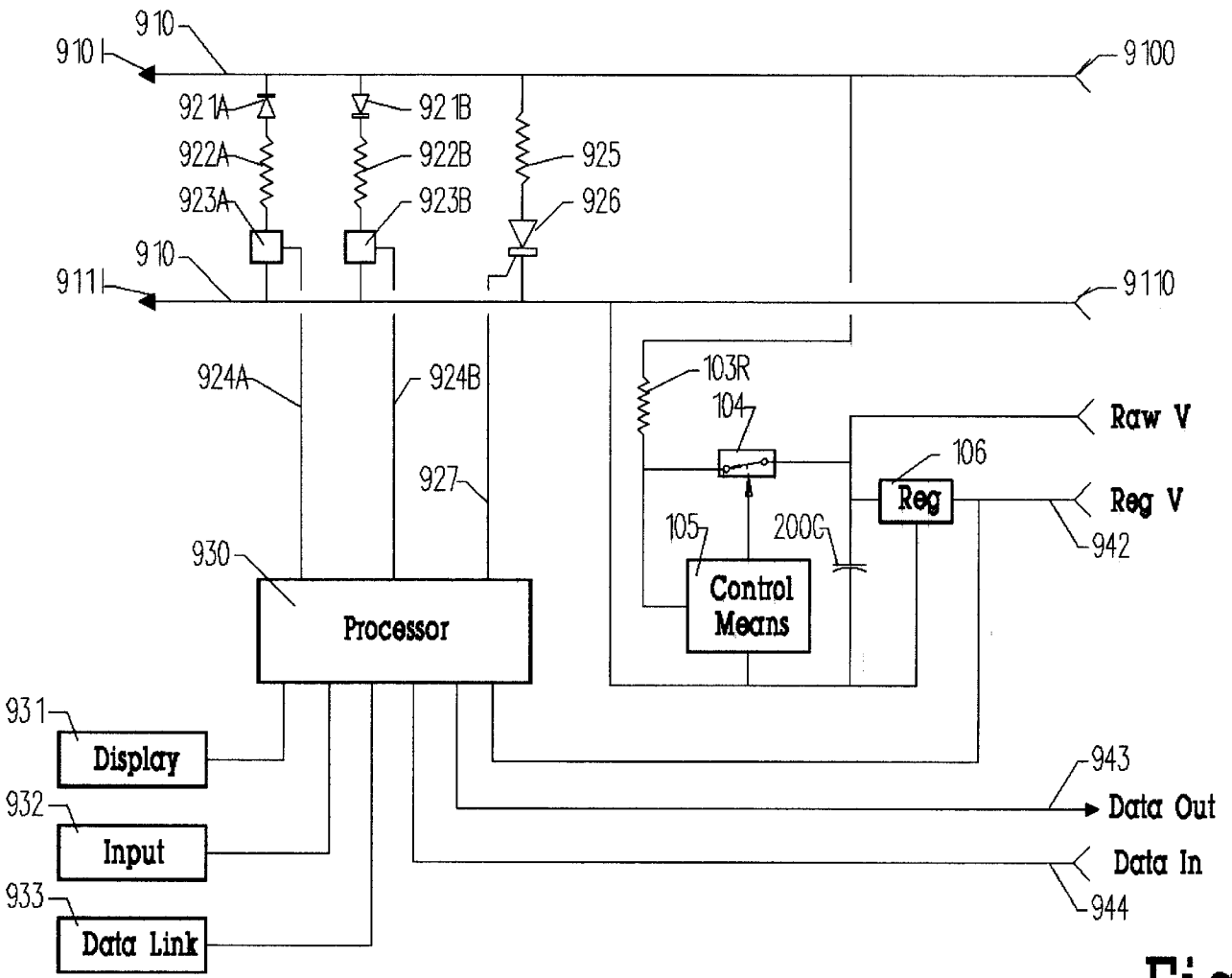
FIG. 3F illustrates one possible decoder/signaler.

Refer now to FIG. 3F, one possible embodiment of a decoder to be located at or near the lamp load (e.g., decoder 915A in the case of lamp load 499A). Inputs 910I and 911I are connected to branch circuit power conductors 810A and 810B, and outputs 9100 and 9110 are coupled to the lamp load. Diode 921A, resistor 922A, and sensor 923A cooperate to detect the periods when one of the thyristors is in conduction; diode 921B, resistor 922B, and sensor 923B, the other. (Although the hardware for separate detection is illustrated here, it is not necessary in many cases.)

Figure 3G:
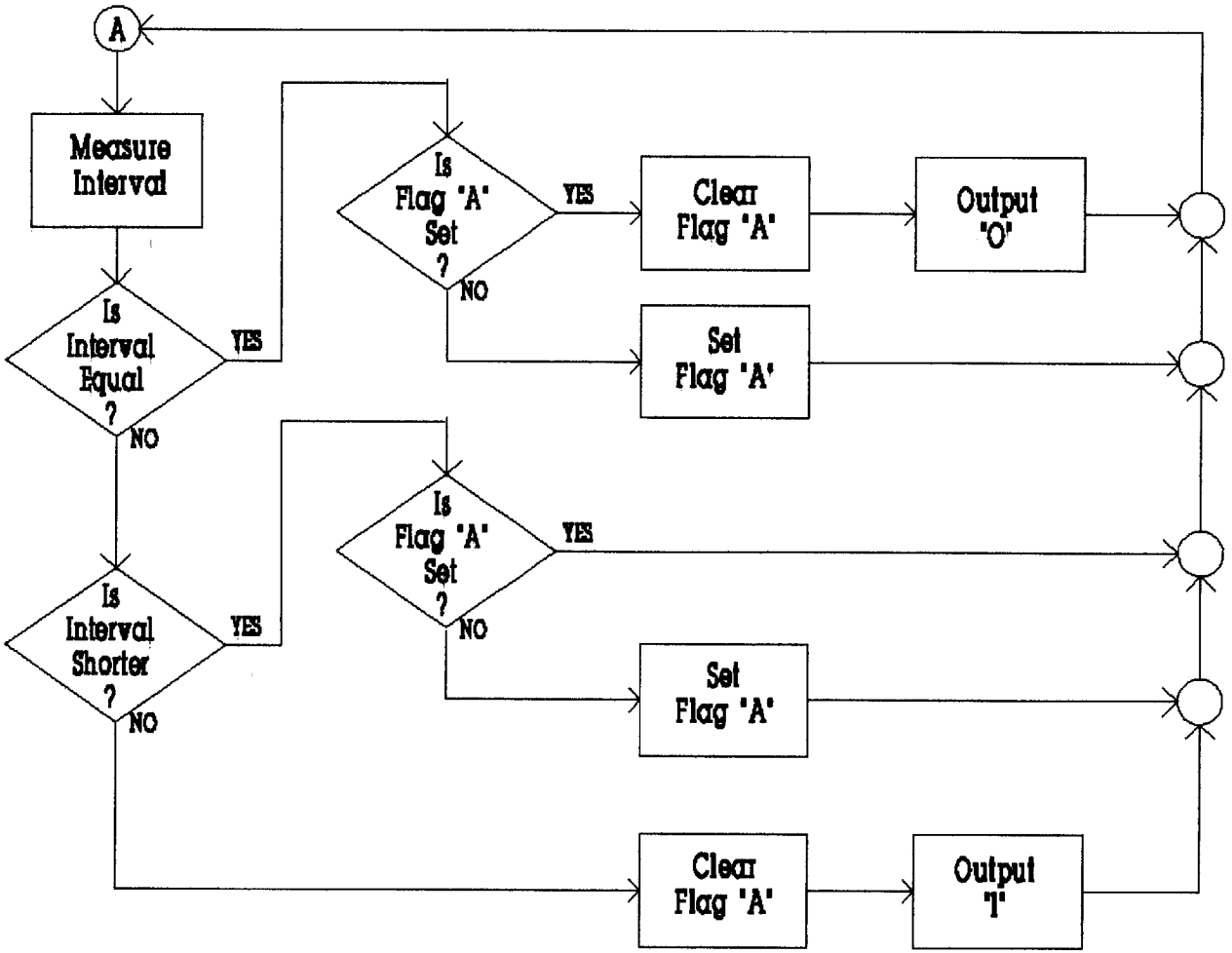
FIG. 3G is a flowchart illustrating one possible method of decoder operation.

FIG. 3G represents a flowchart, illustrating one possible method by which a decoder like 915A can decode the data encoded by a dimmer or other power controller. In this example, the "interval" measured is the period or proportion of non-conduction, although other measures and other methods of measurement can be employed.

The decoded data can be supplied to an output 943, which may supply a local accessory used with the lamp load (e.g., electronics 882) and/or be outputted via display 931 or data link 933.

Figure 3H:
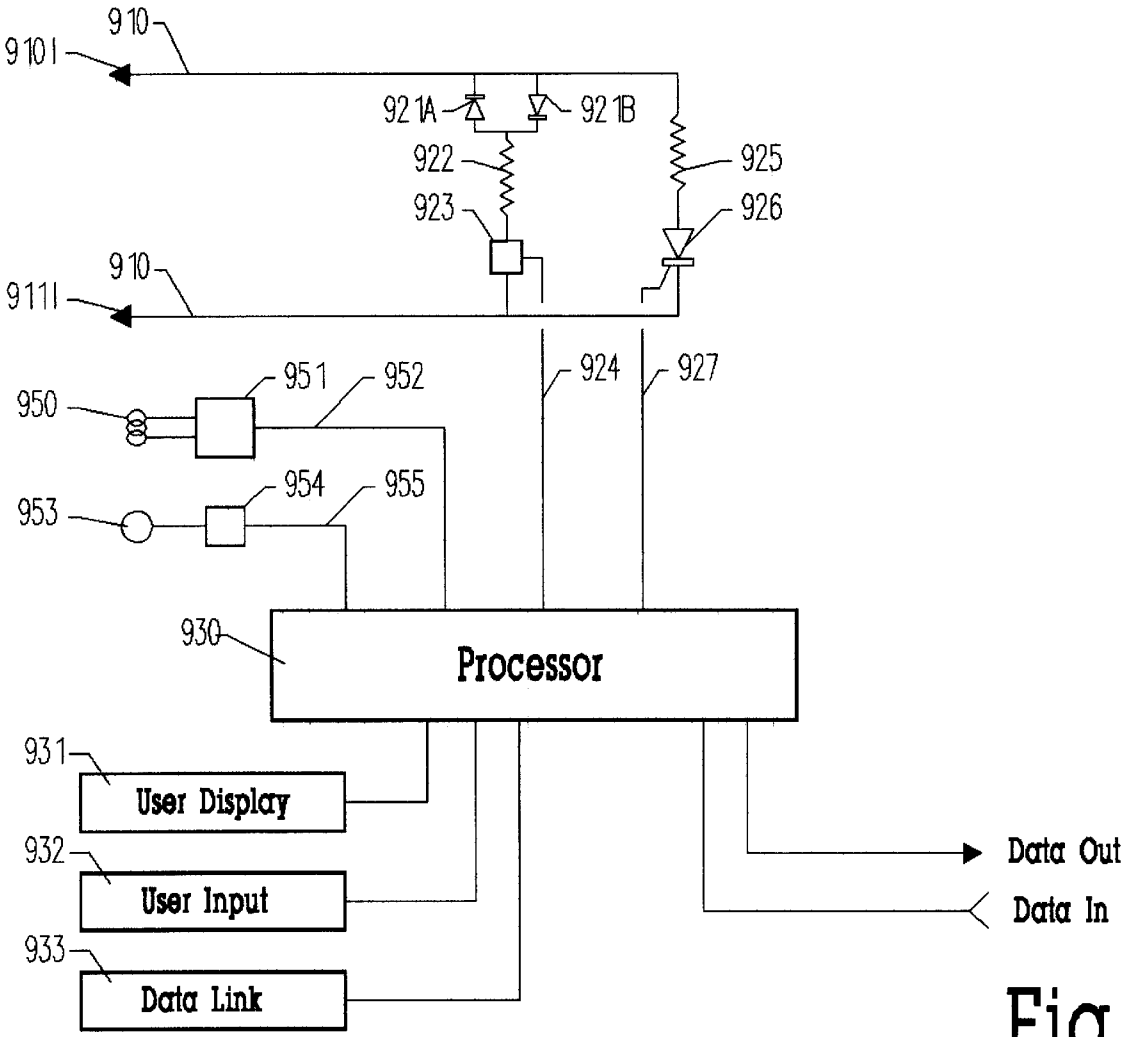
FIG. 3H illustrates one possible handheld decoder/signaler.

FIG. 3H illustrates one possible embodiment of a hand-held decoder. Many of the components serve similar functions to those in the decoder of FIG. 3F. In addition to an input (910I and 911I) for direct electrical connection to a branch circuit, the illustrated embodiment also includes an inductive or capacitive sensor 950 with associated electronics 951 and a photodetector 953 with associated electronics 954. Photosensor 950 or an equivalent allows "reading" the encoded data by holding the sensor in proximity to any branch circuit conductor, coupling the waveform. Sensor 953 or an equivalent allows "reading" the data from any indicator responsive to the power device gate drive (e.g. 827A) or the power device output (e.g. 828A) having a sufficient speed of response.

Figure 3I:
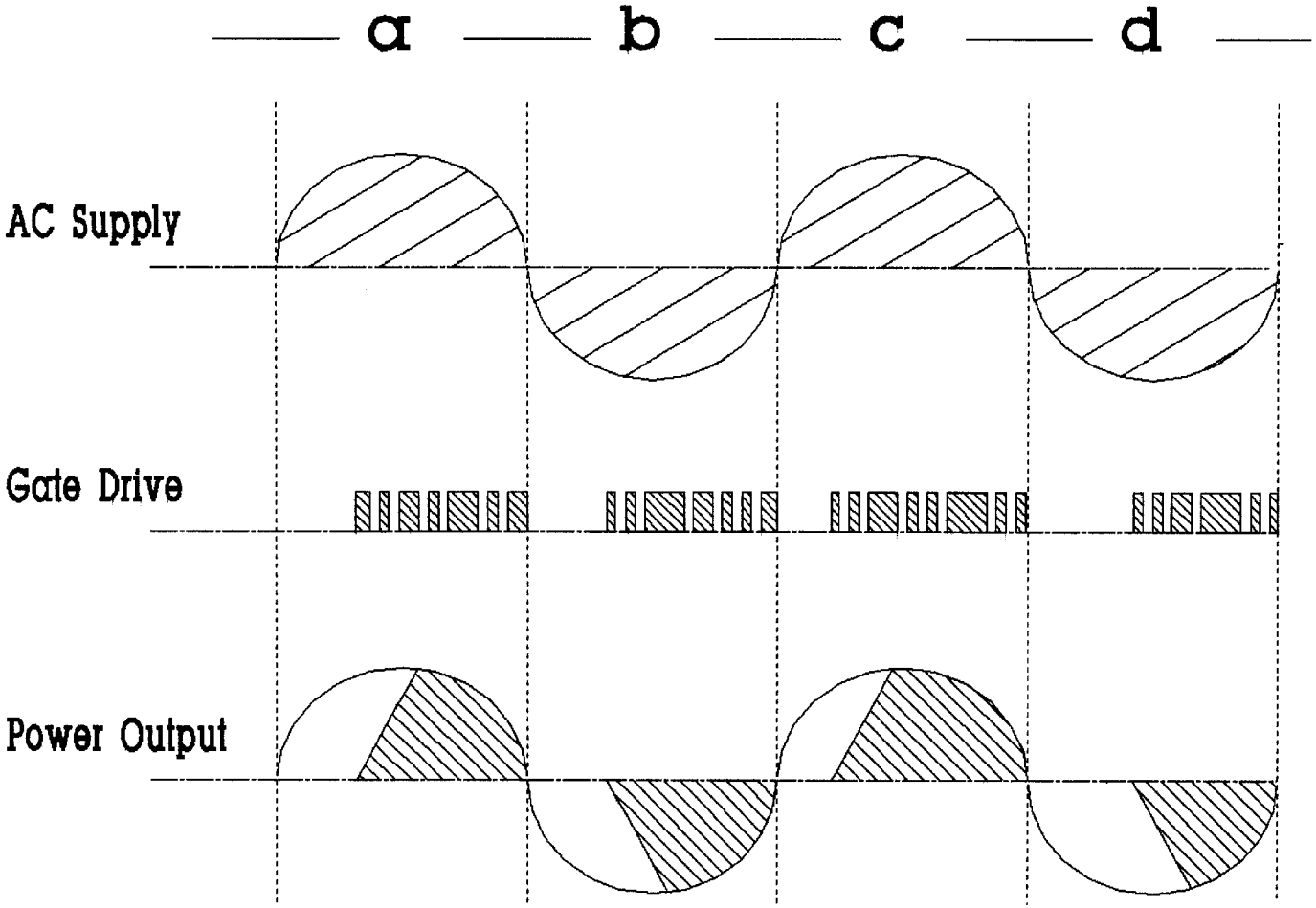
FIG. 3I illustrates waveforms at various points in the lighting system of FIG. 3C showing a compound gate drive waveform.

FIG. 3I illustrates a further improvement. It is a known characteristic of the silicon controlled rectifiers used in dimmer power stages that application of gate drive will not maintain the device in a conductive state unless a load is present and current flows. Otherwise, the device will come out of conduction as soon as gate drive is removed. However, once the device is in conduction it will remain so until the end of the half-cycle, even with gate drive removed.

FIG. 3I illustrates a "compound" gate drive signal. A pulse train encoding data at a relatively high rate is applied to the power device gate (e.g., via 821A). The leading edge of the first pulse in a given half-cycle is applied at the phase angle determined by a method encoding data in the power output waveform based upon a single transition between one and the other of conductive and non-conductive power conditions in that half-cycle. With a load present, a thyristor will enter conduction and remain conducting until the end of the half-cycle, although the gate drive to it will continue to alternate. As a result, data can be decoded from the gate drive (for example, via indicator 827A and sensor 953) at a very high rate, while the same or different data can be decoded at a lower rate from the power device output, whether by direct electrical connection or by inductive, capacitive, or optical coupling to the load wiring or to an indicator.

While the same information can be sent to multiple dimmers, each dimmer can be used independently to send, via its own load wiring, different data streams, dramatically increasing the bandwidth of the total system and associating specific data with each such dimmer. The relationship between the desired intensity value for a lamp load represented by the power output of a dimmer and the information encoded about the lamp load and/or the desired adjustment to one or more parameters of the beam produced by it are integrated, such that no "addressing" of the receiver/decoder at the lamp load is required. Re-routing of the power output of a dimmer reroutes the data with it. (Clearly, the data encoded by a given dimmer can be readily reassigned to another dimmer, when desired.)

Multiple devices can be separately addressed on the output of a single dimmer by a simple addressing scheme or other method.

Figure 3J:
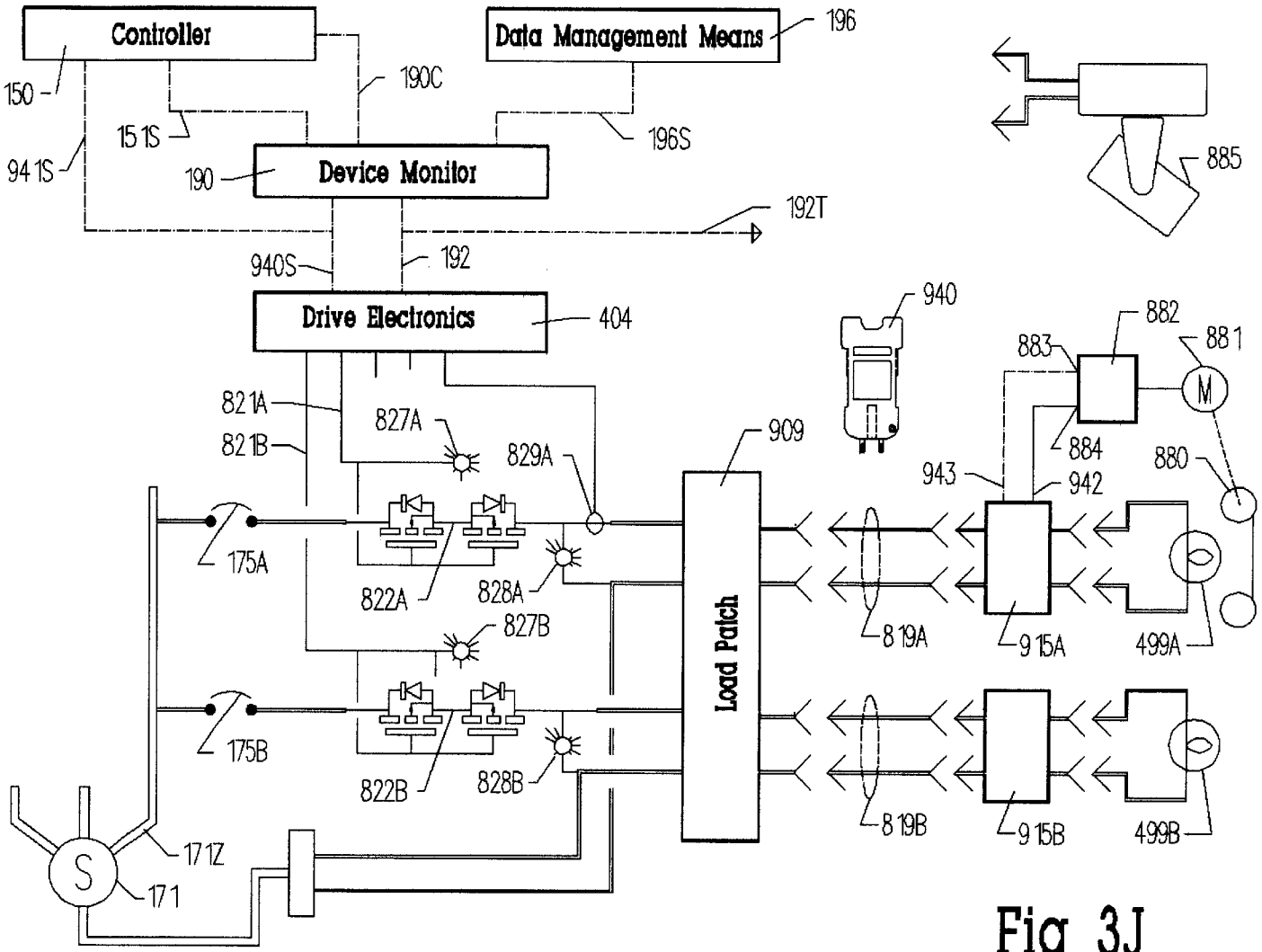
FIG. 3J illustrates a lighting system incorporating means for communicating via the power wiring and the use of non-SCR power devices.

FIG. 3J illustrates an improved system employing non-SCR power devices (such as, for example, also illustrated in some previous Figures). Systems employing such power devices are capable of even higher data rates through the load wiring in certain modes.

Figure 3K:
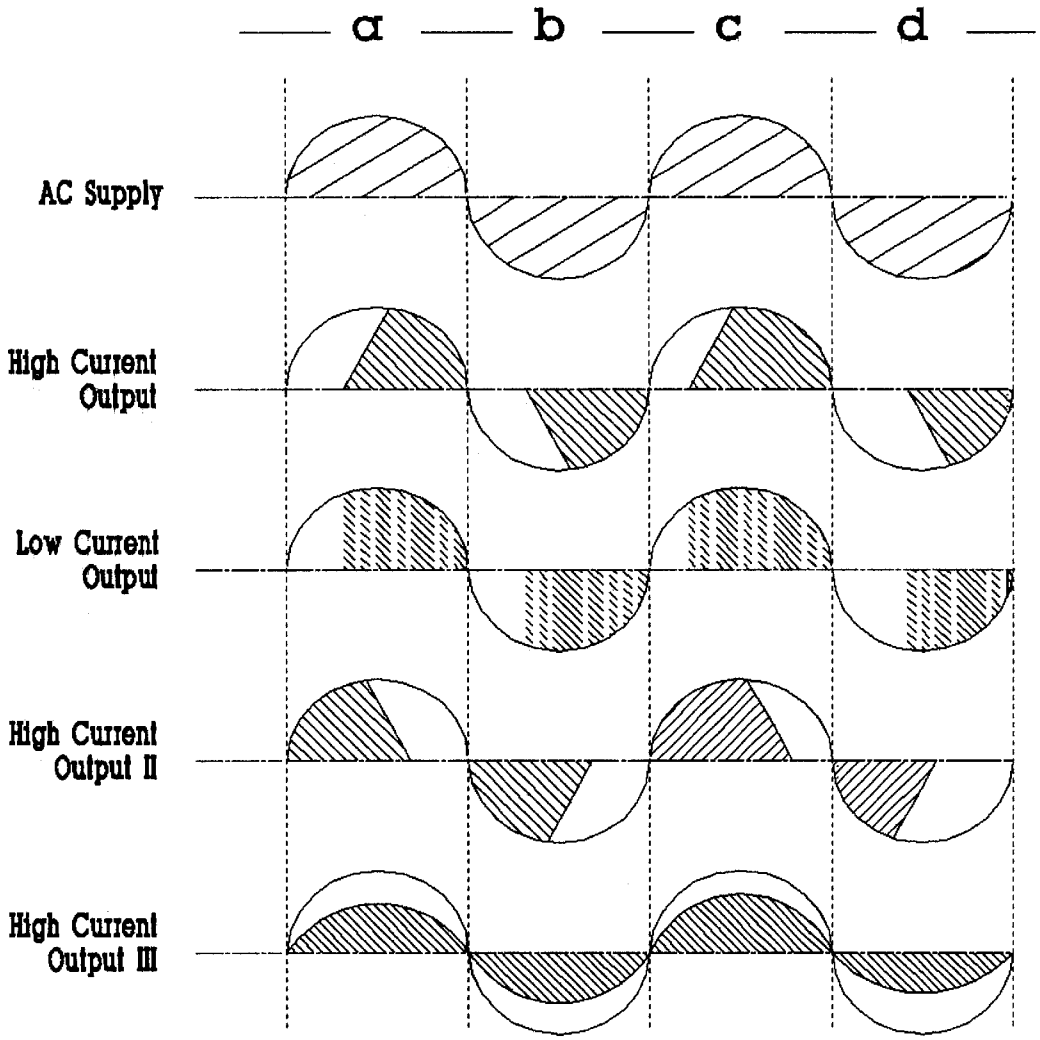
FIG. 3K illustrates output waveforms as may be produced by a non-SCR power stage.

Referring to FIG. 3K, it will be seen that such power devices can produce a phase-control waveform (in forward or reverse or other variations) or can be employed in a pulse-width-modulated or other mode. In any of these modes variations can be produced in the dimmer output encoding data. In addition to varying the timing of a transition and/or average power per half-cycle or series of half-cycles, other encoding methods can be used. In one example, a power stage could alternate between forward and reverse phase-control waveforms to encode data. In the case of dimmers normally having an essentially sinusoidal output waveform, instantaneous voltage could be varied across a half-cycle so as to produce an asymmetrical shape (while maintaining the same average power) to encode data.

While employing one output waveform when driving a load (e.g., any of the "High Current Outputs" of FIG. 3K), the absence of a load or the presence of a minimal load can be detected (for example, via current sensor 829A) and the output waveform changed to encode data at a higher rate (e.g., the "Low Current Output"). Because of the minimal current demands, relatively abrupt transitions generate little or no significant EMI.

The data communication methods of the present invention can also be used with loads not normally employed with dimmers (such as automated fixtures with gas discharge sources, e.g. 885). A significant change can be made in the period of conduction without substantially changing the amount of power available to the load (particularly given the ability of modern power supplies and ballasts to line-regulate). Because the current demands of a transition near the beginning or end of the half-cycle are modest, a choke, a controlled transition, and/or forced air cooling of the power devices may not be required. Thus, while the data communication methods of the present invention can be used with dimmers, the use of dimmers is not a requirement.

Another aspect of the invention is the use of means at or near the load that produces a change in load characteristics detectable upstream (for example, at a dimming or distribution point) in the system. FIGS. 3F and 3H illustrate one of many possible techniques, here a power resistor 925 and silicon controlled rectifier 926. Processor 930, by driving the gate of device 926 via 927, can place resistor 925 (or another component) across the branch circuit. Whether a load is connected to the branch circuit or not, the result is a change in a characteristic of the branch circuit detectable elsewhere in the system (for example, by the current sensor 829A). Such a change, its timing, and/or a sequence of changes, can signal another system component or communicate data to it. (In the example illustrated, the change is asymmetrical, affecting half-cycles of only one polarity although both could be, symmetrically or not.)

Another aspect of the invention is the maintenance of a minimum average voltage level by a dimmer and provisions connected its output to supply electronics and other components with power without the requirement for a separate undimmed supply circuit. FIG. 3F illustrates a circuit, including a solid state switching component illustrated in relay form as 104, that selectively connects a storage capacitor 200C to the incoming line via a current-limiting resistor 103R. Controller 105 senses the voltage available. Upon detecting a voltage available less than a threshold, controller 105 causes switching component 104 to connect the storage capacitor 200C across the line. Current through the circuit will charge storage capacitor 200C until the available voltage rises above the threshold, at which point controller 105 will cause switching component 104 to disconnect storage means 200C from the line and current flow through the circuit will cease. If fine regulation is required, an optional integrated circuit voltage regulator 106 can be employed. Voltage across the circuit will never exceed the threshold value and dissipation in the components will never be excessive. Such a power supply (or one operating on other principles) can power not only the decoder's electronics but the electronics and actuators of a fixture or fixture accessory. Such a power supply method can exploit the characteristic of incandescent lamp loads that a significant amount of power can be applied before the filament produces visible light. Thus, even when "off", a dimmer can still pass sufficient power for the operation of a power supply. A minimum power level can be readily maintained, for example, by specifying a minimum value for the firing angle of the dimmer.

A solid state switching component can also be provided in series at the lamp load to interrupt current flow through the lamp so as to permit a substantial increase in average power in the circuit without producing visible light. The switch can be controlled locally (indeed, the local electronics can signal the dimmer drive electronics to increase average power through the power wiring or by another route) and/or the switching component can be controlled from a remote location over the power wiring or via another route.

Figure 3L:
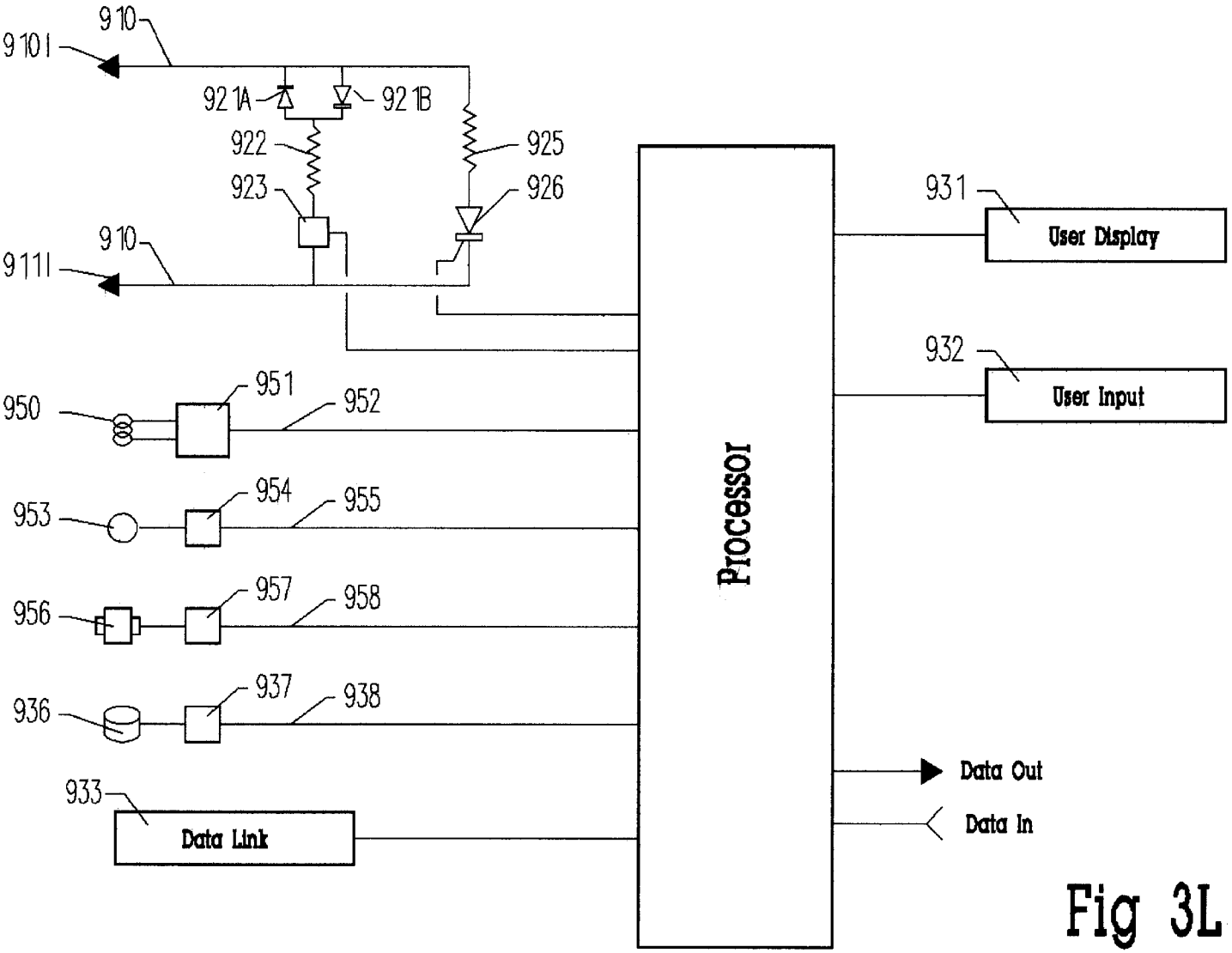
FIG. 3L illustrates one possible handheld unit including a decoder/signaler and additional features.
Figure 3M:
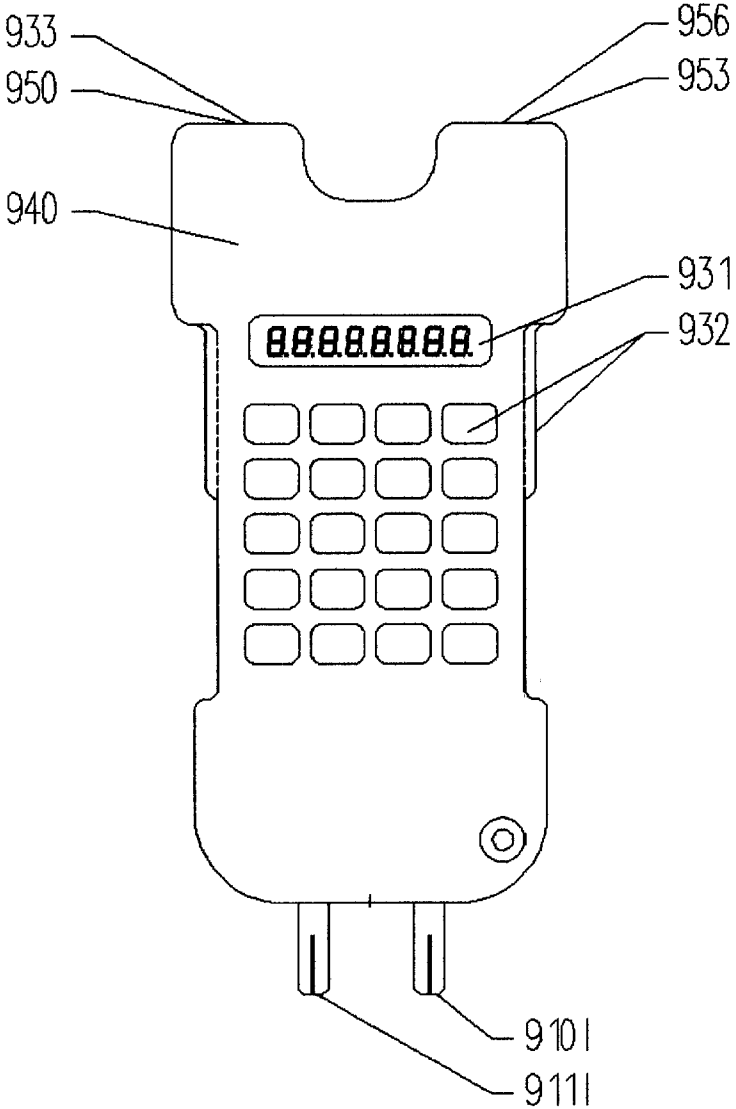
FIG. 3M illustrates one possible mechanical design for a handheld unit.

FIG. 3L illustrates one possible embodiment of an enhanced handheld decoder and FIG. 3M one possible mechanical design. In addition to the direct electrical input via 910I and 911I and the sensors 950 and 953, the enhancements illustrated include a laser diode 956 with associated electronics 957 and an angle sensor 936 with associated electronics 937. The laser diode can be used as a pointing device; as part of a rangefinder; and for reading bar codes.

Various of the sensors can cooperate. A example is the combination of the laser rangefinder (employing diode laser 956 and photodetector 953) and the angle sensor 936. Determining the distance from one point to another is repeatedly required in both "surveys" of an existing venue to establish its dimensions and during the setup of a production, often to a position or an object that it may be difficult or impractical to reach. A laser rangefinder can determine the straight-line distance from the user to a remote point, which will not generally be useful unless the beam is level or plumb. The combination of the straight-line distance determined by the laser rangefinder and the vertical angle as determined by the angle sensor provides the hypotenuse and one included angle of a right triangle, which provides two variables permitting the calculation of the length of one side of the triangle, which is the vertical offset between the rangefinder and the target, and of the other side, which is the true horizontal distance between the rangefinder and target.

The combination of the capability to determine both distance and vertical angle also permits finding, for example, the vertical height difference between two points, by calculating the vertical angle and range to each of the two points and subtracting the calculated vertical height of the two to arrive at the difference.

In other cases it is useful to determine the point located directly over a given location (or directly under a given point in an overhead structure) or level with a given surface. In lieu of specialized devices that employ an internal gym-balled prism to split a single beam into plumb and level ones, a laser diode/level sensor combination can readily display vertical or horizontal angle, serving as a digital protractor as well as an indicator of level and plumb.

Another valuable use is in triangulating the coordinates of a position, whether for finding a desired location or for measuring the actual location of an object. In entertainment practice, such measurements are frequently referenced by distance left or right of a centerline drawn down the middle of the performance space and "upstage" or "downstage" of a "plaster line" drawn, by convention, in theaters on the upstage side of the proscenium arch and in other venues at an equivalent position. By mounting a target on each side on the proscenium or other position whose location is known or entered, and by ranging the distance from one to the other, a baseline can be established. Thereafter, by ranging from a given position to one target and then the other, the location of that position relative to both "centerline" and "plaster line" can be readily calculated and displayed. Conversely, the coordinates of a desired location can be entered and the difference between the handheld's current location and the desired location can be displayed, "steering" the user to the latter. Such ranging can include compensation for out-of-level relationships to the target.

A sight/viewfinder can be employed.

Figure 3N:
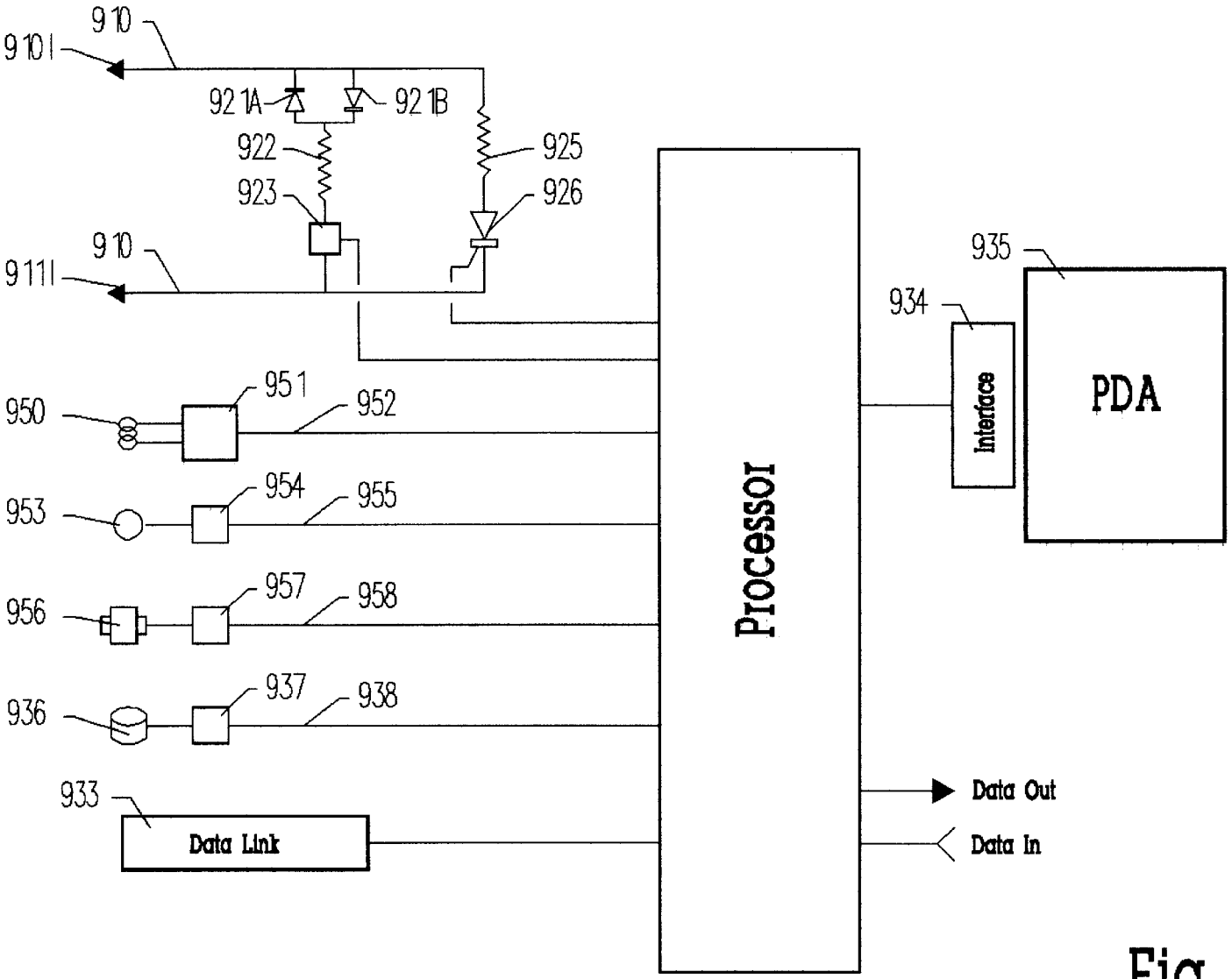
FIG. 3N illustrates one possible handheld unit employing an interface to a separate handheld terminal.
Figure 30:
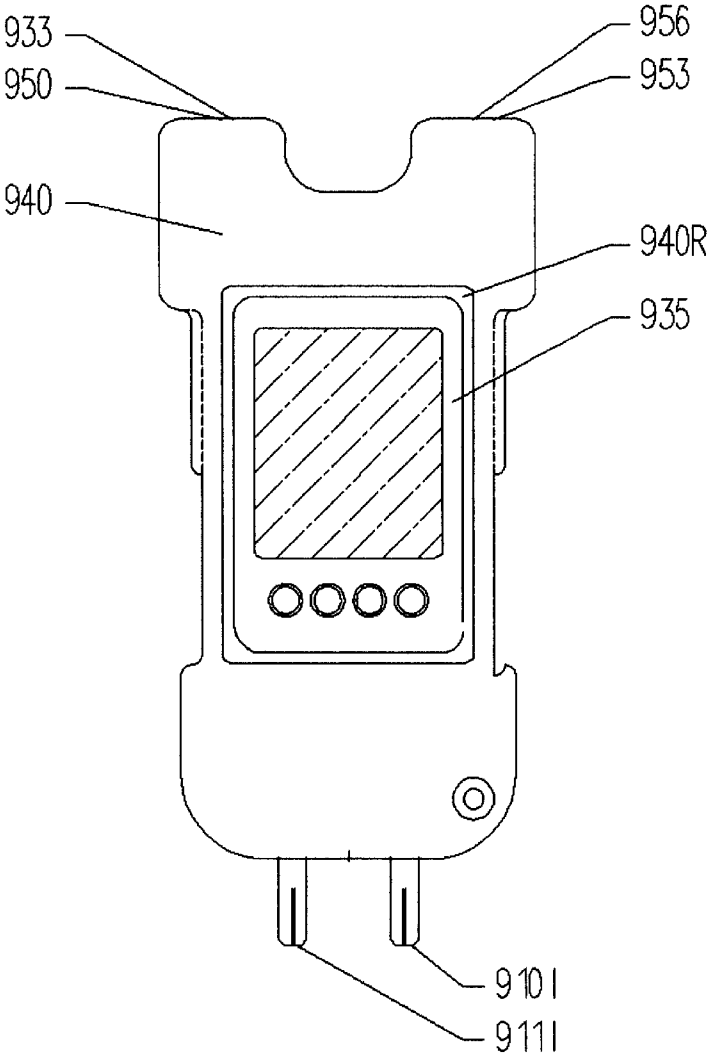

Commercially-available personal digital assistants (PDAs), remote controls, and other devices can be used with or incorporated in a handheld. They lack some of the features illustrated in FIG. 3L, but FIGS. 3N and 3O illustrate a "shoe" that may consist of a housing containing various additional sensors and components, which are interfaced by an appropriate connection/interface 934 to the PDA or other handheld terminal 935. (The nature of that interface 934, whether a connector or an infrared link, will be determined by the design of the PDA, remote, or terminal.) The PDA or other handheld terminal is supported in relationship to the "shoe", illustrated in FIG. 30 as accommodated in a recess 940R. The PDA thus can, for example, provide all or part of the operator interface function.

As discussed elsewhere in the application, one or more of the sensors of a handheld can be remoted from the balance of the components. Examples include inductive, capacitive, and/or RF transponder sensors for sensing the presence of voltage or current flow in electrical components; phase-control duty cycle; encoded data; and RFID transponders, and (including via fiber-optics) emitters and detectors for bar-code reading. Possible locations include glove tips, rings, wristbands, and commonly used hand tools.

While, ideally, a single sensor or other component will be employed for multiple functions, it may not always be practical. For example, the optics required for laser ranging may not permit use of the same laser diode and/or photodetector for bar code reading.

Figure 3P:
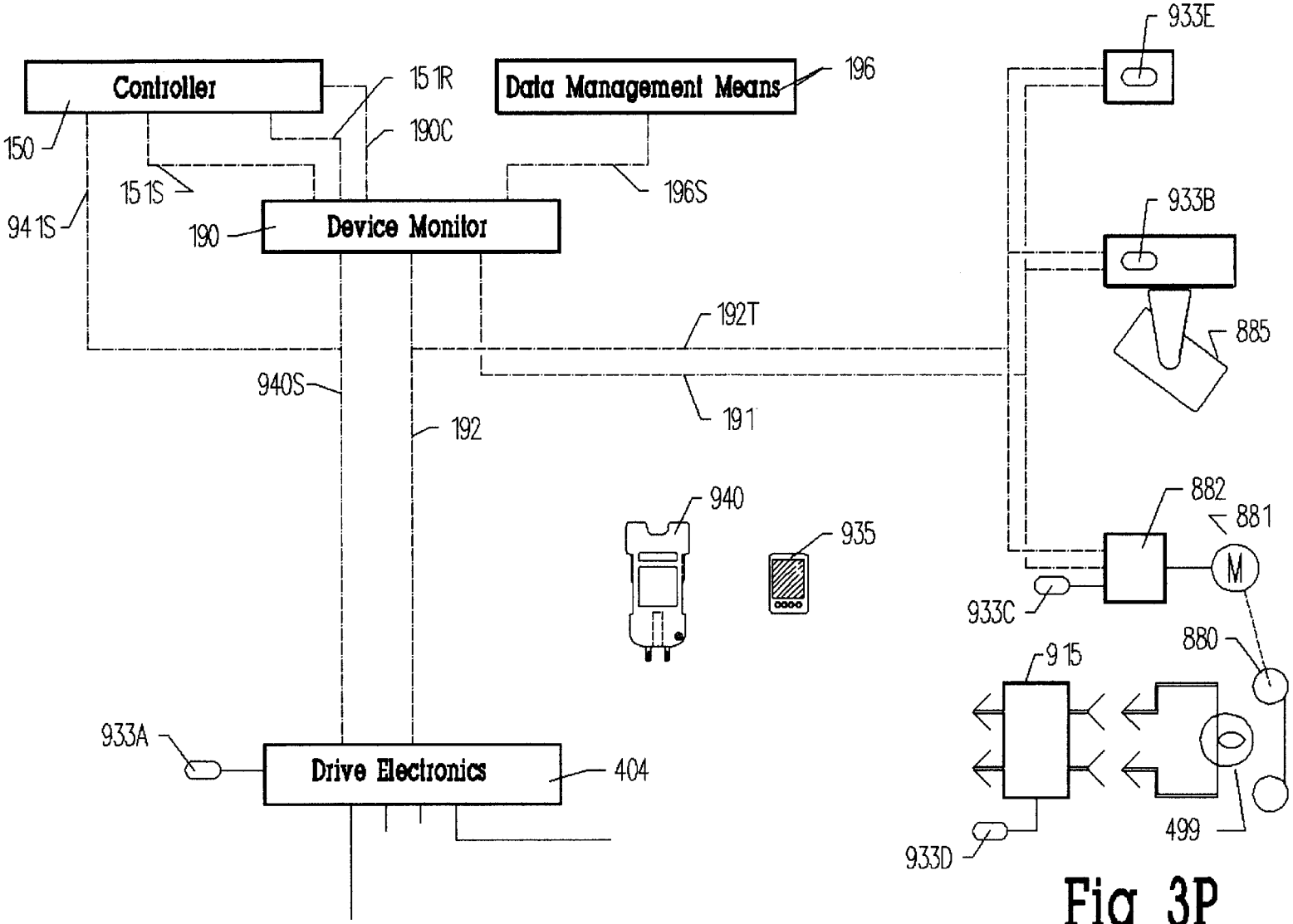
FIG. 3P illustrates a portion of a lighting system with enhanced communications.

FIG. 3P illustrates other improvements.

In the previous Figures, various of the decoders have been illustrated with a data link 833, which permits interaction and interchange of data with other devices. Known infrared transceiver assemblies are one alternative for the function, permitting interaction and exchange with a variety of other devices including commercially-available personal computers (PCs), personal digital assistants (PDAs), and remote controls.

For example, in the case of FIG. 3P, drive electronics 404, decoder 915A, color scroller electronics 882, and automated fixture 885 all incorporate data links 833A–D. The user can employ a handheld decoder 940, a PC, or a PDA or remote 935 to interact with any one of these devices. One benefit is dramatically improved operator interface capability without a substantial increase in device cost or the introduction of controls and displays subject to wear and requiring maintenance.

Interaction can also take place through serial data channels used for the transmission of desired intensity, parameter, and other data, for example, 192T and return side 191.

A device can supplement, display, and/or interact with data stored on or available to another device.

As an example, a device like automated fixture 885 can report a problem detected (e.g., a component failure) by outputting an error code via its access to the return line 191 and/or its data link 833, which can be displayed by another device or terminal as a detailed text message useful to the operator. Such an output can also be used to trigger an interactive store of trouble-shooting and repair instructions, including graphic, pictorial, and/or audio instructions, stored on a CD-ROM or other means for storage.

In addition to communicating with other devices and terminals regarding their own status, devices equipped with a data link can be used as gateways from handheld or other portable terminals to distant parts of the system.

For example, data linked from one device (e.g. a handheld) to another data link equipped device can be re-transmitted via a different medium to which the receiving device has access (for example, serial return line 192). Conversely, data generated elsewhere in the system can be distributed to one or more devices having a data link, which couple them to a handheld. Dedicated gateway units (e.g. 933E) can also be installed for the purpose. Sources and/or destinations for such data can include a data management system or function as later described.

For example, a handheld terminal can locate itself using the laser rangefinder or another method (e.g., known ultrasonic methods or others enumerated later). That location is transmitted to a component with access to the database records necessary for a light plot and/or rigging plan, which returns a description, displayed in tabular and/or graphic form, of the lighting equipment and/or rigging points nearby. Data entered via the handheld terminal can be linked back to update this or another database.

Good practice in both permanently-installed and portable systems includes providing spare power and control signal cables to allow for changes, expansion, and failures. Such "spare" conductors can be used as a "back channel" which, because it lacks the overhead required for transmission of cue data, can increase the "through-put" of other data.

FIG. 3P and other Figures illustrate the use of a "device monitor" 190 to insert additional data into the serial data stream produced by a controller 150 and to handle data on return line 191. The controller itself can, of course, be provided with the hardware and software necessary to interact with other devices directly.

An external hardware unit, such as that used for device monitor 190, can be used for or cooperate in additional functions such as the correlation of channel and dimmer selections on the controller and/or active in its output with information identifying the specifications of, the function, status, and/or the location of the fixtures or accessories controlled.

Conversely, an external hardware unit, such as that used for device monitor 190, can serve as enhanced input and display device for controller 150. For example, where controller 150 has been designed for the control of dimmers, the control of non-dimmer devices such as color changers and automated fixtures is unwieldy. Device monitor 190, in addition to managing communications with such devices, can present the operator with manual controls, input devices, and displays better adapted to the control of such devices, outputting the corresponding values to the controller 150 (e.g., via a DMX512 or other output provided via 151R to a corresponding input on controller 150) for storage by the controller 150—or by "button-pressing" the values into the controller 150 via a remote control port on the controller 150 (e.g., via 190C) in the syntax required.

Such an external hardware unit can also take the levels set and/or stored by the controller 150 and "translate" them into more intelligible displays.

Such an external device can perform functions like communicating with devices to determine their serial addresses and interact with the controller (and a data management means) to create a "soft-patch" and resolve any conflicts in it. Such an external device (or a combination of such devices) can serve as an outboard "patch engine" and router, responsible for routing data generated by one or more consoles and other controllers to the various dimmers, fixtures, accessories, and devices.

These and other improvements have application in the context of followspots and other fixtures.

Such fixtures, which serve as the primary source of light illuminating the principal performers in many types of production, generally rely on gas discharge light sources. Gas discharge sources are not consistent in the spectral distribution of their output. When television or film cameras are used to record, broadcast, or video-magnify the production, "color-correction" of fixtures using gas-discharge sources that illuminate performers is required. Footcandle and color temperature meters are used to establish the deviation from the desired values of the bulb in each fixture (as further modified by fixture "tuning" optics, adjustments, and "throw"). Packages of "gel" are assembled for temporary attachment to the fixture in order to correct the beam to the desired values. The process is time-consuming and the gel package difficult to check and modify during a performance.

A "color corrector" can be provided having graduated scrolls or disc s permitting substantially continuous adjustment of beam color temperature (with "CTO" or "CTB"), green/magenta balance ("minus green" or "plus green"), and, optionally, intensity (with "ND") (although the fixture's dowser or d imming shutter can be used for intensity control). Methods of graduating both flexible "gels" and dichroic filters on glass substrates are both well known in the art.

Desirably, the "color corrector" can be attached to or mounted in existing fixtures in the field.

Housings can be employed, each accommodating a separate scroll or disc, each housing capable of attaching to the fixture or to another such housing so that the user can assemble the combination required by the application.

The scrolls or discs can be manually actuated or motorized. When motorized, they can be driven by local electronics, which can be coupled to other devices.

By verbal instruction to an operator at the fixture/corrector or by remote control of motors, the user can adjust the various scrolls or discs to correct the beam values to the desired values.

The motor control electronics can be provided with their own data link which, if optical, can be highly directional and aligned with the light beam. A handheld terminal or remote can be used by a person remote from the fixture to control the corrector via a compatible data link.

In fact, the correction process can be made automatic. A light/color meter provided with a data link or interface to one can link to the corrector so that the beam can be automatically conformed to the specified values by appropriate adjustment of the scrolls, discs, and/or dowser.

The light/color meter and/or the "corrector" can communicate via a hard-wired serial channel and/or a broadcast link. The measured values can be read at a location remote from the light meter(s), including at the fixture, and the user can actuate the scrolls, discs, or dowser from a variety of remote locations.

In addition to broadcast and hard-wired serial data communication, methods can include transmission over existing wiring used by intercommunication systems (e.g., the Chaos Audio 301 system) by multiplexing data at inaudible frequencies or transmission down the power supply conductor. Such transmissions can be used to control other beam parameters and communicate with and between various parts of a lighting system and staff.

Additional functions are possible.

Supervisory control over fixture intensity can be afforded from a remote location, for example, proportionally mastering a level determined by another control, for example, one used by the followspot operator.

Supervisory control can be afforded from a remote location, modifying any one or more of the adjustable parameters.

Where the fixture provides means for inserting additional "gels" in the beam (for example, the "boomerang" of a followspot), interaction can be provided between the "gel" selected and modification of the parameters to compensate for differences in transmission.

Variations in intensity across the beam of a fixture can be of concern. The light beam can be moved across a stationary meter and those values can be used to produce a graphical map of the variations in intensity across the beam useful in correcting them.

The location of the followspots or other fixtures in three-dimensional space can be determined by pointing their beams at two or more locations a known distance apart and triangulating fixture location. Fixture/subject distance ("throw") can be calculated and variations in it compensated for in beam intensity and size.

Data Management

The type of data distributed, referenced, and maintained can extend well beyond that found in prior art lighting systems.

The development of practical remotely-controllable light dimmers (most notably in the form of thyristor-based phase-control models), and the subsequent application of the digital microprocessor (in the form of the modern "memory board") to the control of such dimmers has drastically improved the ease, efficiency, and repeatability with which sophisticated artistic designs can be produced. Such equipment has itself, however, made no improvement in the efficiency with which such designs can be prepared and maintained, and in some respects has made these tasks more difficult.

Well before the first actual dimmer levels are stored in the control console, the lighting designer for a production must prepare a specification of the equipment required, including the model, bulb, accessories, color media, function and channel assignment of each of hundreds of lighting fixtures, as well as their physical location in the performance space. At this phase of the design process, this specification often takes at least three forms:

- A "hookup" or listing of the console control channels in numerical order, with those fixtures controlled by each console channel specified by type, wattage, accessories, and color media and each identified with a unique code (that code generally identifying its location in the performance space, for example, fixture 2P-10 as the tenth fixture on the second onstage electric pipe);
- A "light plot" or scaled blueprint showing the physical location of each fixture within the performance space, with the type and wattage of each fixture indicated by the choice of graphic symbol used to represent it and the channel, color, and unique code for each fixture written in or alongside its symbol;
- A "shop order" (essentially a bill of materials) listing the quantity of each type of fixture and accessory required, along with its hanging and supporting hardware.

In some cases, an "instrument roster" is also prepared, which lists in order of its unique code (which is to say, by location), each fixture in the lighting system, and includes that fixture's model, bulb, accessories, color, focus, and channel assignment.

As the designer views rehearsals; considers and discusses the production's artistic and practical issues; and responds to changes in the content of the production, the manner of its staging, and the contributions of other designers (for example, in the scenic and costume designs), his or her lighting design may change, requiring that all three (or four) documents be revised. Discrepancies may be present between them.

At some point, the designer will submit these documents to a "production electrician", who is charged with supervising the set-up of the lighting system in the performance space (and/or with reworking, and supplementing, if need be, any lighting system already installed there) such that it meets the designer's specifications. The production electrician must check the designer's paperwork for internal errors and omissions, as well as for impracticalities (like the assignment of a total fixture load of 3000 watts to a dimmer of 2400 watt capacity). The production electrician must generate still more paperwork that reformats and/or further evolves the information presented by the designer. For example, from the designer's specification of the color for each fixture, and factoring in both the size of the piece or "cut" of filter material required by each fixture model and the number of cuts of a given size that can be obtained from the size "sheet" in which a given line of filter material is sold, the production electrician must determine the number of sheets of each filter color that must be ordered, as well as the number of cuts of which size need be made from each sheet and the fixtures for which they must be marked. In another example, the production electrician must translate the spatial relationship between the fixtures and between the fixtures and dimmer location, as well as the electrical relationship between fixtures, dimmers, and channels; the design of the dimming and the cabling system employed by the source of the production's lighting equipment; and the location and quantity of electrical power available in the performance space into a complete electrical specification of the lighting system. This electrical specification must include the number and wattage of dimmers employed; the quantity of each type and length of cable needed; and the "patches" or interconnections required at the dimmer power output and/or at the control signal level required to produce the relationship between control channels and fixtures the designer desires. This specification must, in the case of portable dimming equipment and/or lighting fixtures and accessories like moving lights and color changers, also include the control signal or low-voltage wiring required. Documents must be generated that list not only the kind and quantity of dimmers and cables required, but the marking of each connector and details of each patch such that the specified equipment can be quickly assembled and/or configured into a correctly functioning system at the performance space, and that the electrical pathway to each fixture can be quickly and readily identified to facilitate trouble-shooting and subsequent changes.

It is not unusual for the designer to continue to make changes in the design after the production electrician has begun his or her preparations; requiring changes to an ever-growing volume and variety of paperwork, as well as to the physical equipment that the paperwork describes.

The designer and the production electrician arrive at the performance space for set-up. In the designer's briefcase are the three (or four) documents described. In the production electrician's briefcase are the same basic documents, plus a number of additional documents specifying, for example, the dimming and cabling system in considerable detail. On one or more trucks (and/or already in the facility) are fixtures, cables, dimmers, and color media which, when assembled, will produce the lighting system specified by the designer. In addition to including the appropriate quantities of fixtures and other equipment, the lighting equipment is preferably prepared and premarked to minimize the amount of time and labor spent and the errors made in assembling it into a system.

Prior to the advent of dimmers remotely-controllable by low-voltage signals, the relationship between fixtures and control channels was determined solely by connecting (or "load-patching") the power cable supplying a fixture to the power output of the desired dimmer/channel. With the advent of low-voltage remote control of dimmers it became possible to change the relationship between a channel on the control console and the dimmer it controls by rerouting the low-voltage control signal between the output of the former and the input of the latter ("signal-patching"). In systems in which the controller incorporated a microprocessor, the channel/dimmer arrangement could be changed by changing a "soft-patch" (a lookup table permitting the user to alter the relationship between the control channel on the console and the console's outputs to dimmers). In many modern permanently-installed systems, one outlet is permanently wired to one dimmer ("dimmer-per-circuit"), and the relationship between a fixture plugged into that outlet and a control channel is determined solely by the "soft-patch". In many modern portable systems, a combination of "load-patching" and "signal-patching" or "soft-patching" is employed.

In a very broad analogy, the collection of fixtures, cables, dimmers, and other equipment that makes up the lighting system constitutes the "hardware"; the "patches" constitute the "firmware"; and the intensity levels and other cue data stored in the control console become the "software".

Among the tasks that go into preparing a lighting system for use, one is the entry of any patches. Load patches are mechanical, involving making physical connections, as are those signal patches that involve routing discrete analog voltages. "Soft-patches" are performed in the digital domain either in the lighting console itself or in an outboard patch engine. These "softpatches" are generally entered numerically via keyboard, and the manual entry of patches for several hundred dimmers takes time and is subject to error.

Figure 4A:
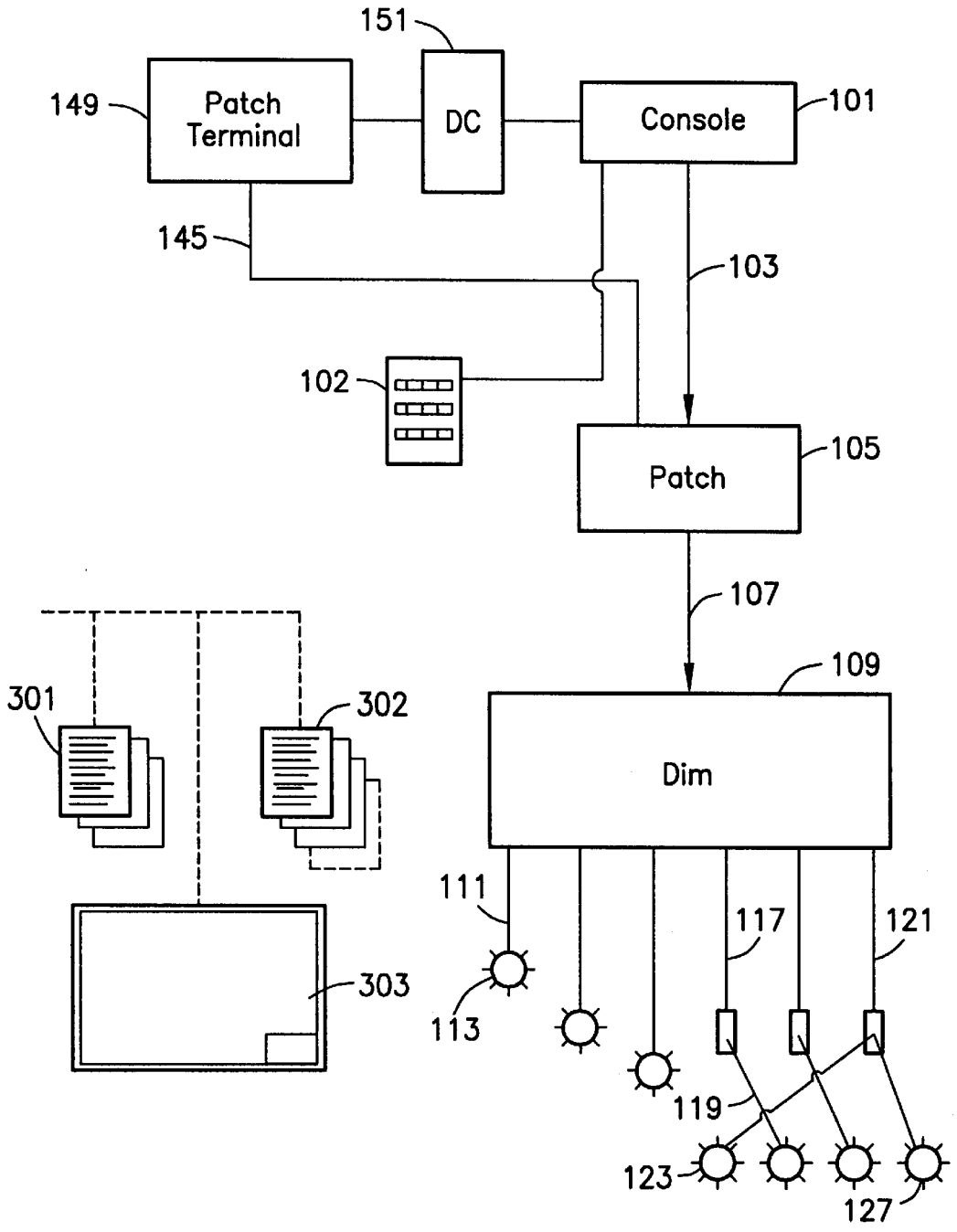
Fig. 4A Prior Art
FIG. 4A illustrates a prior art lighting control system.

FIG. 4A illustrates a prior art system. 301 is a "hookup" document, 302 a "shop order", and 303 a "plot". All are paper forms. 101 is the lighting console, which is illustrated as connected to a software-driven soft-patch unit 105 by 103. The operator interface to soft-patch unit 105 is patch terminal 149. 151 is an input and output device for a data carrier such as a disc drive. As noted, the function of patch unit 105 is generally integrated in many modern consoles. In that case, the keypad of console 101 would also serve the function of patch terminal 149 and the console's data carrier would store both patch and cue data. 102 is an optional handheld remote for the console 101. Soft-patched output 107 is provided to the control input of a bank of dimmers 109. Both dimmer-per-circuit and load-patched approaches are illustrated. Lamp 113 is permanently connected to the output 111 of a dimmer in bank 109. On the other hand, both lamp 123 and lamp 127 are plugged into dimmer 121 but could be re-plugged/re-patched to another dimmer.

Once the set-up of the lighting system (or rework of an existing system) begins, a number of technicians, working under the general supervision of the production electrician, begin to hang or rehang fixtures, run cables, make connections, and insert color and accessories in fixtures. Because this work is generally done under some time pressure, in different parts of the performance space, and often by technicians who were not a party to the preparation of equipment or paperwork for the set-up, the speed of the set-up and the minimization of errors is largely beyond direct supervision by the production electrician, depending not only upon the skill of the individual technicians and their ability to work together, but upon the degree to which and the skill with which the production electrician has organized the process.

It should be noted that, despite his or her best intentions, the production electrician many not have been provided with sufficient time to fully prepare the equipment, or may have had insufficient access to it for such preparation.

Even with preparation (for example, the marking of fixtures, cables, and connectors) and especially without preparation, the quality of paperwork is very important to a successful set-up. Further, it is highly desirable that the technicians working on various parts of the system have access to the information contained in that paperwork, typically by being provided with copies of it.

Once the system has been assembled, the fixtures will be "focused" that is, turned on and their beams manually adjusted in azimuth, elevation, and (depending upon the fixture type and the control it affords over beam characteristics) perhaps also adjusted in size, shape, and/or edge sharpness to achieve the effect desired by the lighting designer. Because focusing a fixture requires that a technician manually adjust it once the fixture is in its final location, frequently requiring that the technician access the fixture by means of a ladder or powered man-lift, or by climbing on a catwalk, truss, or other structural support for the fixture itself, the focus process can take considerable time, particularly when the designer needs to direct the adjustment of each fixture in turn.

With a technician at the fixture and the designer at the vantage point needed to best see the effect of the fixture's beam, neither is generally in a position from which they can turn on the fixture. That typically requires access to the console, which is generally removed from either location. Thus, in addition to the designer and technician, an additional person is often required to operate the console to bring up the channel for each fixture in turn. While some consoles and soft-patch units are available with wired or wireless remote controls that allow bringing up channels, it is rarely practical for the focusing technician to use one, and seldom convenient for the designer, so a third person is still required. With between fifty and five hundred channels to choose from and no direct correlation between channels and fixtures, someone must generally access at least one of the specifying documents (typically the plot) to look up which channel controls each fixture. When the fixture comes up, the technician at it might find that he needs to move it, adjust it, or fix it with the lamp off and might ask the operator to "save" (turn off) the fixture and later "restore" it (turn it back on). All of this requires intercommunication between the technician, designer, and console operator which may be particularly difficult in those circumstances when the distances between two or more of the parties are great, the ambient noise level is high, or the console is in another room.

During the focus process, the designer may wish to double-check the fixture against his or her specifications to assure that it has been correctly selected, colored, accessorized, and patched. During a focus it is also desirable to keep track of which fixtures have been focused, so that none are overlooked. And the designer may wish to document the adjustments made, to allow reproducing them at a later date. To keep up with all these tasks, in theatrical practice, the designer ideally has an assistant to manage his or her paperwork; to keep track of the fixtures that have been and need to be focused; and to feed the console operator channel numbers and the designer whatever information he or she may require.

The focus process will take still longer when extra time is required to turn on the fixtures because of difficulties in establishing which fixture is desired or which channel energizes the desired fixture; by communications difficulties; and particularly when fixtures fail to come on. If a fixture does not come on, because, for example, an error was made in cabling or patching the system; because the fixture or a dimmer was accidentally turned off with its switch or circuit breaker; or because of a failure of the bulb or another electrical component in the system, the focus might be halted until the problem is found and corrected. It is thus desirable to check each fixture for proper operation as early in the set-up as is practical, so that problems can be found and fixed before the focus (and preferably before pipes and trusses are flown out to trim, while the fixtures are still relatively accessable). This may be difficult at the set-up because of the requirement for access to the console, a remote, or some other means of energizing the appropriate dimmer. It is also desirable to double-check that the fixture hung at a given position is as specified, but this requires access to the paperwork.

When an existing lighting design is being reproduced, for example on tour, the technicians who travel with the show might have learned the focus and adjust the fixtures without supervision. This makes getting the right fixtures energized in the right order even more important to minimizing focus time.

In any of these cases, the console operator can be a person knowledgeable about the lighting system (which ties him or her up during the focus, unable to perform other useful tasks), or can be a person with little or no knowledge of the particular lighting design and/or lighting system (in which case they do not know the focus sequence and may be of little use in troubleshooting problems).

Using a console or console remote to test fixtures frequently requires sending a level to the appropriate dimmer through any intervening signal- or soft-patch (requiring that a patch be both made and known). Some dimmers of the last twenty years provide a test or "goose" button on the dimmer itself that fires the dimmer regardless of the status of its control signal input. The dimmer, and therefore such a "goose" button, is frequently at a location out of sight of the fixture that the dimmer powers (unless the dimmer is at the lamp and equipped with such a button). The dimmer controlling a given lamp must be identified and the sequence of dimmers may not relate to the sequence of fixtures.

Throughout the set-up process, the focus, and rehearsals, changes may be made in the system for a variety of reasons. The designer may change his or her design, changes may be required for unanticipated conditions in the performance space, and/or difficulties with equipment require changes or substitutions. These changes render the paperwork brought to the set-up inaccurate, and, if the designer and production electrician are to have an accurate record of the system for operating, trouble-shooting, maintaining, and reproducing it at a later date, the paperwork must be updated. There are a number of practical problems in doing so. Changes are made at different times at different locations in the system and in the performance space by different people. Each person making a change could be asked to update a copy of a relevant document, for example, after changing the color in a fixture, by writing the new color on a copy of the plot, but correcting only one of a half-dozen copies of the plot in use, the other five will still be inaccurate. Further, no correction will be made in any of the related documents that also refer to the color of the fixture (including the hookup, instrument roster, and color cut list), every copy of which will remain inaccurate. Alternatively, one can insist that there is a master copy of the document and that all changes must be noted on it. This produces access and communication problems. In either case, those persons working on the system will have problems with insufficient access to the most current and accurate information about it. Clearly, both undocumented and underdocumented changes produce a variety of problems with setting-up, focusing, and troubleshooting the system. When, for example, a fixture ceases to operate, the degree of difficulty in tracing the electrical path through the system to find the component responsible becomes harder. When the color media fades, without an accurate record of what the color should be, one might have to hope that the ordering code was written on the faded cut when it was first installed.

To this point, the lighting design process has been described as the preparation of a detailed written specification, and the conforming of the physical lighting system to that written specification. However, there also are many productions in which the sequence is reversed. In a television studio, the lighting designer may walk out on the studio floor and decide where a dozen fixtures need to be hung. He or she points to the locations and a half-dozen technicians set to hanging the fixtures, cabling them to the nearest available outlet, and shouting the circuit number to the designer or console operator so that they can be brought up for focus and, hopefully, noted down for the designer's reference in setting cues. In this case, the physical system is assembled first, and the documentation, if any, hopefully follows. Troubleshooting and maintaining a system that evolves in this manner can be very difficult.

In either process, the designer may decide that a change is desired that cannot be immediately implemented. He or she makes a "note" specifying that change, which must be assigned to one or more technicians to perform. Difficulties include not only assigning the tasks efficiently and coordinating notes that are more efficiently performed together, but keeping track of the status of the various projects and updating the paperwork to reflect each change once it has been made. Further, a single change may involve different parts of the system and require several different technicians to each perform a different task part of a larger change.

In recent years, personal computers have been employed to assist in handling lighting paperwork. Using either a generalized database program or one adapted for lighting use, the designer or electrician can enter data once and use various sorts and report formats to generate different documents (a "hookup", for example, is a sort of all fixture records by the channel number field, where an "instrument roster" is a sort of the same records by fixture code). Equipment totals (like the shop order) can be readily produced and certain simple computations performed (like color cut lists and overload checks). When changes are made, updating a fixture's record will result in corrected copies of the various reports the next time that they are run. Whether the documents brought to the set-up are generated by hand or via computer, the process is not changed. If a computer is brought to the performance space to continue updating the paperwork, the problems of simultaneous, multi-party access to accurate information, and of keeping it current, as well as the various other practical problems described, are little changed.

Figure 4B:
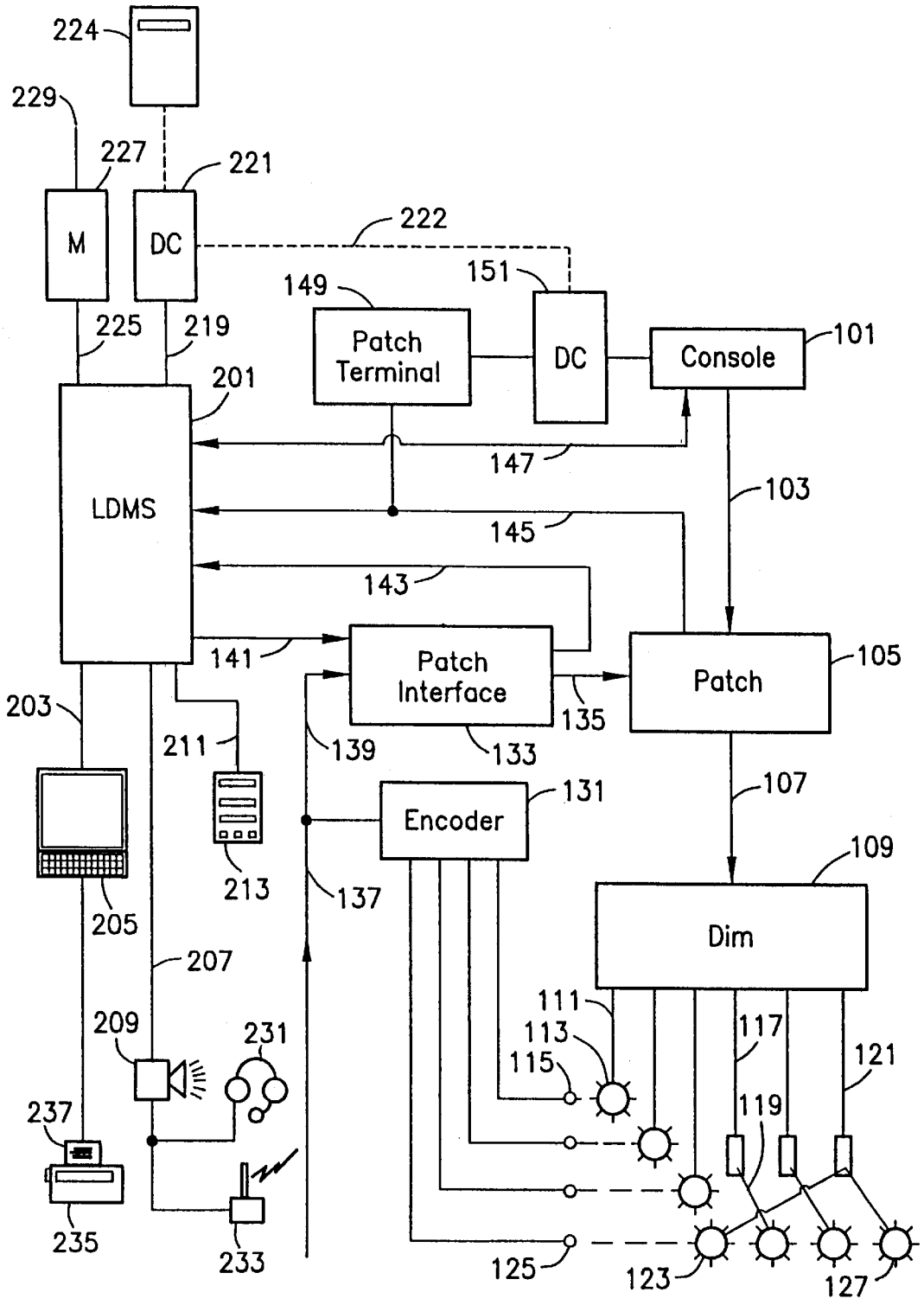
FIG. 4B illustrates a system maintaining system specification information and interacting with the lighting control system.
Figure 4C:
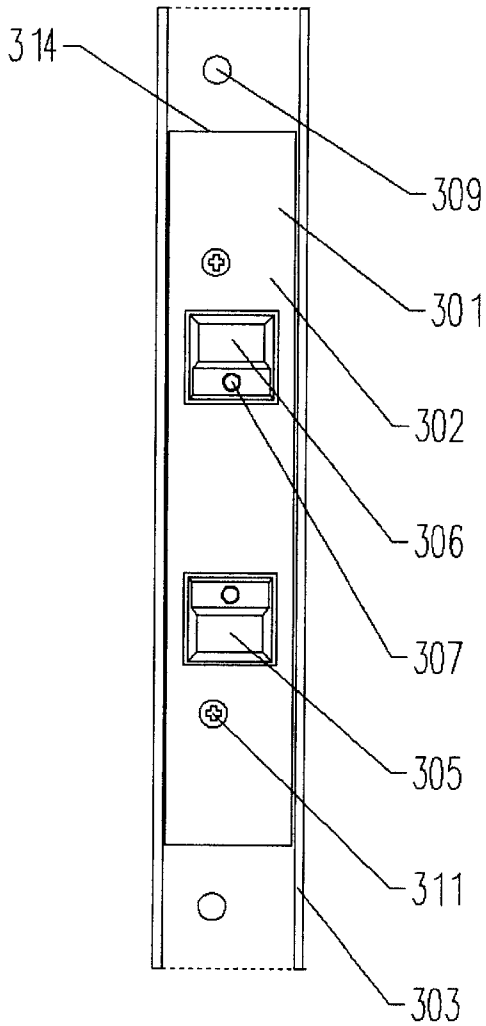
FIG. 4C is a front elevation of a pushbutton station for a pushbutton focusing system.
Figure 4D:
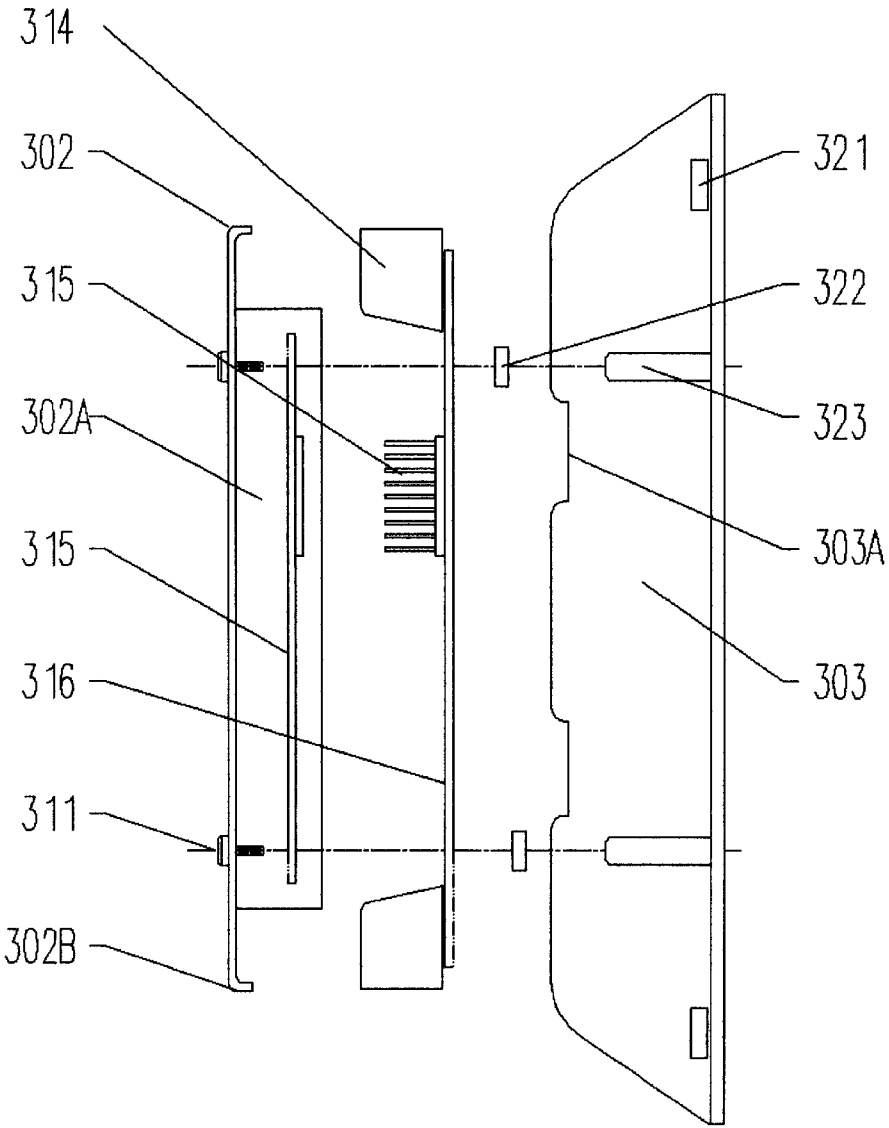
FIG. 4D is an exploded side section showing various possible subassemblies of the pushbutton station of FIG. 4C.
Figure 4E:
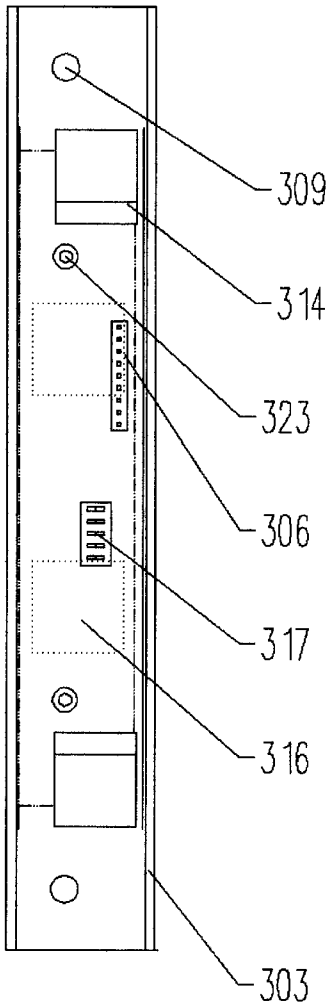
FIG. 4E is a front elevation of the pushbutton station of FIG. 4C with the cover removed.
Figure 4F:
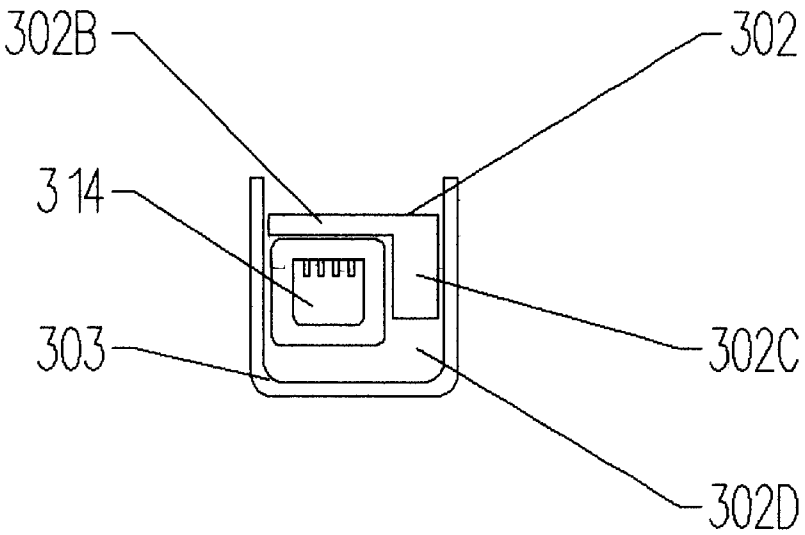
FIG. 4F is an end elevation of the pushbutton station of FIG. 4C.

Refer now to FIG. 4B, which illustrates one embodiment of a lighting system incorporating means for managing and integrating system specification data.

The block diagram of the intensity control system, including lighting console 101, patch unit 105 and its terminal 149 (which may be separate from or integral with the console), dimmer bank 109, and its associated lamp loads are the same as FIG. 4A.

201 is a processor-based system capable of supporting multiple users on multiple terminals. Those terminals may take the form of CRT terminals 205; networked PCs; or other terminal types. Terminals can be placed in proximity to various parts of the lighting system and the performing space, such as at the console, the dimmers, the location at which gels are prepared, and onstage. The specifications for the lighting system can be documented on a database program running on system 201 or prepared off-site and loaded into system 201 via disc 224 in disc drive 221 or via phone line 229 via modem 227. Once loaded, the data can be accessed from any terminal and printed by one or more printer 235.

FIG. 4B illustrates an embodiment in which the specification database is maintained in a hardware system separate from the lighting controller. It will be understood that common hardware can be used for all or part of both systems. For example, a lighting console can be provided with the additional firmware required to maintain the specification database. Or a general-purpose PC (or network of PCs) can be equipped in the known manner with a DMX512 or other serial output card (and, optionally, additional control surfaces) to serve as a lighting controller and further provided with such additional software and hardware as is required for specification database management.

Importantly, because multiple terminals are located at places at which information is needed, the designer, production electrician, and technicians have instant, on-line access to the most current system information. Because those terminals are also located where changes are made, it is easier to enter them, and once entered, the information for all users is simultaneously updated. Terminals, wired or wireless, portable or fixed, integrated with components of the lighting system or not, can afford keyed, keyless, graphic, and/or voice input and output of data.

Information can be displayed in tabular or graphic form. The location of fixtures can, for example, be displayed graphically as a "plot" or in tabular form as an "instrument roster". Entry in one form (for example, by picking and placing a symbol for a particular lamp on a two-dimensional "plot") should automatically make it available in the other. As an example, placing a symbol on a pipe, grid, or other structure during pre-production drafting will automatically assign the appropriate unit number to the new unit; renumber all higher-numbered units on the same position; and open a record in the database (resulting in the appearance of the unit in all tabular records, notably the instrument roster). (After the start of the setup, the new unit hung next to #2P-10 will become unit #2P-10A, rather than #2P-11, because the higher-numbered units, their cabling, and/or their color have probably been marked with unit numbers which it would be very disruptive to change.) On the other hand, inserting a new unit in the instrument roster will produce its entry as a graphic symbol on the "plot". Further, checks and correlations between the two form are possible. Although the instrument roster is tabular, it represents a display of records that, in this case, also contain dimensional data. Therefore, the distance between the two existing units between which the designer wishes to insert a new unit can be checked against stored data on minimum mounting centers, and the designer warned if there is insufficient space. For the same reason, a suitable printer can generate "hanging tapes" (for example, on calculator tapes) that each extend the length of a pipe or other linear lighting position and that print all relevant data for each fixture at the location of that fixture. A database of circuit locations in a permanent installations and cable lengths can be used as the basis for calculating the most appropriate cabling method and the required cable lengths. Stored weights can be used as to calculate total loads. A complete shop order (bill of materials) can be generated. As lighting equipment rental shops increasingly use computerized ordering and inventory-control systems, the "shop order" can be automatically annotated with each shop bidding's ordering code for each item and modemmed to the shop's computer system for estimating. The system can maintain a list of "resources" representing available equipment and flag discrepancies between the design and the available resources. And it can compare two different designs/shows in the same facility or the same show in two different facilities and determine the changes that need be made in the first to transform it into the second.

The database of specification data may also be used with other software programs that provide for calculation of beam size, shape, and effect; offline modeling and pre-programming of cues.

And it will be understood that the proposed system, components, and techniques have value in lighting systems that employ moving lights and color changers, for example.

In the specification database, each fixture may be assigned a record (or linked series of records) with fields specifying the location of the fixture, model, bulb, accessories, color, focus, etc. The physical topography of the lighting system can be related to the electrical topography of the system by the inclusion of jumper, circuit, dimmer, and channel fields in the unit record, or by maintaining, for example, a dimmer record with fields for circuits, and both circuit and channel fields in the unit record. The designer enters the desired channel number in the unit record. Once a circuit number is entered for the same unit (whether in pre-production or during the actual hang), the result is the specification of a dimmer in the case of a dimmer-per-circuit system and therefore the necessary soft-patch. In a system or portion of a system having a load-patch, the user can specify the dimmer to which the circuit is to be patched, or the program can make such assignments itself, in either event resulting in the specification of both load- and soft-patch.

Importantly, interaction is provided between the specification database management system and the lighting intensity control equipment.

For example, the soft-patch can be downloaded from the specification database to the console or patch unit via a compatible data carrier or other link.

In one method, the system 201 can mimic the key closures of a terminal or remote of the console or patch unit, (for example via line 147 in the case of the console 101 or lines 141 and 135 in the case of the patch unit 105) allowing the entry of the patch table without operator intervention or modification to the hardware or firmware of the console or patch unit. Further, when changes to the soft-patch are desired, they can be entered in any terminal 205 or 213 and both the soft-patch in the console 101 or patch unit 105 and the information available to all users are updated and conformed.

Conversely, by watching the keypresses made on the console 101 or patch unit 105 (e.g. via 145) the system 201 can interpret those keypresses to detect changes in the patch and automatically update the information available to the users via its terminals. Data can also be exchanged via a serial link or other port other than the RFU input.

In addition to the entry and updating of softpatches, other forms of interactivity can also be provided between the specification database and the console and any patch unit.

For example, keying the number of a given channel into the console 101 or patch unit 105 could, via one of the links earlier described, also bring up the records for those dimmers and fixtures that the selected channel controls, in tabular or graphic form, on a terminal adjacent to the console, and/or (with suitable modification to the console's firmware) via the console on the consoles own CRT.

Access to specification information and the ability to couple it with the lighting controller vastly improves the efficiency of the latter. Lighting controllers afford the designer access to numbered control channels, but offer no means of determining what any given channel controls without resort to specification information (a channel hookup, a plot, a "magic sheet", tape strips above faders) which may or may not be accurate. On-line access to current specification information permits the user to rapidly identify and control the desired channel(s), as well as to write cues and submasters far more rapidly. Recording a submaster, for example, including all PAR-64s in gel R80 requires only filing in the appropriate fields on a dialogue box.

Further, interactivity permits making compensating changes in cue data that reflect changes to the physical system. For example, changing a lamp type or gel color in the physical system can produce a prompt to the designer to examine the affected channels in those cues in which they are active to determine whether a change in recorded intensity is necessary. Changing channel assignments can generate corresponding changes in cue levels so that levels for the old channel recorded prior to the change are moved to the new channel.

Further, with access to the present intensity levels of channels and/or dimmers, system 201 can correlate the present status of the system with the specification database. For example, the listings for all fixtures presently illuminated and their associated channels and dimmers can be highlighted or otherwise marked on the terminals of system 201, whether in tabular or graphic form. Such access can be provided by interconnection with the console and/or patch unit or simply by monitoring the serial output of the console 101 and/or patch unit 105 to determine which dimmers have non-00 intensity levels.

In all cases, the graphic display of data can include not only a "plot" (realistic scale representation) but a "magic sheet".

By being capable of changing dimmer levels, the system 201 can turn on a desired fixture, channel, or dimmer identified by any one or set of parameters in the specification database (channel number, dimmer number, fixture number, fixture type, location, color, focus, etc.). It will be seen that this can be performed by driving the console 101 or patch unit 105 via the interface between them and system 201, or by driving the dimmer(s) directly.

For example, if the designer, production electrician, or a technician wish to light fixture #2P-10, they need only designate it on any terminal 205 or 213 and the system 201 will look up the necessary channel or dimmer and drive it via the console, patch unit, or directly. The ability to scroll through listings of the specification of the lighting system while the corresponding fixtures in the physical system light drastically increases the ease with which the physical system can be checked and focused.

The console can be fitted with a "mouse" or other two-axis input device. Passing the cursor across the channel number on the console's display (or its entry via the console's keypad) can trigger a display in a window on a console CRT or on another display of a listing of the dimmers and fixtures assigned to that channel, along with their related specification data. Depressing a button on the mouse can "goose" the channel or a specified dimmer. (This feature could also be provided without modification to the console's firmware, as most present "computer boards" use outboard commercial color monitors driven by an EGA or similar standard video output. A device could be interposed in the video lines that "reads" the channel numbers from the console's video output (given the predictable display format); superimposes the mouse- or other input device-driven cursor; and outputs the designated channel number to the system.

The same mouse or other two-axis input device can also be used to select and vary channel levels more rapidly than by keypad. Channels can be selected by clicking on the channel number field, and levels raised and lowered by moving the input device vertically, while holding a button depressed.

The input device can also be used to navigate through specification reports and graphic displays.

And it can be used to superimpose a pointer or line on a video signal (as, in the case of television lighting design, the ability of a lighting designer to point to a detail visible on the current output of his router is a very useful communications aid.)

By means of small wired or wireless handheld terminal 213, the designer or any other party can "goose" the first fixture to be focused by entering its unique code, channel, dimmer, or other identifier and without reference to a plot or printed form—or by pointing to it on a graphic display. The fixture is turned on for checking or focus, while the various specifications for that fixture are displayed on the terminal. In the application issuing as U.S. Pat. No. 5,319,301, included in its entirety by reference, such data is also disclosed as shown on a display incorporated in lighting equipment, and a "device monitor" disclosed. A terminal user can enter notes in the terminal, flagging the fixture as having been focused and/or as needing additional work, changes, or correction. When the designer is ready for the next fixture, because he or she can step through by sequential fixture number, the next adjacent fixture will light, although it is not necessarily on the next sequential channel or dimmer number. The need for a console operator is eliminated and many of the functions of a designer's assistant are provided.

In the matter of "notes", the system provides for their more efficient entry, distribution, management, and the updating of system specification information.

The majority of notes can be handled in a few simple variations:

Strike [specify unit, channel, function, or dimmer]

Move [specify unit, channel, function, or dimmer] to [specify new position, channel, function]

Add or Replace [specify unit record fields]

Repatch [specify unit, channel, function, or dimmer] to [specify channel or dimmer]

Recolor [specify unit, channel, function, or dimmer] to [specify new color]

For example, the entry of a note by the designer to change the color of the fixtures in a specified channel (a "Recolor" note) will, first, result in the system's determination of the specific fixtures controlled by that channel. It can produce a report at the terminal at the gel cutting and storage area, requesting the cutting of the new color and identifying the number and size of "cuts" as well as the fixture numbers with which they should be marked. Simultaneously, the note would appear on all terminals under a list of pending notes, sorted, for example, by the area of the lighting system in which the work was required, so that all the notes for a given location can be dealt with at the same time. Once the color had been changed, a technician would "check off" the note on a terminal, which would remove the note from the "pending" list (with an audit trail) and update the online data for those fixtures with the new color.

In another example, where the designer requires physically moving a fixture (a "Move" note) which, in turn, requires changing the outlet/circuit into which it is plugged, the technician performing the work would enter the new circuit number, which would not only complete the note and update both the soft-patch and the online data, but could "goose" the new dimmer to confirm operation of the fixture. Where a load-patch need be changed, the entry by the technician of the new circuit number would generate a "Repatch" note on the terminal at the load-patch location (a proviso also appearing on the pending "move" note that the unit was moved but not re-patched). When a technician changed the load-patch and "checked off" that change, the system would update the soft-patch, if required, and test the lamp. Once the note to move a lamp has been "checked off" by the technicians, the system can send the note back to the designer, querying him or her as to whether the moved fixture need be refocused. If so, it would be held as a "Refocus" note; if not, it would be marked "complete".

Notes can be entered graphically, the user pointing to the affected fixture on a "plot" and pointing to the new location for an "Add" or "Move".

It should be noted that a variety of methods for inputting to and outputting from system 201 are possible.

In addition to display on terminals and printouts (and, for example, large LED displays), voice synthesis can be used to output data via speaker 209, intercom 231, and/or wireless transmission 233. Data can be input not only via terminals but by speech recognition. Speech input and output are particularly appropriate because most such lighting data consists of numbers and a reasonably limited vocabulary of terms. Further, speaker-dependent recognition allows the system to recognize different users on a common medium, such that multiple users can access the system simultaneously and the system keep each "conversation" separate.

Thus, users can simply "talk" to the system 201 to query it for data; to ask for fixtures, dimmers, and channels to be energized and/or repatched; and to input changes in and data about the specifications of the lighting system.

Where the dimmers provide feedback as to the status of lamp loads, the system can not only check for the presence of a load on the appropriate dimmers, but identify for the user, the location and type of a fixture no longer appearing on a dimmer's output so that the user is directed to the appropriate fixture with the appropriate spare bulb. Where the dimmer itself does not sense the presence of load, a single set of current sensors at the dimmer rack or power service level can also be used, given the system periodically sequencing through dimmers one at a time (either adding or subtracting them) and looking for the value of the load change.

Particularly in cases where the production "hangs first and documents later", various methods of simplifying the entry of specification data are possible.

For example, the physical location of the fixture can be entered by swiping a bar-code label nearby. Because many lighting systems incorporate linear supporting structures for fixtures (e.g. pipes, trusses, ladders) and linear electrical raceways parallel to them a continuous bar code tape (e.g., 361 applied to raceway 360 in FIG. 4J) (or series of labels) can be produced and applied that returns a unique code for each location swiped. The bar code itself may encode a pipe number and footage along the pipe, or the coding may be arbitrary (in effect, a continuously increasing series of numbers that are mapped at installation by entering the location of and encoded number at each end of a strip). Discrete location labels are also possible. Another location entry technique uses ultrasonic or other position determining methods (including laser ranging to reference points) to establish the location of a handheld unit in three-dimensional space. Another technique uses RF tags or other transponders located about the facility. Another technique uses visible or IR LEDs or other radiators, radiating a code or in a manner that permits the sensing device to identify a radiator, and therefore its location, uniquely.

The type of fixture can be entered into a terminal manually or by voice. The fixture type can also be entered by scanning a bar code label on it, a label that can be (or is already) used for inventory control (e.g. 366A). An RF tag or other transponder can also be used and has the advantage of requiring less exact alignment by the reader. Such a transponder can be incorporated in or near a bolt-head or other point on the fixture (e.g. 367A) that would be adjusted during the set-up and the read head located on or in a wrench or glove, such that the act of hanging or adjusting the fixture will automatically cause a "read" of its type. Where the label or tag does not identify an aspect of the fixture (such as the presence of an optional or removable accessory), the hand-held terminal can prompt the user on scan with a list of the likely accessories, and the user then check off those present. Gel color, for example, can be typed or spoken in. Bar codes or tags can identify fixtures by type (i.e. all fixtures of the same model bear the same code) and/or uniquely. The ability to identify the fixture itself uniquely permits relating the fixture "serial number" to a specific unit record in the database. Thereafter, scanning the fixture can trigger the display of related data, and/or the "goosing" of the fixture.

The scanning or other sampling of location can be used to energize circuits. For example, where a raceway is marked with a bar code strip, scanning short sections of the strip located in proximity to a circuit outlet can cause the nearby circuit to be energized.

The circuit to which a fixture is plugged can also be identified by one or more of several methods. Where a female outlet is permanently attached to a circuit (for example, the pigtail on a raceway) (e.g. 363A) a bar code label (e.g. 364A) or transponder can be attached to the connector or raceway. Scanning the label or transponder on or near the receptacle identifies the circuit; typing or speaking a channel number would provide the data needed to soft-patch the circuit to the required channel; and scanning and/or manually or verbally entering the fixture type, accessories, and gel color would enter all the remaining necessary basic specification data for most tabular reports. By also entering the fixture location, the data for an accurate graphical representation of the system is supplied.

Because a permanently-installed outlet is at a fixed physical location and an effort is made to plug fixtures into the closest outlet, the entry of a circuit/dimmer number provides some initial specification of location, which can be overridden by scanning or by manually entering a fixture location.

When a fixture is connected by one or more extension cables, it is difficult to determine at other locations which cable/circuit that may be, unless the cables are physically traced back to their source, which can be difficult and subject to error. Ideally, each connector on each cable was labeled with the circuit number during the set-up or the preparation for it, but such labeling is not always done, and when the cable is reused for a different fixture or connected to a different circuit at the male end, seldom corrected.

One method of addressing this problem is to supply extension cables with their own unique codes. Scanning the male end of the cable (e.g., label 369B on connector 368B) and an outlet (e.g., label 364B on connector 363B) associates the cable 372B with a dimmer or circuit. Scanning the female end (e.g., label 371B on connector 370B) and a fixture (e.g., label 366B on fixture 365B) associates the cable 372B with the fixture. By relating dimmer to cable and cable to fixture, scanning any one element can produce a display of all available data for the dimmer, circuit, cable, and fixture.

Another method is the previously disclosed technique of encoding data onto a dimmer or power controller output. As previously described, the user can touch a handheld unit to a cable or fixture and read out the dimmer to which it is connected (or determine that it is connected to no dimmer at all). With a connection from the handheld to the centralized portions of the system by means of the power wiring, a broadcast link, and/or wired connection, the user can "goose" the dimmer and fixture from his or her present location, as well as associating other data (like a channel and/or fixture number) with it for entry into a database record. With a connection from the centralized portion of the system (through the dimmer and its power output or via another route and/or onboard storage of data), the user can read out the channel to which the dimmer is patched as well as any relevant data about the channel, dimmer, circuit, or fixtures that are or should be connected to it.

In addition to or in lieu of employing permanent bar code labels or other identifiers, temporary labels or identifiers can also be employed. A data management system can printout tags or labels for application to cables and connectors with information in both text and in bar-code or other machine-readable form. Portable printers can be employed with or linked to handheld terminals to generate labels reflecting the results of scanning or manual entry, including by sensing the motions of a pen or marker making a manual entry on a fixture or label.

Programmable RFID transponders can be written or overwritten with additional data.

As has been described, in prior art systems it can be difficult to determine whether a given circuit or cable is connected to a dimmer.

Many prior art thyristor-based dimmers produce a small leakage current even when "off" that causes false indication by some forms of voltage tester that the dimmer is "on". Placing a load across the output shunts the leakage current and produces a more accurate reading. A handheld tester that switches a suitable load in and out of a circuit and senses whether voltage is present across the load in both the shunted and unshunted conditions can determine whether the circuit is connected to a dimmed or an undimmed supply.

Sensing the conductive or-non-conductive period or proportion of an AC waveform permits determining that a dimmer is supplying less than full power to a load and the display of the corresponding percentage value.

Reproduction of a manual focus at a later date may require noting the azimuth and elevation adjustment of the fixture, as well as the settings of its shutters and barndoors and, in the case of television studios putting fixtures on "stirrup hangers" or other means of adjusting the height of a fixture below its nominal hanging point, fixture height. By incorporating both an angle and a direction sensor into a handheld with, for example, a beveled groove that will nest with either rectangular or cylindrical housings of lighting fixtures, touching the bevel against the fixture housing and pressing a "read" button allows storing the azimuth and elevation adjustment, which can be reproduced at a later date by holding the handheld against the fixture and adjusting it until the display shows a match to the earlier value. A handheld can be used in a similar fashion to read the settings of barndoors. Barndoors, shutters, spot/flood and focus adjustments on fixtures can be equipped with features that simplify scanning (resistance or inductance elements, 1D or 2D bar code). Such elements could also be used as part of a feedback system when the fixture were fitted with optional motors for remote-control/automation. Terminals can also provide for the user sketching the beam shape and entering its location onstage numerically and/or graphically.

The use of a visible laser or laser diode for scanning bar codes also makes it available for use as a pointing device; for modulated communication with distant fixtures, accessories, and devices with data links; and as an alignment device for highly-directional but non-visible data links.

Other improvements relate to methods by which the user can "goose" dimmers in a lighting system, with or without a database capability, and with or without a dedicated handheld remote.

One such improvement locates one switch or other actuator at or near the outlets of a lighting system. This actuator can take the form of a pushbutton. Such pushbuttons (for example, 115 of FIG. 4B) can be connected to at least one processing unit (131) via low-voltage wiring. Upon depressing a pushbutton, the processing unit can "goose" the dimmer connected to that outlet by applying a control signal to it. This control signal can be applied either by instructing the control console to do so (by mimiccing the appropriate button presses of a remote focus unit (RFU) at the RFU input of the console or), or by adding levels to the multiplexed output signal from the console before it reaches the dimmers, as has been disclosed in detail in the application issuing as the '301 patent.

In a dimmer-per-circuit system, the relationship between outlet and dimmer is fixed, and therefore the relationship between the pushbutton pressed and the dimmer "goosed" will be fixed, and need be entered only once, at installation.

In systems or portions of a system in which a load-patch is found, a given outlet connected through the load-patch has no fixed relationship to any particular dimmer. This relationship, which is (or at least should be) specified in the paperwork, can be entered either manually or from the specification database via a file transfer such that pressing the button associated with an outlet will cause the stimulation of the dimmer that should be load-patched to that outlet.

With the addition of means for sensing the presence of voltage and/or current on the load-patched circuits themselves, the determination of the load-patch can be made automatic. During set-up, for example, the dimmers can be stimulated rapidly and sequentially and the voltage and/or current sensors watched to see which circuits respond during the period that a given dimmer is firing. (Dimmers at level can be very briefly pulled down.) The results can be used to produce a table of the load-patch, which, thereafter, provides the correlation between pushbuttons and dimmers, and can be incorporated into the lighting database. Where a database is already present, the actual load-patch can be compared with the one planned and any discrepancies flagged. When, of course, changes are made in the load-patch, a regular scan of the load-patch will detect them and flag them for the user who can accept them (updating the "paperwork") or correct them.

In one example of a system with a load-patched portion but no sensors, one group of technicians might hang fixtures in the front-of-house of a theater, plugging them to circuits at will and scanning the circuit number at the position and entering, from a plot, the fixture's identifying code (e.g. BBL-12). The database will then display on the terminal at the load-patch location, the correct load-patch, given the specified soft-patch, or generate both load- and soft-patch. With sensors and in an extreme example, the technicians could hang and plug fixtures in any order and do the load-patch in any order and, so long as the desired relationship between the fixture and a channel was known (by associating a circuit number with a channel either directly or via a fixture number) the system could soft-patch to compensate for the essentially random choice of circuits and load-patch.

Although a single button (or other actuator) might be provided for each circuit, it can serve several functions. Depressing and releasing a circuit's button would turn the associated dimmer on and can, if the system is so equipped, cause output of relevant data through a display or voice link. Pressing and releasing the same button again will release the "goose". Pressing and holding the button for a circuit for more than (for example) three seconds before releasing it, whether the circuit is then "goosed" or not, can be taken as an instruction to goose all dimmers that are soft-patched to the same channel. Because fixtures are frequently focused in a sequence along a pipe or truss, pressing the button for the circuit next to a goosed circuit can be taken not only as an instruction to "goose" that circuit, but to "ungoose" the adjacent one. Two adjacent circuits can be "goosed" simultaneously by pressing and releasing their buttons at the same time. The system can be provided with a "time-out" that clears all "gooses" after a defined period of inactivity and/or after any button is held for (for example) ten seconds.

Figure 4G:
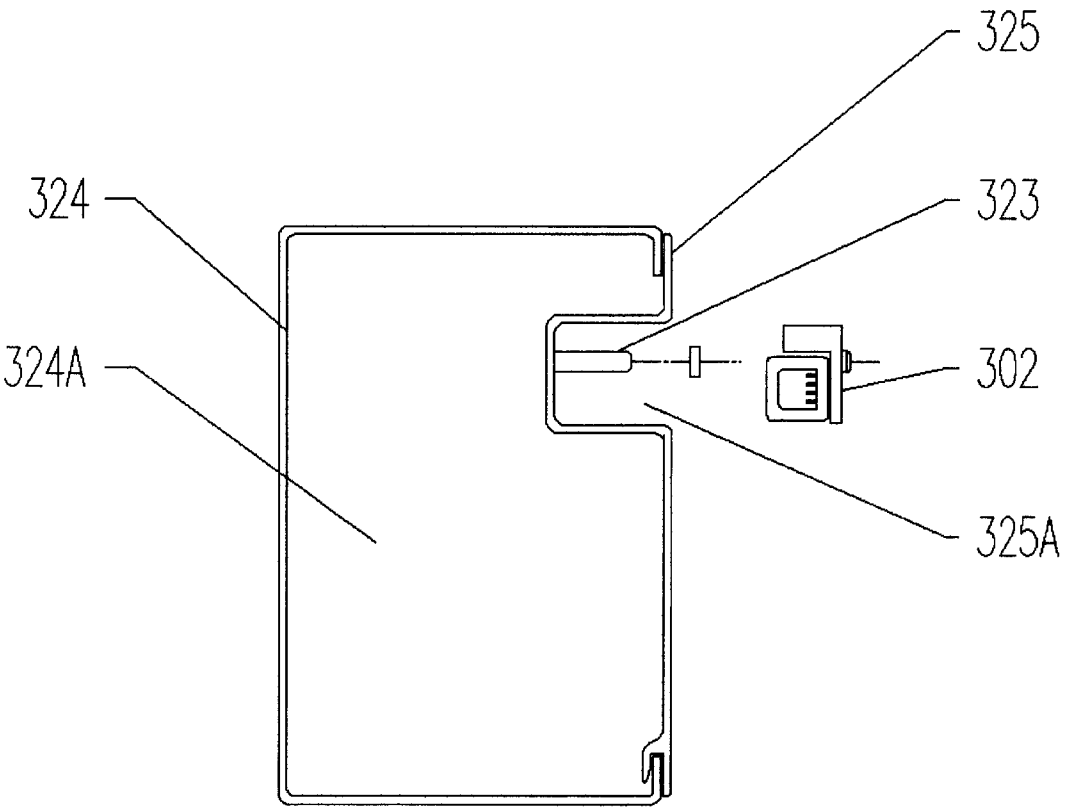
FIG. 4G is a section through an electrical raceway with a cover designed to mount the components of the pushbutton station of FIG. 4C.
Figure 4H:
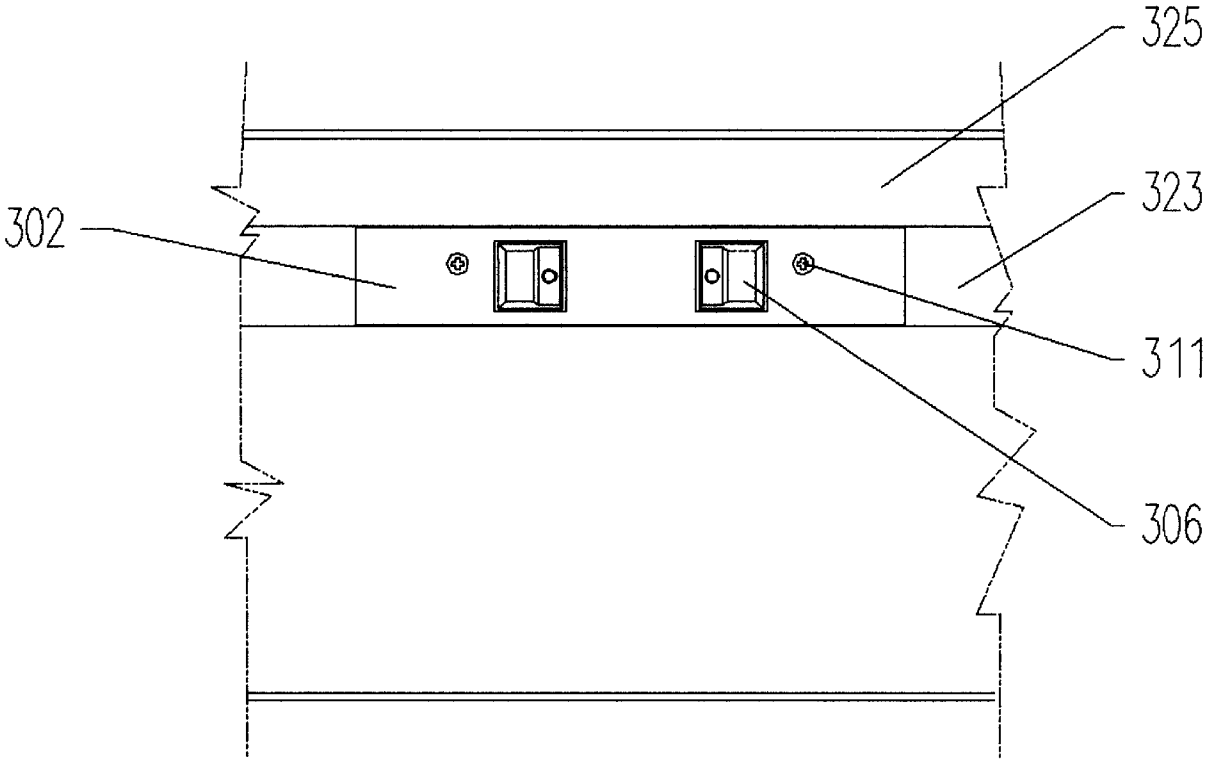
FIG. 4H is a front elevation of the electrical raceway and cover of FIG. 4G.
Figure 4I:
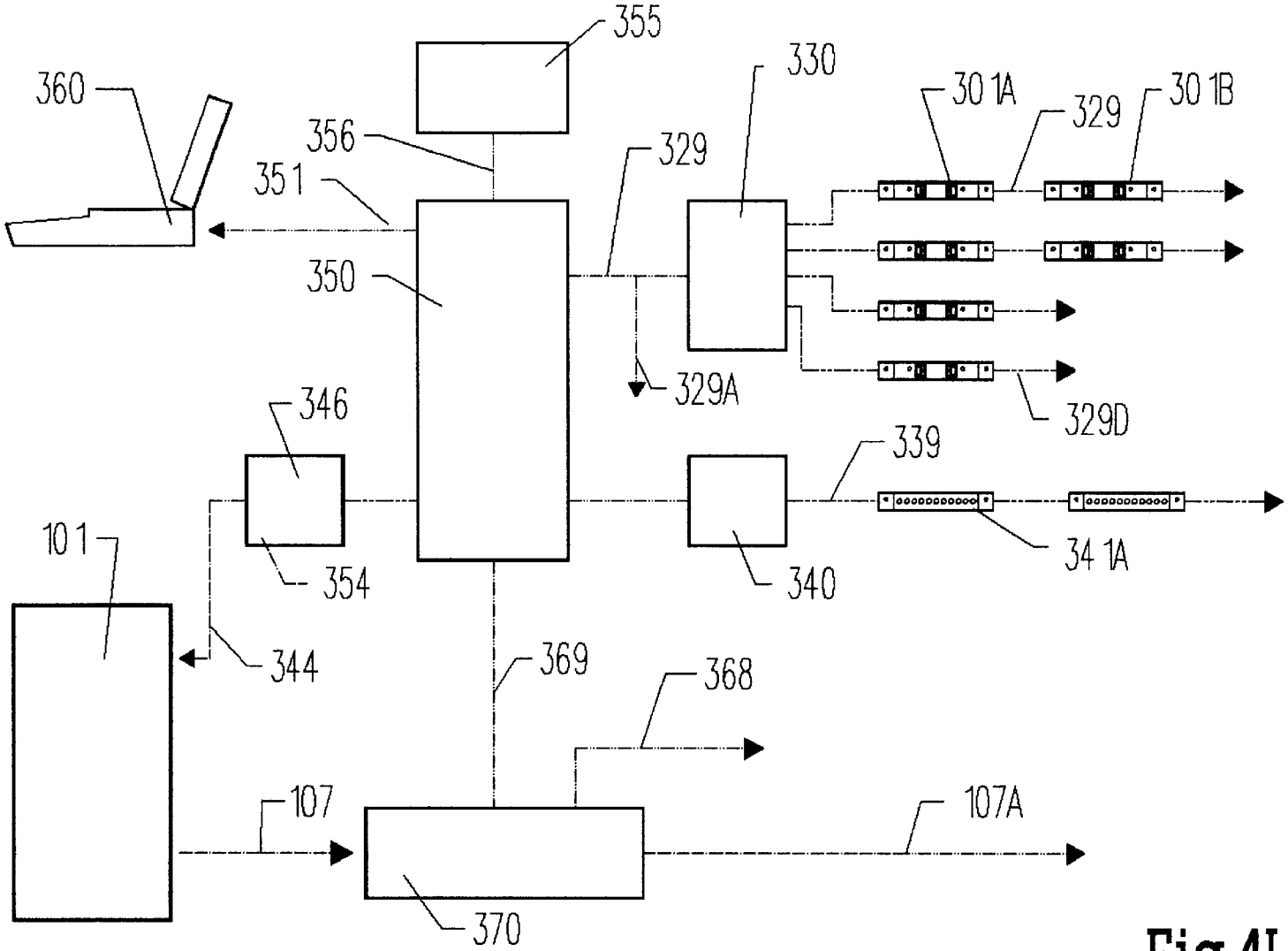
FIG. 4I is a block diagram of a system interfacing the pushbutton station of FIG. 4C and other components to the lighting control system.
Figure 4J:
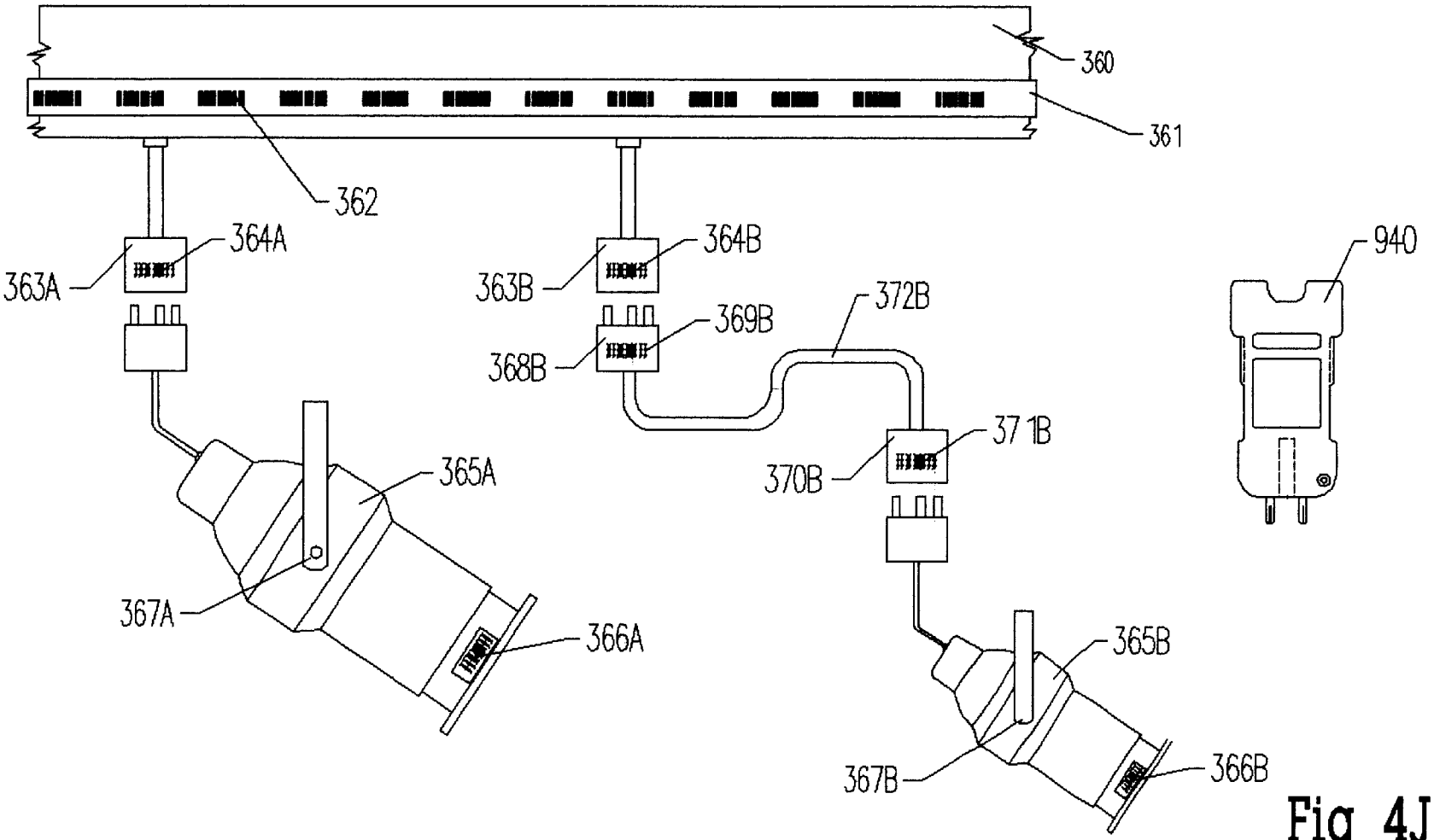
FIG. 4J illustrates a portion of a lighting system including scannable identifiers for fixtures, circuits, and locations.

Such actuators can take many forms. FIGS. 4C–4F shows a small sheet metal or plastic enclosure whose Pan portion 303 can be mounted with bolts, rivets, or screws (via holes 309), double-stick tape, velcro, or wire ties (via holes 321). A "Termination Card" 316 mounted in the Pan 303 is connected with other elements of the system via either modular RJ-11 cables (via jacks 314) or hard wire connected via a Mass-Con connector 315 or punch-down terminals. The Termination Card 316 is addressed by any one of a number of means, such as the DIP switch 317 shown. A Cover 301 mounting, in this example, two pushbuttons 305 and 306, each with an associated LED (e.g. 307), incorporates the active electronics. FIGS. 4G and 4H show how the same Cover 302 and Termination card 316 can be mounted in the braked or extruded cover 325 of a standard raceway 324. The block diagram of FIG. 4I shows how a series of Pushbutton Units 301 can be assembled into a larger system having various features described (including interface to a console 101 through its RFU jack (via 344) and injection of "goosed" levels into the DMX512 data stream 107 by injector 370).

Other possible actuators include linear switches (resistive and capacitive tapeswitches, fiber optic, and membrane switches) that permit identifying the location of a press. Such linear switches could be printed with or paralleled by bar code or other location codes. Where a lamp is hung at one location and plugged at another, association (by manual entry or "swipe") of the circuit with the location would allow swiping the location code above the lamp (or pressing the linear switch there, between points permanently assigned to a circuit) to serve as a "goose" of the lamp even though the nominal goose button was located elsewhere.

Although the pushbutton unit illustrated in FIGS. 4C–4H can be located between each pair of outlets, affording one button per circuit, it is not necessary that one pushbutton or its equivalent be provided for each circuit. In the example of a series of circuits along a raceway or in a plugging box, the system need only maintain the sequence of circuits/dimmers and the nearest (or most appropriate) starting circuit to each pushbutton station. For example, pressing either button on a pushbutton unit 301 located at the center of a balcony rail or a pipe would "goose" the nearest outlet, and repeated presses of one button would step the "goose" in one direction through the sequence/along the position, and presses of the other switch, in the other direction.

The wiring used to connect pushbutton stations (e.g. 329) can have additional pairs serving additional purposes, such as distributing DMX or other signals to and from the fixture locations for use by color scrollers and other consumers. The same wiring can distribute database data to the pushbutton enclosures, which then display and/or radiate them via either visible or IR LEDs or other means to handheld units. Pushbutton enclosures can also mount detectors/receivers that accept encoded data from users via IR links and hard-wire them back to the centralized portion of the system. The block diagram of FIG. 4I also illustrates how a separate system of emitters and/or detectors (e.g. 341A) can be distributed about the performance space. Voice can be distributed through the same system.

Nor need the actuators be fixed. A handheld remote that links by IR or other wireless means can be used to enter "gooses". Where the system can locate the remotes (for example, because a given handheld's output is being received only, or best, at a particular detector), the "gooses" will be started at the nearest outlet. A separate means of locating the handheld, such as its receipt of a unique signal from a nearby coded radiator or a swipe of a nearby bar-code or tag, can be used to identify its location. Further, laser diodes can be used to designate a particular detector to establish location and, thereafter, a less directional transmitter used.

The "handheld" can be very small—in fact recent wristwatches that mimic TV remotes could be used.

In this context, the term "handheld" refers generally to a portable unit that can be carried or worn by the user.

Communication of data within and relating to the lighting system can be by many means. For example, broadcast radio and infrared links are useable. Previous applications have, for example, also disclosed the benefits of linear fiber optic radiators and receivers in data distribution, although spread spectrum radio, lossy coaxial cables, and magnetically-coupled transmission are among the other choices. The instant application discloses other methods.

It should be noted that because, in permanent installations, circuits are installed through the facility at fixed spacial locations, a two-axis input device, like a mouse or trackball can also be used to drive the "goose" across a stored "map" of the circuit locations. In the example of the circuits on a grid, the two axes of movement of the input device can correspond to the two axes of the studio. Similarly, a two-axis input device can be used to move across a "plot" (whether displayed or not), goosing the fixtures.

In circumstances where users may not have hands free (such as when climbing a truss) a voice input can offer advantages. Another approach makes use of a pressure sensor connected to a small mouthpiece. The user can blow for "next" and inhale for "last", such an approach being essentially immune to high levels of ambient noise. The proximity method can be used to set the starting address or the user can key one in. The "sniffer" approach, particularly with the read head built into a glove or wristband can cause the act of touching a fixture to be adjusted to light that fixture and (optionally) trigger a read back of data about that fixture.

The "handheld" unit may or may not be integrated with a unit for testing for the presence of power and/or the condition of the fixture.

What is claimed is:

1. An apparatus comprising:

a semiconductor power controller for selectively coupling a lamp load to an alternating current supply, said lamp load at a location remote from said semiconductor power controller, said semiconductor power controller having a power output coupled to said lamp load, said alternating current supply supplying alternating current, said alternating current having half-cycles, said semiconductor power controller responsive to a control input;

a control circuit coupled with said control input of said semiconductor power controller, said control circuit having an input and accepting a first value at said input indicating a desired amount of power to be supplied to said lamp load, said control circuit determining those portions of said half-cycles in which said semiconductor power controller couples said alternating current supply to said lamp load so as to supply said desired amount of power to said lamp load;

said control circuit further accepting at least one additional value not a desired amount of power value and varying those portions of said half-cycles at which said semiconductor power controller couples said alternating current supply to said lamp load so as to encode said additional value so as to be decodable in said power output.

2. The apparatus according to claim 1, wherein said control circuit varies said portions of said half-cycles so as to substantially deliver said desired amount of power to said lamp load.

3. The apparatus according to claim 1, wherein said remote lamp load produces a light beam, and wherein the apparatus further includes a remote controller at the lamp load, the remote controller varying at least one additional parameter of said light beam;

wherein the control circuit encodes a value corresponding to a desired adjustment of the additional parameter; and wherein the remote controller decodes the encoded value, and adjusts the light beam in the remote lamp load in response thereto.

4. An apparatus comprising:

a semiconductor power controller for variably controlling the amount of average power applied to a lamp load from an alternating current supply, said lamp load at a location remote from said semiconductor power controller, said semiconductor power controller having a power output coupled to said lamp load, said alternating current supply supplying alternating current, said alternating current having half-cycles, said semiconductor power controller responsive to a control input;

a control circuit coupled with said control input of said semiconductor power controller, said control circuit having an input and accepting a first value at said input as indicating a desired amount of power to be supplied to said lamp load;

said control circuit further accepting at least one additional value and varying the average power supplied to said lamp load from said desired amount of power in each of a plurality of said half-cycles so as to encode said additional value in said power output.

5. The apparatus according to claim 4, wherein said control circuit varies said average power supplied in said half-cycles so as to substantially deliver said desired amount of power to said lamp load on average.

6. The apparatus according to claim 4, wherein said remote lamp load produces a light beam, and wherein the apparatus further includes a remote controller at the lamp load, the remote controller varying at least one additional parameter of said light beam;

wherein the control circuit encodes a value corresponding to a desired adjustment of the additional parameter; and wherein the remote controller decodes the encoded value, and adjusts the light beam in the remote lamp load in response thereto.

7. A method of operation for a dimmer, said dimmer having a control input, comprising the steps of:

coupling a semiconductor power controlling means between an alternating current supply and a lamp load, said semiconductor power controlling means being spaced apart;

inputting a first value identifying a desired amount of power for said lamp load;

accepting at least a second value for transmission;

varying the conductive condition of said semiconductor power controlling means so as to introduce detectable variations in the power supplied to said lamp load that encode said second value.

* * * * *